US011058271B2

(12) United States Patent
Blouin

(10) Patent No.: US 11,058,271 B2
(45) Date of Patent: Jul. 13, 2021

(54) VACUUM BRUSH

(71) Applicant: iRobot Corporation, Bedford, MA (US)

(72) Inventor: Matthew Blouin, Townsend, MA (US)

(73) Assignee: iRobot Corporation, Bedford, MA (US)

( * ) Notice: Subject to any disclaimer, the term of this patent is extended or adjusted under 35 U.S.C. 154(b) by 165 days.

(21) Appl. No.: 16/429,430

(22) Filed: Jun. 3, 2019

(65) Prior Publication Data

US 2019/0350420 A1 Nov. 21, 2019

Related U.S. Application Data

(63) Continuation of application No. 14/325,997, filed on Jul. 8, 2014, now Pat. No. 10,314,449, which is a continuation of application No. 13/028,996, filed on Feb. 16, 2011, now Pat. No. 8,800,107.

(60) Provisional application No. 61/304,886, filed on Feb. 16, 2010.

(51) Int. Cl.
*A47L 9/04* (2006.01)

(52) U.S. Cl.
CPC ..... *A47L 9/0477* (2013.01); *A47L 9/0427* (2013.01); *A47L 9/0455* (2013.01)

(58) Field of Classification Search
CPC ..... A47L 9/0477; A47L 9/0427; A47L 9/0455
See application file for complete search history.

(56) References Cited

U.S. PATENT DOCUMENTS

| | | | |
|---|---|---|---|
| 510,066 | A | 12/1893 | Guise |
| 1,755,054 | A | 4/1930 | Darst |
| 1,780,221 | A | 11/1930 | Buchmann |
| 1,970,302 | A | 8/1934 | Gerhardt |
| 1,999,696 | A | 4/1935 | Kitto |
| 2,136,324 | A | 11/1938 | Simon |
| 2,176,769 | A | 10/1939 | Martinet |
| 2,302,111 | A | 11/1942 | Dow et al. |
| 2,353,621 | A | 7/1944 | Replogle |
| 2,770,825 | A | 11/1956 | Pullen |
| 3,119,369 | A | 1/1964 | Harland et al. |

(Continued)

FOREIGN PATENT DOCUMENTS

| | | |
|---|---|---|
| AU | 2003275566 A1 | 6/2004 |
| CN | 1806740 | 7/2006 |

(Continued)

OTHER PUBLICATIONS

Maschinemarkt Wiirzburg 105, Nr. 27, 30, (Jul. 5, 1999), 3.

(Continued)

*Primary Examiner* — Andrew A Horton
(74) *Attorney, Agent, or Firm* — Schwegman Lundberg & Woessner, P.A.

(57) ABSTRACT

A rotating cleaning element configured to be inserted in a cleaning head compartment of a robotic vacuum, the rotating cleaning element including: a drive end including a drive protrusion configured to engage a drive mechanism of the cleaning head compartment; a bearing end and a shroud configured to surround at least a portion of the bearing end to lessen an amount of hair and similar matter that reaches the bearing; and a central member extending between the bearing end and the drive end.

20 Claims, 23 Drawing Sheets

(56) References Cited

U.S. PATENT DOCUMENTS 3,166,138 A 1/1965 Dunn, Jr.
3,216,047 A 11/1965 Carl-Oskar Ernolf
3,333,564 A 8/1967 Waters
3,375,375 A 3/1968 Abbey et al.
3,381,652 A 5/1968 Schaefer et al.
3,457,575 A 7/1969 Bienek
3,550,714 A 12/1970 Bellinger
3,569,727 A 3/1971 Aggarwal et al.
3,639,941 A 2/1972 Kirwan et al.
3,674,316 A 7/1972 Brey
3,678,882 A 7/1972 Kinsella
3,744,586 A 7/1973 Leinauer
3,756,667 A 9/1973 Bombardier et al.
3,809,004 A 5/1974 Leonheart
3,816,004 A 6/1974 Bignardi
3,845,831 A 11/1974 James
RE28,268 E 12/1974 Autrand
3,853,086 A 12/1974 Asplund
3,863,285 A 2/1975 Hukuba
3,888,181 A 6/1975 Kups
3,937,174 A 2/1976 Haaga
3,952,361 A 4/1976 Wilkins
3,989,311 A 11/1976 Debrey
3,989,931 A 11/1976 Phillips
3,993,017 A 11/1976 De Brey
4,004,313 A 1/1977 Capra
4,012,681 A 3/1977 Finger et al.
4,070,170 A 1/1978 Leinfelt
4,099,284 A 7/1978 Shinozaki et al.
4,119,900 A 10/1978 Kremnitz
4,175,589 A 11/1979 Ichiryu et al.
4,175,892 A 11/1979 De Brey
4,196,727 A 4/1980 Kippel et al.
4,198,727 A 4/1980 Farmer
4,199,838 A 4/1980 Simonsson
4,209,254 A 6/1980 Hidalgo et al.
4,219,902 A 9/1980 Demaagd
D258,901 S 4/1981 Keyworth
4,297,578 A 10/1981 Carter
4,306,329 A 12/1981 Yokoi et al.
4,309,758 A 1/1982 Halsall et al.
4,328,545 A 5/1982 Halsall et al.
4,367,403 A 1/1983 Miller
4,369,543 A 1/1983 Chen et al.
4,401,909 A 8/1983 Gorsek
4,416,033 A 11/1983 Specht
4,429,430 A 2/1984 Lyman
4,445,245 A 5/1984 Lu
4,465,370 A 8/1984 Yuasa et al.
4,477,998 A 10/1984 You
4,481,692 A 11/1984 Kurz
4,482,960 A 11/1984 Pryor
4,492,058 A 1/1985 Goldfarb et al.
4,513,469 A 4/1985 Godfrey et al.
D278,732 S 5/1985 Ohkado
4,518,437 A 5/1985 Sommer
4,534,637 A 8/1985 Suzuki et al.
4,556,313 A 12/1985 Miller, Jr. et al.
4,575,211 A 3/1986 Matsumura et al.
4,580,311 A 4/1986 Kurz
4,601,082 A 7/1986 Kurz
4,618,213 A 10/1986 Chen
4,620,285 A 10/1986 Perdue
4,624,026 A 11/1986 Olson et al.
4,626,995 A 12/1986 Lofgren et al.
4,628,454 A 12/1986 Ito
4,638,445 A 1/1987 Mattaboni
4,644,156 A 2/1987 Takahashi et al.
4,649,504 A 3/1987 Krouglicof et al.
4,652,917 A 3/1987 Miller
4,654,492 A 3/1987 Koerner et al.
4,654,924 A 4/1987 Getz et al.
4,660,969 A 4/1987 Sorimachi et al.
4,662,854 A 5/1987 Fang
4,674,048 A 6/1987 Okumura
4,679,152 A 7/1987 Perdue
4,680,827 A 7/1987 Hummel
4,696,074 A 9/1987 Cavalli
D292,223 S 10/1987 Trumbull
4,700,301 A 10/1987 Dyke
4,700,427 A 10/1987 Knepper
4,703,820 A 11/1987 Reinaud
4,710,020 A 12/1987 Maddox et al.
4,716,621 A 1/1988 Zoni
4,728,801 A 3/1988 Oconnor
4,733,343 A 3/1988 Yoneda et al.
4,733,430 A 3/1988 Westergren
4,733,431 A 3/1988 Martin
4,735,136 A 4/1988 Lee et al.
4,735,138 A 4/1988 Gawler et al.
4,748,336 A 5/1988 Fujie et al.
4,748,833 A 6/1988 Nagasawa
4,756,049 A 7/1988 Uehara
4,767,213 A 8/1988 Hummel
4,769,700 A 9/1988 Pryor
4,777,416 A 10/1988 George, II et al.
D298,766 S 11/1988 Tanno et al.
4,782,550 A 11/1988 Jacobs
4,796,198 A 1/1989 Boultinghouse et al.
4,806,751 A 2/1989 Abe et al.
4,811,228 A 3/1989 Hyyppae
4,813,906 A 3/1989 Matsuyama et al.
4,815,157 A 3/1989 Tsuchiya
4,817,000 A 3/1989 Eberhardt
4,818,875 A 4/1989 Weiner
4,829,442 A 5/1989 Kadonoff et al.
4,829,626 A 5/1989 Haerkoenen et al.
4,832,098 A 5/1989 Palinkas et al.
4,851,661 A 7/1989 Everett, Jr.
4,854,000 A 8/1989 Takimoto
4,854,006 A 8/1989 Nishimura et al.
4,855,915 A 8/1989 Dallaire
4,857,912 A 8/1989 Everett, Jr. et al.
4,858,132 A 8/1989 Holmquist
4,867,570 A 9/1989 Sorimachi et al.
4,880,474 A 11/1989 Koharagi et al.
4,887,415 A 12/1989 Martin
4,891,762 A 1/1990 Chotiros
4,893,025 A 1/1990 Lee
4,901,394 A 2/1990 Nakamura et al.
4,905,151 A 2/1990 Weiman et al.
4,912,643 A 3/1990 Beirne
4,918,441 A 4/1990 Bohman
4,919,224 A 4/1990 Shyu et al.
4,919,489 A 4/1990 Kopsco
4,920,060 A 4/1990 Parrent, Jr. et al.
4,920,605 A 5/1990 Takashima
4,933,864 A 6/1990 Evans, Jr. et al.
4,937,912 A 7/1990 Kurz
4,953,253 A 9/1990 Fukuda et al.
4,954,962 A 9/1990 Evans, Jr. et al.
4,955,714 A 9/1990 Stotler et al.
4,956,891 A 9/1990 Wulff
4,961,303 A 10/1990 Mccarty et al.
4,961,304 A 10/1990 Ovsborn et al.
4,962,453 A 10/1990 Pong, Jr. et al.
4,971,591 A 11/1990 Raviv et al.
4,973,912 A 11/1990 Kaminski et al.
4,974,283 A 12/1990 Holsten et al.
4,977,618 A 12/1990 Allen
4,977,639 A 12/1990 Takahashi et al.
4,986,663 A 1/1991 Cecchi et al.
5,001,635 A 3/1991 Yasutomi et al.
5,002,145 A 3/1991 Wakaumi et al.
5,012,886 A 5/1991 Jonas et al.
5,018,240 A 5/1991 Holman
5,020,186 A 6/1991 Lessig, III et al.
5,022,812 A 6/1991 Coughlan et al.
5,023,788 A 6/1991 Kitazume et al.
5,024,529 A 6/1991 Svetkoff et al.
D318,500 S 7/1991 Malewicki et al.
5,032,775 A 7/1991 Mizuno et al.
5,033,151 A 7/1991 Kraft et al.
5,033,291 A 7/1991 Podoloff et al.

(56) References Cited

U.S. PATENT DOCUMENTS 5,040,116 A 8/1991 Evans, Jr. et al.
5,045,769 A 9/1991 Everett, Jr.
5,049,802 A 9/1991 Mintus et al.
5,051,906 A 9/1991 Evans, Jr. et al.
5,062,819 A 11/1991 Mallory
5,070,567 A 12/1991 Holland
5,084,934 A 2/1992 Lessig, III et al.
5,086,535 A 2/1992 Grossmeyer et al.
5,090,321 A 2/1992 Abouav
5,093,955 A 3/1992 Blehert et al.
5,094,311 A 3/1992 Akeel
5,105,502 A 4/1992 Takashima
5,105,550 A 4/1992 Shenoha
5,109,566 A 5/1992 Kobayashi et al.
5,115,538 A 5/1992 Cochran et al.
5,127,128 A 7/1992 Lee
5,136,675 A 8/1992 Hodson
5,136,750 A 8/1992 Takashima et al.
5,142,985 A 9/1992 Stearns et al.
5,144,471 A 9/1992 Takanashi et al.
5,144,714 A 9/1992 Mori et al.
5,144,715 A 9/1992 Matsuyo et al.
5,152,028 A 10/1992 Hirano
5,152,202 A 10/1992 Strauss
5,155,684 A 10/1992 Burke et al.
5,163,202 A 11/1992 Kawakami et al.
5,163,320 A 11/1992 Goshima et al.
5,164,579 A 11/1992 Pryor et al.
5,165,064 A 11/1992 Mattaboni
5,170,352 A 12/1992 Mctamaney et al.
5,173,881 A 12/1992 Sindle
5,182,833 A 2/1993 Yamaguchi et al.
5,202,742 A 4/1993 Frank et al.
5,204,814 A 4/1993 Noonan et al.
5,206,500 A 4/1993 Decker et al.
5,208,521 A 5/1993 Aoyama
5,216,777 A 6/1993 Moro et al.
5,227,985 A 7/1993 DeMenthon
5,233,682 A 8/1993 Abe et al.
5,239,720 A 8/1993 Wood et al.
5,251,358 A 10/1993 Moro et al.
5,261,139 A 11/1993 Lewis
5,272,785 A 12/1993 Stegens
5,276,618 A 1/1994 Everett, Jr.
5,276,939 A 1/1994 Uenishi
5,277,064 A 1/1994 Knigga et al.
5,279,672 A 1/1994 Betker et al.
5,284,452 A 2/1994 Corona
5,284,522 A 2/1994 Kobayashi et al.
5,293,955 A 3/1994 Lee
D345,707 S 4/1994 Alister
5,303,448 A 4/1994 Hennessey et al.
5,307,273 A 4/1994 Oh et al.
5,309,592 A 5/1994 Hiratsuka
5,310,379 A 5/1994 Hippely et al.
5,315,227 A 5/1994 Pierson et al.
5,319,827 A 6/1994 Yang
5,319,828 A 6/1994 Waldhauser et al.
5,321,614 A 6/1994 Ashworth
5,323,483 A 6/1994 Baeg
5,324,948 A 6/1994 Dudar et al.
5,341,186 A 8/1994 Kato
5,341,540 A 8/1994 Soupert et al.
5,341,549 A 8/1994 Wirtz et al.
5,345,649 A 9/1994 Whitlow
5,353,224 A 10/1994 Lee et al.
5,363,305 A 11/1994 Cox et al.
5,363,935 A 11/1994 Schempf et al.
5,369,347 A 11/1994 Yoo
5,369,838 A 12/1994 Wood et al.
5,386,862 A 2/1995 Glover et al.
5,399,951 A 3/1995 Lavallee et al.
5,400,244 A 3/1995 Watanabe et al.
5,404,612 A 4/1995 Ishikawa
5,410,479 A 4/1995 Coker
5,435,038 A 7/1995 Sauers
5,435,405 A 7/1995 Schempf et al.
5,440,216 A 8/1995 Kim
5,442,358 A 8/1995 Keeler et al.
5,444,965 A 8/1995 Colens
5,446,356 A 8/1995 Kim
5,446,445 A 8/1995 Bloomfield et al.
5,451,135 A 9/1995 Schempf et al.
5,452,490 A 9/1995 Brundula et al.
5,454,129 A 10/1995 Kell
5,455,982 A 10/1995 Armstrong et al.
5,465,451 A * 11/1995 Stegens ..... A46B 13/001 15/179
5,465,525 A 11/1995 Mifune et al.
5,465,619 A 11/1995 Sotack et al.
5,467,273 A 11/1995 Faibish et al.
5,471,560 A 11/1995 Allard et al.
5,491,670 A 2/1996 Weber
5,497,529 A 3/1996 Boesi
5,498,948 A 3/1996 Bruni et al.
5,502,638 A 3/1996 Takenaka
5,505,072 A 4/1996 Oreper
5,507,067 A 4/1996 Hoekstra et al.
5,510,893 A 4/1996 Suzuki
5,511,147 A 4/1996 Abdel-malek
5,515,572 A 5/1996 Hoekstra et al.
5,534,762 A 7/1996 Kim
5,537,017 A 7/1996 Feiten et al.
5,537,711 A 7/1996 Tseng
5,539,953 A 7/1996 Kurz
5,542,146 A 8/1996 Hoekstra et al.
5,542,148 A 8/1996 Young
5,546,631 A 8/1996 Chambon
5,548,511 A 8/1996 Bancroft
5,551,525 A 9/1996 Pack et al.
5,553,349 A 9/1996 Kilstroem et al.
5,555,587 A 9/1996 Guha
5,560,077 A 10/1996 Crotchett
5,568,589 A 10/1996 Hwang
D375,592 S 11/1996 Ljunggren
5,608,306 A 3/1997 Rybeck et al.
5,608,894 A 3/1997 Kawakami et al.
5,608,944 A 3/1997 Gordon
5,610,488 A 3/1997 Miyazawa
5,611,106 A 3/1997 Wulff
5,611,108 A 3/1997 Knowlton et al.
5,613,261 A 3/1997 Kawakami et al.
5,613,269 A 3/1997 Miwa
5,621,291 A 4/1997 Lee
5,622,236 A 4/1997 Azumi et al.
5,634,237 A 6/1997 Paranjpe
5,634,239 A 6/1997 Tuvin et al.
5,636,402 A 6/1997 Kawagoe et al.
5,642,299 A 6/1997 Hardin et al.
5,646,494 A 7/1997 Han
5,647,554 A 7/1997 Ikegami et al.
5,650,702 A 7/1997 Azumi
5,652,489 A 7/1997 Kawakami
5,682,313 A 10/1997 Edlund et al.
5,682,839 A 11/1997 Grimsley et al.
5,696,675 A 12/1997 Nakamura et al.
5,698,861 A 12/1997 Oh
5,709,007 A 1/1998 Chiang
5,710,506 A 1/1998 Broell et al.
5,714,119 A 2/1998 Kawagoe et al.
5,717,169 A 2/1998 Liang et al.
5,717,484 A 2/1998 Hamaguchi et al.
5,720,077 A 2/1998 Nakamura et al.
5,732,401 A 3/1998 Conway
5,735,959 A 4/1998 Nishikado et al.
5,745,235 A 4/1998 Vercammen et al.
5,752,871 A 5/1998 Tsuzuki
5,756,904 A 5/1998 Oreper et al.
5,761,762 A 6/1998 Kubo
5,764,888 A 6/1998 Bolan et al.
5,767,437 A 6/1998 Rogers
5,767,960 A 6/1998 Orman
5,777,596 A 7/1998 Herbert
5,778,486 A 7/1998 Kim

(56) References Cited

U.S. PATENT DOCUMENTS

| | | | |
|---|---|---|---|
| 5,781,697 | A | 7/1998 | Jeong |
| 5,781,960 | A | 7/1998 | Kilstroem et al. |
| 5,786,602 | A | 7/1998 | Pryor et al. |
| 5,787,545 | A | 8/1998 | Colens |
| 5,793,900 | A | 8/1998 | Nourbakhsh et al. |
| 5,794,297 | A | 8/1998 | Muta |
| 5,812,267 | A | 9/1998 | Everett, Jr. et al. |
| 5,814,808 | A | 9/1998 | Takada et al. |
| 5,815,880 | A | 10/1998 | Nakanishi |
| 5,815,884 | A | 10/1998 | Imamura et al. |
| 5,819,008 | A | 10/1998 | Asama et al. |
| 5,819,360 | A | 10/1998 | Fujii |
| 5,819,936 | A | 10/1998 | Saveliev et al. |
| 5,820,821 | A | 10/1998 | Kawagoe et al. |
| 5,821,730 | A | 10/1998 | Drapkin |
| 5,825,981 | A | 10/1998 | Matsuda |
| 5,828,770 | A | 10/1998 | Leis et al. |
| 5,831,597 | A | 11/1998 | West et al. |
| 5,839,156 | A | 11/1998 | Park et al. |
| 5,839,532 | A | 11/1998 | Yoshiji et al. |
| 5,841,259 | A | 11/1998 | Kim et al. |
| 5,867,800 | A | 2/1999 | Leif |
| 5,869,910 | A | 2/1999 | Colens |
| 5,896,611 | A | 4/1999 | Haaga |
| 5,903,124 | A | 5/1999 | Kawakami |
| 5,905,209 | A | 5/1999 | Oreper |
| 5,907,886 | A | 6/1999 | Buscher |
| 5,910,700 | A | 6/1999 | Crotzer |
| 5,911,260 | A | 6/1999 | Suzuki |
| 5,916,008 | A | 6/1999 | Wong |
| 5,924,167 | A | 7/1999 | Wright et al. |
| 5,926,909 | A | 7/1999 | McGee |
| 5,933,102 | A | 8/1999 | Miller et al. |
| 5,933,913 | A | 8/1999 | Wright et al. |
| 5,935,179 | A | 8/1999 | Kleiner et al. |
| 5,940,346 | A | 8/1999 | Sadowsky et al. |
| 5,940,927 | A | 8/1999 | Haegermarck et al. |
| 5,940,930 | A | 8/1999 | Oh et al. |
| 5,942,869 | A | 8/1999 | Katou et al. |
| 5,943,730 | A | 8/1999 | Boomgaarden |
| 5,943,733 | A | 8/1999 | Tagliaferri |
| 5,947,225 | A | 9/1999 | Kawakami et al. |
| 5,950,408 | A | 9/1999 | Schaedler |
| 5,959,423 | A | 9/1999 | Nakanishi et al. |
| 5,968,281 | A | 10/1999 | Wright et al. |
| 5,974,348 | A | 10/1999 | Rocks |
| 5,974,365 | A | 10/1999 | Mitchell |
| 5,983,448 | A | 11/1999 | Wright et al. |
| 5,984,880 | A | 11/1999 | Lander et al. |
| 5,987,383 | A | 11/1999 | Keller et al. |
| 5,989,700 | A | 11/1999 | Krivopal |
| 5,991,951 | A | 11/1999 | Kubo et al. |
| 5,995,883 | A | 11/1999 | Nishikado |
| 5,995,884 | A | 11/1999 | Allen et al. |
| 5,996,167 | A | 12/1999 | Close |
| 5,998,953 | A | 12/1999 | Nakamura et al. |
| 5,998,971 | A | 12/1999 | Corbridge |
| 6,000,088 | A | 12/1999 | Wright et al. |
| 6,003,198 | A | 12/1999 | Stegens |
| 6,009,358 | A | 12/1999 | Angott et al. |
| 6,021,545 | A | 2/2000 | Graute et al. |
| 6,023,813 | A | 2/2000 | Thatcher et al. |
| 6,023,814 | A | 2/2000 | Imamura |
| 6,025,687 | A | 2/2000 | Himeda et al. |
| 6,026,539 | A | 2/2000 | Mouw et al. |
| 6,030,464 | A | 2/2000 | Azevedo |
| 6,030,465 | A | 2/2000 | Marcussen et al. |
| 6,032,542 | A | 3/2000 | Warnick et al. |
| 6,036,572 | A | 3/2000 | Sze |
| 6,038,501 | A | 3/2000 | Kawakami |
| 6,040,669 | A | 3/2000 | Hog |
| 6,041,471 | A | 3/2000 | Charky et al. |
| 6,041,472 | A | 3/2000 | Kasen et al. |
| 6,046,800 | A | 4/2000 | Ohtomo et al. |
| 6,049,620 | A | 4/2000 | Dickinson et al. |
| 6,052,821 | A | 4/2000 | Chouly et al. |
| 6,055,042 | A | 4/2000 | Sarangapani |
| 6,055,702 | A | 5/2000 | Imamura et al. |
| 6,061,868 | A | 5/2000 | Moritsch et al. |
| 6,065,182 | A | 5/2000 | Wright et al. |
| 6,073,432 | A | 6/2000 | Schaedler |
| 6,076,025 | A | 6/2000 | Ueno et al. |
| 6,076,026 | A | 6/2000 | Jambhekar et al. |
| 6,076,226 | A | 6/2000 | Reed |
| 6,076,227 | A | 6/2000 | Schallig et al. |
| 6,081,257 | A | 6/2000 | Zeller |
| 6,088,020 | A | 7/2000 | Mor |
| 6,094,775 | A | 8/2000 | Behmer |
| 6,099,091 | A | 8/2000 | Campbell |
| 6,101,670 | A | 8/2000 | Song |
| 6,101,671 | A | 8/2000 | Wright et al. |
| 6,108,031 | A | 8/2000 | King et al. |
| 6,108,067 | A | 8/2000 | Okamoto |
| 6,108,076 | A | 8/2000 | Hanseder |
| 6,108,269 | A | 8/2000 | Kabel |
| 6,108,597 | A | 8/2000 | Kirchner et al. |
| 6,112,143 | A | 8/2000 | Allen et al. |
| 6,112,996 | A | 9/2000 | Matsuo |
| 6,119,057 | A | 9/2000 | Kawagoe |
| 6,122,798 | A | 9/2000 | Kobayashi et al. |
| 6,124,694 | A | 9/2000 | Bancroft et al. |
| 6,125,498 | A | 10/2000 | Roberts et al. |
| 6,131,237 | A | 10/2000 | Kasper et al. |
| 6,138,063 | A | 10/2000 | Himeda |
| 6,142,252 | A | 11/2000 | Kinto et al. |
| 6,146,278 | A | 11/2000 | Kobayashi |
| 6,154,279 | A | 11/2000 | Thayer |
| 6,154,694 | A | 11/2000 | Aoki et al. |
| 6,160,479 | A | 12/2000 | Aahlen et al. |
| 6,167,332 | A | 12/2000 | Kurtzberg et al. |
| 6,167,587 | B1 | 1/2001 | Kasper et al. |
| 6,192,548 | B1 | 2/2001 | Huffman |
| 6,216,307 | B1 | 4/2001 | Kaleta et al. |
| 6,220,865 | B1 | 4/2001 | Macri et al. |
| 6,226,830 | B1 | 5/2001 | Hendriks et al. |
| 6,230,362 | B1 | 5/2001 | Kasper et al. |
| 6,237,741 | B1 | 5/2001 | Guidetti |
| 6,240,342 | B1 | 5/2001 | Fiegert et al. |
| 6,243,913 | B1 | 6/2001 | Frank et al. |
| 6,255,793 | B1 | 7/2001 | Peless et al. |
| 6,259,979 | B1 | 7/2001 | Holmquist |
| 6,261,379 | B1 | 7/2001 | Conrad et al. |
| 6,263,539 | B1 | 7/2001 | Baig |
| 6,263,989 | B1 | 7/2001 | Won |
| 6,272,936 | B1 | 8/2001 | Oreper et al. |
| 6,276,478 | B1 | 8/2001 | Hopkins et al. |
| 6,278,918 | B1 | 8/2001 | Dickson et al. |
| 6,282,526 | B1 | 8/2001 | Ganesh |
| 6,283,034 | B1 | 9/2001 | Miles, Jr. |
| 6,285,778 | B1 | 9/2001 | Nakajima et al. |
| 6,285,930 | B1 | 9/2001 | Dickson et al. |
| 6,300,737 | B1 | 10/2001 | Bergvall et al. |
| 6,321,337 | B1 | 11/2001 | Reshef et al. |
| 6,321,515 | B1 | 11/2001 | Colens |
| 6,323,570 | B1 | 11/2001 | Nishimura et al. |
| 6,324,714 | B1 | 12/2001 | Walz et al. |
| 6,327,741 | B1 | 12/2001 | Reed |
| 6,332,400 | B1 | 12/2001 | Meyer |
| 6,339,735 | B1 | 1/2002 | Peless et al. |
| 6,362,875 | B1 | 3/2002 | Burkley |
| 6,370,453 | B2 | 4/2002 | Sommer |
| 6,374,155 | B1 | 4/2002 | Wallach et al. |
| 6,374,157 | B1 | 4/2002 | Takamura |
| 6,381,802 | B2 | 5/2002 | Park |
| 6,385,515 | B1 | 5/2002 | Dickson et al. |
| 6,388,013 | B1 | 5/2002 | Saraf et al. |
| 6,389,329 | B1 | 5/2002 | Colens |
| 6,400,048 | B1 | 6/2002 | Nishimura et al. |
| 6,401,294 | B2 | 6/2002 | Kasper |
| 6,408,226 | B1 | 6/2002 | Byrne et al. |
| 6,412,141 | B2 | 7/2002 | Kasper et al. |
| 6,415,203 | B1 | 7/2002 | Inoue et al. |
| 6,421,870 | B1 | 7/2002 | Basham et al. |
| 6,427,285 | B1 | 8/2002 | Legatt et al. |

(56) References Cited

U.S. PATENT DOCUMENTS

| | | | |
|---|---|---|---|
| 6,430,471 | B1 | 8/2002 | Kintou et al. |
| 6,431,296 | B1 | 8/2002 | Won |
| 6,437,227 | B1 | 8/2002 | Theimer |
| 6,437,465 | B1 | 8/2002 | Nishimura et al. |
| 6,438,456 | B1 | 8/2002 | Feddema et al. |
| 6,438,793 | B1 | 8/2002 | Miner et al. |
| 6,442,476 | B1 | 8/2002 | Poropat |
| 6,443,509 | B1 | 9/2002 | Levin et al. |
| 6,444,003 | B1 | 9/2002 | Sutcliffe |
| 6,446,302 | B1 | 9/2002 | Kasper et al. |
| 6,454,036 | B1 | 9/2002 | Airey et al. |
| D464,091 | S | 10/2002 | Christianson |
| 6,457,206 | B1 | 10/2002 | Judson |
| 6,459,955 | B1 | 10/2002 | Bartsch et al. |
| 6,463,368 | B1 | 10/2002 | Feiten et al. |
| 6,465,982 | B1 | 10/2002 | Bergvall et al. |
| 6,473,167 | B1 | 10/2002 | Odell |
| 6,480,762 | B1 | 11/2002 | Uchikubo et al. |
| 6,481,515 | B1 | 11/2002 | Kirkpatrick et al. |
| 6,490,539 | B1 | 12/2002 | Dickson et al. |
| 6,491,127 | B1 | 12/2002 | Holmberg et al. |
| 6,493,612 | B1 | 12/2002 | Bisset et al. |
| 6,493,613 | B2 | 12/2002 | Peless et al. |
| 6,496,754 | B2 | 12/2002 | Song et al. |
| 6,496,755 | B2 | 12/2002 | Wallach et al. |
| 6,502,657 | B2 | 1/2003 | Kerrebrock et al. |
| 6,504,610 | B1 | 1/2003 | Bauer et al. |
| 6,507,773 | B2 | 1/2003 | Parker et al. |
| 6,525,509 | B1 | 2/2003 | Petersson et al. |
| D471,243 | S | 3/2003 | Cioffi et al. |
| 6,532,404 | B2 | 3/2003 | Colens |
| 6,535,793 | B2 | 3/2003 | Allard |
| 6,540,607 | B2 | 4/2003 | Mokris et al. |
| 6,548,982 | B1 | 4/2003 | Papanikolopoulos et al. |
| 6,553,612 | B1 | 4/2003 | Dyson et al. |
| 6,556,722 | B1 | 4/2003 | Russell et al. |
| 6,556,892 | B2 | 4/2003 | Kuroki et al. |
| 6,557,104 | B2 | 4/2003 | Vu et al. |
| D474,312 | S | 5/2003 | Stephens et al. |
| 6,563,130 | B2 | 5/2003 | Dworkowski et al. |
| 6,571,415 | B2 | 6/2003 | Gerber et al. |
| 6,571,422 | B1 | 6/2003 | Gordon et al. |
| 6,572,711 | B2 | 6/2003 | Sclafani et al. |
| 6,574,536 | B1 | 6/2003 | Kawagoe et al. |
| 6,580,246 | B2 | 6/2003 | Jacobs |
| 6,584,376 | B1 | 6/2003 | Van Kommer |
| 6,586,908 | B2 | 7/2003 | Petersson et al. |
| 6,587,573 | B1 | 7/2003 | Stam et al. |
| 6,590,222 | B1 | 7/2003 | Bisset et al. |
| 6,594,551 | B2 | 7/2003 | Mckinney, Jr. et al. |
| 6,594,844 | B2 | 7/2003 | Jones |
| D478,884 | S | 8/2003 | Slipy et al. |
| 6,601,265 | B1 | 8/2003 | Burlington |
| 6,604,021 | B2 | 8/2003 | Imai et al. |
| 6,604,022 | B2 | 8/2003 | Parker et al. |
| 6,605,156 | B1 | 8/2003 | Clark et al. |
| 6,611,120 | B2 | 8/2003 | Song et al. |
| 6,611,734 | B2 | 8/2003 | Parker et al. |
| 6,611,738 | B2 | 8/2003 | Ruffner |
| 6,615,108 | B1 | 9/2003 | Peless et al. |
| 6,615,885 | B1 | 9/2003 | Ohm |
| 6,622,465 | B2 | 9/2003 | Jerome et al. |
| 6,624,744 | B1 | 9/2003 | Wilson et al. |
| 6,625,843 | B2 | 9/2003 | Kim et al. |
| 6,629,028 | B2 | 9/2003 | Paromtchik et al. |
| 6,639,659 | B2 | 10/2003 | Granger |
| 6,658,325 | B2 | 12/2003 | Zweig |
| 6,658,354 | B2 | 12/2003 | Lin |
| 6,658,692 | B2 | 12/2003 | Lenkiewicz et al. |
| 6,658,693 | B1 | 12/2003 | Reed, Jr. |
| 6,661,239 | B1 | 12/2003 | Ozick |
| 6,662,889 | B2 | 12/2003 | De Fazio et al. |
| 6,668,951 | B2 | 12/2003 | Won |
| 6,670,817 | B2 | 12/2003 | Fournier et al. |
| 6,671,592 | B1 | 12/2003 | Bisset et al. |
| 6,687,571 | B1 | 2/2004 | Byrne et al. |
| 6,690,134 | B1 | 2/2004 | Jones et al. |
| 6,690,993 | B2 | 2/2004 | Foulke, Jr. et al. |
| 6,697,147 | B2 | 2/2004 | Ko et al. |
| 6,711,280 | B2 | 3/2004 | Stafsudd et al. |
| 6,732,826 | B2 | 5/2004 | Song et al. |
| 6,737,591 | B1 | 5/2004 | Lapstun et al. |
| 6,741,054 | B2 | 5/2004 | Koselka et al. |
| 6,741,364 | B2 | 5/2004 | Lange et al. |
| 6,748,297 | B2 | 6/2004 | Song et al. |
| 6,756,703 | B2 | 6/2004 | Chang |
| 6,760,647 | B2 | 7/2004 | Nourbakhsh et al. |
| 6,764,373 | B1 | 7/2004 | Osawa et al. |
| 6,769,004 | B2 | 7/2004 | Barrett |
| 6,774,596 | B1 | 8/2004 | Bisset |
| 6,779,380 | B1 | 8/2004 | Nieuwkamp |
| 6,781,338 | B2 | 8/2004 | Jones et al. |
| 6,809,490 | B2 | 10/2004 | Jones et al. |
| 6,810,305 | B2 | 10/2004 | Kirkpatrick, Jr. |
| 6,810,559 | B2 | 11/2004 | Mertes et al. |
| 6,830,120 | B1 | 12/2004 | Yashima et al. |
| 6,832,407 | B2 | 12/2004 | Salem |
| 6,836,701 | B2 | 12/2004 | Mckee |
| 6,841,963 | B2 | 1/2005 | Song et al. |
| 6,845,297 | B2 | 1/2005 | Allard |
| 6,856,811 | B2 | 2/2005 | Burdue et al. |
| 6,859,010 | B2 | 2/2005 | Jeon et al. |
| 6,859,682 | B2 | 2/2005 | Naka et al. |
| 6,860,206 | B1 | 3/2005 | Rudakevych et al. |
| 6,865,447 | B2 | 3/2005 | Lau et al. |
| 6,870,792 | B2 | 3/2005 | Chiappetta |
| 6,871,115 | B2 | 3/2005 | Huang et al. |
| 6,883,201 | B2 | 4/2005 | Jones et al. |
| 6,886,651 | B1 | 5/2005 | Slocum et al. |
| 6,888,333 | B2 | 5/2005 | Laby |
| 6,901,624 | B2 | 6/2005 | Mori et al. |
| 6,906,702 | B1 | 6/2005 | Tanaka et al. |
| 6,914,403 | B2 | 7/2005 | Tsurumi |
| 6,917,854 | B2 | 7/2005 | Bayer |
| 6,925,357 | B2 | 8/2005 | Wang et al. |
| 6,925,679 | B2 | 8/2005 | Wallach et al. |
| 6,929,548 | B2 | 8/2005 | Wang |
| D510,066 | S | 9/2005 | Hickey et al. |
| 6,938,298 | B2 | 9/2005 | Aasen |
| 6,940,291 | B1 | 9/2005 | Ozick |
| 6,941,199 | B1 | 9/2005 | Bottomley et al. |
| 6,956,348 | B2 | 10/2005 | Landry et al. |
| 6,957,712 | B2 | 10/2005 | Song et al. |
| 6,960,986 | B2 | 11/2005 | Asama et al. |
| 6,965,209 | B2 | 11/2005 | Jones et al. |
| 6,965,211 | B2 | 11/2005 | Tsurumi |
| 6,968,592 | B2 | 11/2005 | Takeuchi et al. |
| 6,971,140 | B2 | 12/2005 | Kim |
| 6,975,246 | B1 | 12/2005 | Trudeau |
| 6,980,229 | B1 | 12/2005 | Ebersole, Jr. |
| 6,985,556 | B2 | 1/2006 | Shanmugavel et al. |
| 6,993,954 | B1 | 2/2006 | George et al. |
| 6,999,850 | B2 | 2/2006 | Mcdonald |
| 7,013,527 | B2 | 3/2006 | Thomas, Sr. et al. |
| 7,024,278 | B2 | 4/2006 | Chiappetta et al. |
| 7,024,280 | B2 | 4/2006 | Parker et al. |
| 7,027,893 | B2 | 4/2006 | Perry et al. |
| 7,030,768 | B2 | 4/2006 | Wanie |
| 7,031,805 | B2 | 4/2006 | Lee et al. |
| 7,032,469 | B2 | 4/2006 | Bailey |
| 7,053,578 | B2 | 5/2006 | Diehl et al. |
| 7,054,716 | B2 | 5/2006 | Mckee et al. |
| 7,055,210 | B2 | 6/2006 | Keppler et al. |
| 7,057,120 | B2 | 6/2006 | Ma et al. |
| 7,057,643 | B2 | 6/2006 | Iida et al. |
| 7,065,430 | B2 | 6/2006 | Naka et al. |
| 7,066,291 | B2 | 6/2006 | Martins et al. |
| 7,069,124 | B1 | 6/2006 | Whittaker et al. |
| 7,079,923 | B2 | 7/2006 | Abramson et al. |
| 7,085,623 | B2 | 8/2006 | Siegers |
| 7,085,624 | B2 | 8/2006 | Aldred et al. |
| 7,113,847 | B2 | 9/2006 | Chmura et al. |
| 7,133,746 | B2 | 11/2006 | Abramson et al. |
| 7,142,198 | B2 | 11/2006 | Lee |

(56) References Cited

U.S. PATENT DOCUMENTS 7,148,458 B2 12/2006 Schell et al.
7,155,308 B2 12/2006 Jones
7,167,775 B2 1/2007 Abramson et al.
7,171,285 B2 1/2007 Kim et al.
7,173,391 B2 2/2007 Jones et al.
7,173,991 B2 2/2007 Scarpa
7,174,238 B1 2/2007 Zweig
7,188,000 B2 3/2007 Chiappetta et al.
7,193,384 B1 3/2007 Norman et al.
7,196,487 B2 3/2007 Jones et al.
7,201,786 B2 4/2007 Wegelin et al.
7,206,677 B2 4/2007 Hulden
7,211,980 B1 5/2007 Bruemmer et al.
7,225,500 B2 6/2007 Diehl et al.
7,246,405 B2 7/2007 Yan
7,248,951 B2 7/2007 Hulden
7,275,280 B2 10/2007 Haegermarck et al.
7,283,892 B1 10/2007 Boillot et al.
7,288,912 B2 10/2007 Landry et al.
7,318,248 B1 1/2008 Yan
7,320,149 B1 1/2008 Huffman et al.
7,324,870 B2 1/2008 Lee
7,328,196 B2 2/2008 Peters, II
7,332,890 B2 2/2008 Cohen et al.
7,352,153 B2 4/2008 Yan
7,359,766 B2 4/2008 Jeon et al.
7,360,277 B2 4/2008 Moshenrose et al.
7,363,108 B2 4/2008 Noda et al.
7,388,879 B2 6/2008 Sabe et al.
7,389,166 B2 6/2008 Harwig et al.
7,408,157 B2 8/2008 Yan
7,418,762 B2 9/2008 Arai et al.
7,430,455 B2 9/2008 Casey et al.
7,430,462 B2 9/2008 Chiu et al.
7,441,298 B2 10/2008 Svendsen et al.
7,444,206 B2 10/2008 Abramson et al.
7,448,113 B2 11/2008 Jones et al.
7,459,871 B2 12/2008 Landry et al.
7,467,026 B2 12/2008 Sakagami et al.
7,474,941 B2 1/2009 Kim et al.
7,503,096 B2 3/2009 Lin
7,515,991 B2 4/2009 Egawa et al.
7,555,363 B2 6/2009 Augenbraun et al.
7,557,703 B2 7/2009 Yamada et al.
7,568,259 B2 8/2009 Yan
7,571,511 B2 8/2009 Jones et al.
7,578,020 B2 8/2009 Jaworski et al.
7,600,521 B2 10/2009 Woo
7,603,744 B2 10/2009 Reindle
7,617,557 B2 11/2009 Reindle
7,620,476 B2 11/2009 Morse et al.
7,636,982 B2 12/2009 Jones et al.
7,647,144 B2 1/2010 Haegermarck
7,650,666 B2 1/2010 Jang
7,660,650 B2 2/2010 Kawagoe et al.
7,663,333 B2 2/2010 Jones et al.
7,693,605 B2 4/2010 Park
7,706,917 B1 4/2010 Chiappetta et al.
7,765,635 B2 8/2010 Park
7,801,645 B2 9/2010 Taylor et al.
7,805,220 B2 9/2010 Taylor et al.
7,809,944 B2 10/2010 Kawamoto
7,849,555 B2 12/2010 Hahm et al.
7,853,645 B2 12/2010 Brown et al.
7,920,941 B2 4/2011 Park et al.
7,937,800 B2 5/2011 Yan
7,957,836 B2 6/2011 Myeong et al.
8,087,117 B2 1/2012 Kapoor et al.
8,418,303 B2 4/2013 Kapoor et al.
8,800,107 B2 8/2014 Blouin
10,314,449 B2 6/2019 Blouin
2001/0004719 A1 6/2001 Sommer
2001/0008036 A1 7/2001 Worwag
2001/0013929 A1 8/2001 Torsten
2001/0020200 A1 9/2001 Das et al.
2001/0022010 A1* 9/2001 Kasper ..... A47L 11/4016 15/320
2001/0025183 A1 9/2001 Shahidi
2001/0037163 A1 11/2001 Allard
2001/0043509 A1 11/2001 Green et al.
2001/0045883 A1 11/2001 Holdaway et al.
2001/0047231 A1 11/2001 Peless et al.
2001/0047895 A1 12/2001 De Fazio et al.
2002/0011367 A1 1/2002 Kolesnik
2002/0011813 A1 1/2002 Koselka et al.
2002/0016649 A1 2/2002 Jones
2002/0021219 A1 2/2002 Edwards
2002/0027652 A1 3/2002 Paromtchik et al.
2002/0032948 A1 3/2002 Ahn et al.
2002/0036779 A1 3/2002 Kiyoi et al.
2002/0081937 A1 6/2002 Yamada et al.
2002/0095239 A1 7/2002 Wallach et al.
2002/0097400 A1 7/2002 Jung et al.
2002/0104963 A1 8/2002 Mancevski
2002/0108209 A1 8/2002 Peterson
2002/0112742 A1 8/2002 Bredo et al.
2002/0113973 A1 8/2002 Ge
2002/0116089 A1 8/2002 Kirkpatrick
2002/0120364 A1 8/2002 Colens
2002/0124343 A1 9/2002 Reed
2002/0153185 A1 10/2002 Song et al.
2002/0156556 A1 10/2002 Ruffner
2002/0159051 A1 10/2002 Guo
2002/0166193 A1 11/2002 Kasper
2002/0169521 A1 11/2002 Goodman et al.
2002/0173877 A1 11/2002 Zweig
2002/0189871 A1 12/2002 Won
2003/0009259 A1 1/2003 Hattori et al.
2003/0019071 A1 1/2003 Field et al.
2003/0023356 A1 1/2003 Keable
2003/0024986 A1 2/2003 Mazz et al.
2003/0025472 A1 2/2003 Jones et al.
2003/0028286 A1 2/2003 Glenn et al.
2003/0030399 A1 2/2003 Jacobs
2003/0058262 A1 3/2003 Sato et al.
2003/0060928 A1 3/2003 Abramson et al.
2003/0067451 A1 4/2003 Tagg et al.
2003/0097875 A1 5/2003 Lentz et al.
2003/0120389 A1 6/2003 Abramson et al.
2003/0124312 A1 7/2003 Autumn
2003/0126352 A1 7/2003 Barrett
2003/0137268 A1 7/2003 Papanikolopoulos et al.
2003/0146384 A1 8/2003 Logsdon et al.
2003/0192144 A1 10/2003 Song et al.
2003/0193657 A1 10/2003 Uomori et al.
2003/0216834 A1 11/2003 Allard
2003/0221114 A1 11/2003 Hino et al.
2003/0229421 A1 12/2003 Chmura et al.
2003/0229474 A1 12/2003 Suzuki et al.
2003/0233171 A1 12/2003 Heiligensetzer
2003/0233177 A1 12/2003 Johnson et al.
2003/0233870 A1 12/2003 Mancevski
2003/0233930 A1 12/2003 Ozick
2004/0016077 A1 1/2004 Song et al.
2004/0020000 A1 2/2004 Jones
2004/0030448 A1 2/2004 Solomon
2004/0030449 A1 2/2004 Solomon
2004/0030450 A1 2/2004 Solomon
2004/0030451 A1 2/2004 Solomon
2004/0030570 A1 2/2004 Solomon
2004/0030571 A1 2/2004 Solomon
2004/0031113 A1 2/2004 Porchia et al.
2004/0049877 A1 3/2004 Jones et al.
2004/0055163 A1 3/2004 Mccambridge et al.
2004/0068351 A1 4/2004 Solomon
2004/0068415 A1 4/2004 Solomon
2004/0068416 A1 4/2004 Solomon
2004/0074038 A1 4/2004 Im et al.
2004/0074044 A1 4/2004 Diehl et al.
2004/0076324 A1 4/2004 Burl et al.
2004/0078924 A1 4/2004 Roney et al.
2004/0083570 A1 5/2004 Song et al.
2004/0085037 A1 5/2004 Jones et al.
2004/0088079 A1 5/2004 Lavarec et al.

(56) References Cited

U.S. PATENT DOCUMENTS

2004/0093122 A1 5/2004 Galibraith
2004/0098167 A1 5/2004 Yi et al.
2004/0111184 A1 6/2004 Chiappetta et al.
2004/0111821 A1 6/2004 Lenkiewicz et al.
2004/0113777 A1 6/2004 Matsuhira et al.
2004/0117064 A1 6/2004 Mcdonald
2004/0117846 A1 6/2004 Karaoguz et al.
2004/0118998 A1 6/2004 Wingett et al.
2004/0128028 A1 7/2004 Miyamoto et al.
2004/0133316 A1 7/2004 Dean
2004/0134336 A1 7/2004 Solomon
2004/0134337 A1 7/2004 Solomon
2004/0143919 A1 7/2004 Wilder
2004/0148419 A1 7/2004 Chen et al.
2004/0148731 A1 8/2004 Damman et al.
2004/0153212 A1 8/2004 Profio et al.
2004/0156541 A1 8/2004 Jeon et al.
2004/0158357 A1 8/2004 Lee et al.
2004/0181706 A1 9/2004 Chen et al.
2004/0187249 A1 9/2004 Jones et al.
2004/0187457 A1 9/2004 Colens
2004/0196451 A1 10/2004 Aoyama
2004/0200505 A1 10/2004 Taylor et al.
2004/0204792 A1 10/2004 Taylor et al.
2004/0210345 A1 10/2004 Noda et al.
2004/0210347 A1 10/2004 Sawada et al.
2004/0211444 A1 10/2004 Taylor et al.
2004/0221790 A1 11/2004 Sinclair et al.
2004/0236468 A1 11/2004 Taylor et al.
2004/0244138 A1 12/2004 Taylor et al.
2004/0255425 A1 12/2004 Arai et al.
2005/0000543 A1 1/2005 Taylor et al.
2005/0010330 A1 1/2005 Abramson et al.
2005/0010331 A1 1/2005 Taylor et al.
2005/0021181 A1 1/2005 Kim et al.
2005/0067994 A1 3/2005 Jones et al.
2005/0085947 A1 4/2005 Aldred et al.
2005/0137749 A1 6/2005 Jeon et al.
2005/0138765 A1 6/2005 Lee
2005/0144751 A1 7/2005 Kegg et al.
2005/0150074 A1 7/2005 Diehl et al.
2005/0150519 A1 7/2005 Keppler et al.
2005/0154795 A1 7/2005 Kuz et al.
2005/0156562 A1 7/2005 Cohen et al.
2005/0165508 A1 7/2005 Kanda et al.
2005/0166354 A1 8/2005 Uehigashi
2005/0166355 A1 8/2005 Tani
2005/0172445 A1 8/2005 Diehl et al.
2005/0183229 A1 8/2005 Uehigashi
2005/0183230 A1 8/2005 Uehigashi
2005/0187678 A1 8/2005 Myeong et al.
2005/0192707 A1 9/2005 Park et al.
2005/0204717 A1 9/2005 Colens
2005/0209736 A1 9/2005 Kawagoe
2005/0211880 A1 9/2005 Schell et al.
2005/0212929 A1 9/2005 Schell et al.
2005/0213082 A1 9/2005 Dibernardo et al.
2005/0213109 A1 9/2005 Schell et al.
2005/0217042 A1 10/2005 Reindle
2005/0218852 A1 10/2005 Landry et al.
2005/0222933 A1 10/2005 Wesby
2005/0229340 A1 10/2005 Sawalski et al.
2005/0229355 A1 10/2005 Crouch et al.
2005/0235451 A1 10/2005 Yan
2005/0251292 A1 11/2005 Casey et al.
2005/0255425 A1 11/2005 Pierson
2005/0258154 A1 11/2005 Blankenship et al.
2005/0273967 A1 12/2005 Taylor et al.
2005/0288819 A1 12/2005 De Guzman
2006/0000050 A1 1/2006 Cipolla et al.
2006/0010638 A1 1/2006 Shimizu et al.
2006/0020369 A1 1/2006 Taylor et al.
2006/0020370 A1 1/2006 Abramson
2006/0021168 A1 2/2006 Nishikawa
2006/0025134 A1 2/2006 Cho et al.
2006/0037170 A1 2/2006 Shimizu
2006/0042042 A1 3/2006 Mertes et al.
2006/0044546 A1 3/2006 Lewin et al.
2006/0060216 A1 3/2006 Woo
2006/0061657 A1 3/2006 Rew et al.
2006/0064828 A1 3/2006 Stein et al.
2006/0087273 A1 4/2006 Ko et al.
2006/0089765 A1 4/2006 Pack et al.
2006/0100741 A1 5/2006 Jung
2006/0119839 A1 6/2006 Bertin et al.
2006/0143295 A1 6/2006 Costa-requena et al.
2006/0146776 A1 7/2006 Kim
2006/0190133 A1 8/2006 Konandreas et al.
2006/0190146 A1 8/2006 Morse et al.
2006/0196003 A1 9/2006 Song et al.
2006/0220900 A1 10/2006 Ceskutti et al.
2006/0259194 A1 11/2006 Chiu
2006/0259494 A1 11/2006 Watson et al.
2006/0288519 A1 12/2006 Jaworski et al.
2006/0293787 A1 12/2006 Kanda et al.
2007/0006404 A1 1/2007 Cheng et al.
2007/0017061 A1 1/2007 Yan
2007/0028574 A1 2/2007 Yan
2007/0032904 A1 2/2007 Kawagoe et al.
2007/0042716 A1 2/2007 Goodall et al.
2007/0043459 A1 2/2007 Abbott et al.
2007/0061041 A1 3/2007 Zweig
2007/0114975 A1 5/2007 Cohen et al.
2007/0150096 A1 6/2007 Yeh et al.
2007/0157415 A1 7/2007 Lee et al.
2007/0157420 A1 7/2007 Lee et al.
2007/0179670 A1 8/2007 Chiappetta et al.
2007/0226949 A1 10/2007 Hahm et al.
2007/0234492 A1 10/2007 Svendsen et al.
2007/0244610 A1 10/2007 Ozick et al.
2007/0250212 A1 10/2007 Halloran et al.
2007/0266508 A1 11/2007 Jones et al.
2008/0007203 A1 1/2008 Cohen et al.
2008/0039974 A1 2/2008 Sandin et al.
2008/0052846 A1 3/2008 Kapoor et al.
2008/0091304 A1 4/2008 Ozick et al.
2008/0184518 A1 8/2008 Taylor et al.
2008/0276407 A1 11/2008 Schnittman et al.
2008/0281470 A1 11/2008 Gilbert, Jr. et al.
2008/0282494 A1 11/2008 Won et al.
2008/0294288 A1 11/2008 Yamauchi
2008/0302586 A1 12/2008 Yan
2008/0307590 A1 12/2008 Jones et al.
2009/0007366 A1 1/2009 Svendsen et al.
2009/0038089 A1 2/2009 Landry et al.
2009/0049640 A1 2/2009 Lee et al.
2009/0055022 A1 2/2009 Casey et al.
2009/0102296 A1 4/2009 Greene et al.
2009/0169146 A1 7/2009 Gagnon
2009/0292393 A1 11/2009 Casey et al.
2010/0011529 A1 1/2010 Won et al.
2010/0049365 A1 2/2010 Jones et al.
2010/0063628 A1 3/2010 Landry et al.
2010/0107355 A1 5/2010 Won et al.
2010/0218339 A1 9/2010 Fahlstroem
2010/0257690 A1 10/2010 Jones et al.
2010/0257691 A1 10/2010 Jones et al.
2010/0263158 A1 10/2010 Jones et al.
2010/0268384 A1 10/2010 Jones et al.
2010/0312429 A1 12/2010 Jones et al.
2011/0252594 A1 10/2011 Blouin
2014/0317879 A1 10/2014 Blouin

FOREIGN PATENT DOCUMENTS

CN 101588743 A 11/2009
DE 2128842 A1 12/1972
DE 2128842 12/1980
DE 3317376 A1 11/1984
DE 3536907 A1 4/1986
DE 3404202 A1 5/1987
DE 3536907 2/1989
DE 3404202 12/1992
DE 9311014 U1 10/1993

(56) References Cited

FOREIGN PATENT DOCUMENTS

| | | | |
|---|---|---|---|
| DE | 4338841 | A1 | 5/1995 |
| DE | 4414683 | A1 | 10/1995 |
| DE | 4338841 | | 8/1999 |
| DE | 19849978 | A1 | 5/2000 |
| DE | 19849978 | | 2/2001 |
| DE | 10242257 | A1 | 4/2003 |
| DE | 102004038074 | B3 | 6/2005 |
| DE | 10357636 | A1 | 7/2005 |
| DE | 102004041021 | B3 | 8/2005 |
| DE | 102005046813 | A1 | 4/2007 |
| DK | 338988 | A | 12/1988 |
| EP | 0265542 | A1 | 5/1988 |
| EP | 0281085 | A2 | 9/1988 |
| EP | 0294101 | A2 | 12/1988 |
| EP | 0307381 | A2 | 3/1989 |
| EP | 0358628 | A2 | 3/1990 |
| EP | 0307381 | | 7/1990 |
| EP | 0358628 | | 5/1991 |
| EP | 0433697 | A2 | 6/1991 |
| EP | 0437024 | A1 | 7/1991 |
| EP | 0479273 | A2 | 4/1992 |
| EP | 0433697 | | 12/1992 |
| EP | 0479273 | | 5/1993 |
| EP | 0554978 | A2 | 8/1993 |
| EP | 0294101 | | 12/1993 |
| EP | 0554978 | | 3/1994 |
| EP | 0615719 | A1 | 9/1994 |
| EP | 0792726 | A1 | 9/1997 |
| EP | 0845237 | A1 | 6/1998 |
| EP | 0861629 | A1 | 9/1998 |
| EP | 0792726 | | 6/1999 |
| EP | 0930040 | A2 | 7/1999 |
| EP | 0930040 | | 10/1999 |
| EP | 0845237 | | 4/2000 |
| EP | 1018315 | A1 | 7/2000 |
| EP | 1172719 | A1 | 1/2002 |
| EP | 1228734 | A2 | 8/2002 |
| EP | 1228734 | | 6/2003 |
| EP | 1331537 | A1 | 7/2003 |
| EP | 1380245 | A1 | 1/2004 |
| EP | 1380246 | A2 | 1/2004 |
| EP | 1380246 | | 3/2005 |
| EP | 1553472 | A1 | 7/2005 |
| EP | 1557730 | A1 | 7/2005 |
| EP | 1642522 | A2 | 4/2006 |
| EP | 1642522 | | 11/2007 |
| EP | 2536322 | | 12/2012 |
| EP | 2536322 | | 4/2017 |
| EP | 3192419 | | 7/2017 |
| ES | 2238196 | A1 | 8/2005 |
| ES | 2238196 | | 11/2006 |
| FR | 2601443 | A1 | 1/1988 |
| FR | 2601443 | | 11/1991 |
| FR | 2828589 | A1 | 2/2003 |
| GB | 702426 | A | 1/1954 |
| GB | 2128842 | A | 5/1984 |
| GB | 2128842 | | 4/1986 |
| GB | 2213047 | A | 8/1989 |
| GB | 2225221 | A | 5/1990 |
| GB | 2267360 | A | 12/1993 |
| GB | 2283838 | A | 5/1995 |
| GB | 2284957 | A | 6/1995 |
| GB | 2267360 | | 12/1995 |
| GB | 2300082 | A | 10/1996 |
| GB | 2300082 | | 9/1999 |
| GB | 2404330 | A | 2/2005 |
| GB | 2404330 | | 7/2005 |
| GB | 2417354 | A | 2/2006 |
| JP | 53021869 | A | 2/1978 |
| JP | 53110257 | A | 9/1978 |
| JP | 943901 | C | 3/1979 |
| JP | 57014726 | A | 1/1982 |
| JP | 57064217 | A | 4/1982 |
| JP | 59005315 | A | 1/1984 |
| JP | 59033511 | U | 3/1984 |
| JP | 59094005 | A | 5/1984 |
| JP | 59099308 | A | 6/1984 |
| JP | 59112311 | A | 6/1984 |
| JP | 59120124 | U | 8/1984 |
| JP | 59131668 | U | 9/1984 |
| JP | 59164973 | A | 9/1984 |
| JP | 59184917 | A | 10/1984 |
| JP | S59212924 | A | 12/1984 |
| JP | S59226909 | A | 12/1984 |
| JP | 60089213 | A | 5/1985 |
| JP | S60211510 | A | 10/1985 |
| JP | S60259895 | A | 12/1985 |
| JP | 61023221 | A | 1/1986 |
| JP | 61097712 | A | 5/1986 |
| JP | 62070709 | A | 4/1987 |
| JP | 62074018 | A | 4/1987 |
| JP | 62120510 | A | 6/1987 |
| JP | 62154008 | A | 7/1987 |
| JP | S62164431 | U | 10/1987 |
| JP | S62263507 | A | 11/1987 |
| JP | S62263508 | A | 11/1987 |
| JP | 62189057 | U | 12/1987 |
| JP | 63079623 | A | 4/1988 |
| JP | 63158032 | A | 7/1988 |
| JP | 63183032 | A | 7/1988 |
| JP | 63241610 | A | 10/1988 |
| JP | 1162454 | A | 6/1989 |
| JP | H101254187 | | 10/1989 |
| JP | H026312 | | 1/1990 |
| JP | 2026312 | B2 | 6/1990 |
| JP | H02283343 | A | 11/1990 |
| JP | 0351023 | A | 3/1991 |
| JP | 2520732 | | 8/1991 |
| JP | 046312 | A | 1/1992 |
| JP | 0419586 | | 3/1992 |
| JP | 0523269 | | 4/1993 |
| JP | H05150829 | A | 6/1993 |
| JP | H0554620 | U | 7/1993 |
| JP | H0540519 | | 10/1993 |
| JP | H05285861 | | 11/1993 |
| JP | 0603251 | Y2 | 1/1994 |
| JP | 0638912 | | 2/1994 |
| JP | 06038912 | A | 2/1994 |
| JP | 6105781 | A | 4/1994 |
| JP | H0626312 | U | 4/1994 |
| JP | H06137828 | A | 5/1994 |
| JP | H06293095 | A | 10/1994 |
| JP | 06327598 | A | 11/1994 |
| JP | 7059702 | A | 3/1995 |
| JP | H07129239 | A | 5/1995 |
| JP | H07222705 | A | 8/1995 |
| JP | H07270518 | A | 10/1995 |
| JP | H07281742 | A | 10/1995 |
| JP | H07281752 | A | 10/1995 |
| JP | 07295636 | | 11/1995 |
| JP | H07311041 | A | 11/1995 |
| JP | H07313417 | A | 12/1995 |
| JP | H07319542 | A | 12/1995 |
| JP | 8000393 | | 1/1996 |
| JP | 8000393 | A | 1/1996 |
| JP | 8016241 | A | 1/1996 |
| JP | 8016776 | A | 1/1996 |
| JP | H10816776 | | 2/1996 |
| JP | 8063229 | A | 3/1996 |
| JP | 8083125 | A | 3/1996 |
| JP | 8089449 | A | 4/1996 |
| JP | 8089451 | | 4/1996 |
| JP | H0889451 | A | 4/1996 |
| JP | 2520732 | | 5/1996 |
| JP | H08123548 | A | 5/1996 |
| JP | 08152916 | A | 6/1996 |
| JP | H08256960 | A | 10/1996 |
| JP | H08263137 | A | 10/1996 |
| JP | H08286744 | A | 11/1996 |
| JP | H082686741 | A | 11/1996 |
| JP | H08322774 | A | 12/1996 |
| JP | H08335112 | A | 12/1996 |
| JP | 9047413 | A | 2/1997 |
| JP | H0943901 | A | 2/1997 |

(56) References Cited

FOREIGN PATENT DOCUMENTS

| | | | |
|---|---|---|---|
| JP | H0944240 | A | 2/1997 |
| JP | 9066855 | A | 3/1997 |
| JP | H09145309 | A | 6/1997 |
| JP | H09160644 | A | 6/1997 |
| JP | 09179625 | A | 7/1997 |
| JP | 09185410 | A | 7/1997 |
| JP | H09179685 | A | 7/1997 |
| JP | H09192069 | A | 7/1997 |
| JP | H09204223 | A | 8/1997 |
| JP | H09206258 | A | 8/1997 |
| JP | 09251318 | A | 9/1997 |
| JP | H09233712 | A | 9/1997 |
| JP | H09251318 | A | 9/1997 |
| JP | H09265319 | A | 10/1997 |
| JP | H09269807 | A | 10/1997 |
| JP | H09269810 | A | 10/1997 |
| JP | 2555263 | Y2 | 11/1997 |
| JP | H09319431 | A | 12/1997 |
| JP | H09319432 | A | 12/1997 |
| JP | H09319434 | A | 12/1997 |
| JP | H09325812 | A | 12/1997 |
| JP | 10055215 | A | 2/1998 |
| JP | 10117973 | | 5/1998 |
| JP | H10117973 | A | 5/1998 |
| JP | H10118963 | A | 5/1998 |
| JP | H10177414 | A | 6/1998 |
| JP | 10214114 | | 8/1998 |
| JP | 10228316 | | 8/1998 |
| JP | H10214114 | A | 8/1998 |
| JP | H10228316 | A | 8/1998 |
| JP | 10240342 | | 9/1998 |
| JP | 10260727 | | 9/1998 |
| JP | H10240342 | A | 9/1998 |
| JP | H10260727 | A | 9/1998 |
| JP | H10295595 | A | 10/1998 |
| JP | H10314088 | A | 12/1998 |
| JP | 11015941 | A | 1/1999 |
| JP | 1165655 | | 3/1999 |
| JP | 1185269 | | 3/1999 |
| JP | 11065655 | A | 3/1999 |
| JP | 11085269 | A | 3/1999 |
| JP | H11102219 | A | 4/1999 |
| JP | H11102220 | A | 4/1999 |
| JP | H11162454 | A | 6/1999 |
| JP | H11174145 | A | 7/1999 |
| JP | H11175149 | A | 7/1999 |
| JP | H11178764 | A | 7/1999 |
| JP | H11178765 | A | 7/1999 |
| JP | 11508810 | | 8/1999 |
| JP | 11508810 | T2 | 8/1999 |
| JP | H11212642 | A | 8/1999 |
| JP | H11213157 | A | 8/1999 |
| JP | 11510935 | | 9/1999 |
| JP | 11510935 | T2 | 9/1999 |
| JP | H11248806 | A | 9/1999 |
| JP | H11282532 | A | 10/1999 |
| JP | H11282533 | A | 10/1999 |
| JP | H11295412 | A | 10/1999 |
| JP | H11346964 | A | 12/1999 |
| JP | 2000047728 | A | 2/2000 |
| JP | 2000056006 | A | 2/2000 |
| JP | 2000056831 | A | 2/2000 |
| JP | 2000066722 | A | 3/2000 |
| JP | 2000075925 | A | 3/2000 |
| JP | 2000275321 | A | 10/2000 |
| JP | 2000353014 | A | 12/2000 |
| JP | 2001022443 | A | 1/2001 |
| JP | 2001067588 | A | 3/2001 |
| JP | 2001087182 | A | 4/2001 |
| JP | 2001121455 | A | 5/2001 |
| JP | 2001125641 | A | 5/2001 |
| JP | 2001216482 | A | 8/2001 |
| JP | 2001258807 | A | 9/2001 |
| JP | 2001265437 | A | 9/2001 |
| JP | 2001275908 | A | 10/2001 |
| JP | 2001289939 | A | 10/2001 |
| JP | 2001306170 | A | 11/2001 |
| JP | 2001320781 | A | 11/2001 |
| JP | 2001525567 | A | 12/2001 |
| JP | 2002078650 | A | 3/2002 |
| JP | 2002085301 | A | 3/2002 |
| JP | 2002204768 | A | 7/2002 |
| JP | 2002204769 | A | 7/2002 |
| JP | 2002247510 | A | 8/2002 |
| JP | 2002532178 | | 10/2002 |
| JP | 2002323925 | A | 11/2002 |
| JP | 2002333920 | A | 11/2002 |
| JP | 3356170 | B1 | 12/2002 |
| JP | 2002355206 | A | 12/2002 |
| JP | 2002360471 | A | 12/2002 |
| JP | 2002360479 | A | 12/2002 |
| JP | 2002360482 | A | 12/2002 |
| JP | 2002366227 | A | 12/2002 |
| JP | 2002369778 | A | 12/2002 |
| JP | 2003005296 | A | 1/2003 |
| JP | 2003010076 | A | 1/2003 |
| JP | 2003010088 | A | 1/2003 |
| JP | 2003015740 | A | 1/2003 |
| JP | 2003028528 | A | 1/2003 |
| JP | 3375843 | B2 | 2/2003 |
| JP | 2003000361 | A | 2/2003 |
| JP | 2003036116 | A | 2/2003 |
| JP | 2003038401 | A | 2/2003 |
| JP | 2003038402 | A | 2/2003 |
| JP | 2003047579 | A | 2/2003 |
| JP | 2003052596 | A | 2/2003 |
| JP | 2003505127 | A | 2/2003 |
| JP | 2003061882 | A | 3/2003 |
| JP | 2003084994 | A | 3/2003 |
| JP | 2003167628 | A | 6/2003 |
| JP | 2003180586 | A | 7/2003 |
| JP | 2003180587 | A | 7/2003 |
| JP | 2003186539 | A | 7/2003 |
| JP | 2003190064 | A | 7/2003 |
| JP | 2003241836 | A | 8/2003 |
| JP | 2003262520 | A | 9/2003 |
| JP | 2003285288 | A | 10/2003 |
| JP | 2003304992 | A | 10/2003 |
| JP | 2003310489 | A | 11/2003 |
| JP | 2003310509 | A | 11/2003 |
| JP | 2003330543 | A | 11/2003 |
| JP | 2004123040 | A | 4/2004 |
| JP | 2004148021 | A | 5/2004 |
| JP | 2004160102 | A | 6/2004 |
| JP | 2004166968 | A | 6/2004 |
| JP | 2004174228 | A | 6/2004 |
| JP | 2004198330 | A | 7/2004 |
| JP | 2004219185 | A | 8/2004 |
| JP | 2005118354 | A | 5/2005 |
| JP | 2005135400 | A | 5/2005 |
| JP | 2005211360 | A | 8/2005 |
| JP | 2005224265 | A | 8/2005 |
| JP | 2005230032 | A | 9/2005 |
| JP | 2005245916 | A | 9/2005 |
| JP | 2005296511 | A | 10/2005 |
| JP | 2005346700 | A | 12/2005 |
| JP | 2005352707 | A | 12/2005 |
| JP | 2006043071 | A | 2/2006 |
| JP | 2006155274 | A | 6/2006 |
| JP | 2006164223 | A | 6/2006 |
| JP | 2006227673 | A | 8/2006 |
| JP | 2006247467 | A | 9/2006 |
| JP | 2006260161 | A | 9/2006 |
| JP | 2006293662 | A | 10/2006 |
| JP | 2006296697 | A | 11/2006 |
| JP | 2007034866 | A | 2/2007 |
| JP | 2007213180 | A | 8/2007 |
| JP | 4019586 | B2 | 12/2007 |
| JP | 4074285 | | 4/2008 |
| JP | 4084921 | B2 | 4/2008 |
| JP | 2009015611 | A | 1/2009 |
| JP | 2010198552 | A | 9/2010 |
| JP | 2011050428 | A | 3/2011 |
| JP | 5023269 | B2 | 9/2012 |

(56) References Cited

FOREIGN PATENT DOCUMENTS

| | | | |
|---|---|---|---|
| JP | 5040519 | B2 | 10/2012 |
| JP | 5042076 | B2 | 10/2012 |
| JP | 5046239 | B2 | 10/2012 |
| JP | 5046246 | B2 | 10/2012 |
| JP | 5054620 | B2 | 10/2012 |
| JP | 5091604 | B2 | 12/2012 |
| JP | 5150827 | B2 | 2/2013 |
| JP | 5257527 | B2 | 8/2013 |
| JP | 5257533 | B2 | 8/2013 |
| JP | 5285861 | B2 | 9/2013 |
| JP | 3197758 | | 5/2015 |
| JP | 3201903 | | 12/2015 |
| WO | WO-9526512 | A1 | 10/1995 |
| WO | WO-9530887 | A1 | 11/1995 |
| WO | WO-9617258 | A2 | 6/1996 |
| WO | 9617258 | | 2/1997 |
| WO | WO-9715224 | A1 | 5/1997 |
| WO | WO-9740734 | A1 | 11/1997 |
| WO | WO-9741451 | A1 | 11/1997 |
| WO | WO-9853456 | A1 | 11/1998 |
| WO | WO-9905580 | A2 | 2/1999 |
| WO | WO-9916078 | A1 | 4/1999 |
| WO | WO-9928800 | A1 | 6/1999 |
| WO | WO-9938056 | A1 | 7/1999 |
| WO | WO-9938237 | A1 | 7/1999 |
| WO | WO-9943250 | A1 | 9/1999 |
| WO | WO-9959042 | A1 | 11/1999 |
| WO | WO-0004430 | A1 | 1/2000 |
| WO | WO-0036962 | A1 | 6/2000 |
| WO | WO-0038026 | A1 | 6/2000 |
| WO | WO-0038028 | A1 | 6/2000 |
| WO | WO-0038029 | A1 | 6/2000 |
| WO | WO-0078410 | A1 | 12/2000 |
| WO | WO-0106904 | A1 | 2/2001 |
| WO | WO-0106905 | A1 | 2/2001 |
| WO | WO-0180703 | A1 | 11/2001 |
| WO | WO-0191623 | A2 | 12/2001 |
| WO | WO-0239864 | A1 | 5/2002 |
| WO | WO-0239868 | A1 | 5/2002 |
| WO | WO-02058527 | A1 | 8/2002 |
| WO | WO-02062194 | A1 | 8/2002 |
| WO | WO-02067744 | A1 | 9/2002 |
| WO | WO-02067745 | A1 | 9/2002 |
| WO | WO-02067752 | A1 | 9/2002 |
| WO | WO-02069774 | A1 | 9/2002 |
| WO | WO-02069775 | A2 | 9/2002 |
| WO | WO-02071175 | A1 | 9/2002 |
| WO | WO-02074150 | A1 | 9/2002 |
| WO | WO-02075350 | A1 | 9/2002 |
| WO | WO-02075356 | A1 | 9/2002 |
| WO | WO-02075469 | A1 | 9/2002 |
| WO | WO-02075470 | A1 | 9/2002 |
| WO | WO-02081074 | A1 | 10/2002 |
| WO | WO-02101477 | A2 | 12/2002 |
| WO | WO-03015220 | A1 | 2/2003 |
| WO | WO-03024292 | A2 | 3/2003 |
| WO | WO-03026474 | A2 | 4/2003 |
| WO | 02069775 | | 5/2003 |
| WO | WO-03040546 | A1 | 5/2003 |
| WO | WO-03040845 | A1 | 5/2003 |
| WO | WO-03040846 | A1 | 5/2003 |
| WO | WO-03062850 | A2 | 7/2003 |
| WO | WO-03062852 | A1 | 7/2003 |
| WO | 03071914 | | 9/2003 |
| WO | WO-2004004533 | A1 | 1/2004 |
| WO | WO-2004004534 | A1 | 1/2004 |
| WO | WO-2004005956 | A1 | 1/2004 |
| WO | WO-2004006034 | A2 | 1/2004 |
| WO | WO-2004025947 | A2 | 3/2004 |
| WO | 2004025947 | | 5/2004 |
| WO | WO-2004043215 | A1 | 5/2004 |
| WO | WO-2004058028 | A2 | 7/2004 |
| WO | WO-2004059409 | A1 | 7/2004 |
| WO | WO-2005006935 | A1 | 1/2005 |
| WO | WO-2005036292 | A1 | 4/2005 |
| WO | WO-2005055795 | A1 | 6/2005 |
| WO | WO-2005055796 | A2 | 6/2005 |
| WO | WO-2005076545 | A1 | 8/2005 |
| WO | WO-2005077243 | A1 | 8/2005 |
| WO | WO-2005077244 | A1 | 8/2005 |
| WO | WO-2005081074 | A1 | 9/2005 |
| WO | WO-2005082223 | A1 | 9/2005 |
| WO | WO-2005083541 | A1 | 9/2005 |
| WO | WO-2005098475 | A1 | 10/2005 |
| WO | WO-2005098476 | A1 | 10/2005 |
| WO | WO-2006046400 | A1 | 5/2006 |
| WO | WO-2006061044 | A1 | 6/2006 |
| WO | WO-2006061133 | A1 | 6/2006 |
| WO | WO-2006068403 | A1 | 6/2006 |
| WO | WO-2006073248 | A1 | 7/2006 |
| WO | WO-2007036490 | A2 | 4/2007 |
| WO | 2007036490 | | 5/2007 |
| WO | WO-2007065030 | A2 | 6/2007 |
| WO | WO-2007065033 | A2 | 6/2007 |
| WO | WO-2007137234 | A2 | 11/2007 |
| WO | WO-2008091199 | A1 | 7/2008 |
| WO | 2011103198 | | 8/2011 |

OTHER PUBLICATIONS

"2004 EDU Robot Controller Reference Guide", Innovation First, [Online] Retrieved from the internet: <http://www.ifirobotics.com>, (Mar. 1, 2004), 13 pgs.

"A Clean Sweep", Robotics World Jan. 2001, (Jan. 2001).

"An intelligent cleaning robot 'iclebo Q' AVING USA", Yujin Robotics, <http://us.aving.net/newslview.php?articleid=7251>, accessed Nov. 4, 2011, (8 pgs).

"U.S. Appl. No. 14/325,997, Advisory Action dated Apr. 17, 2018", 2 pgs.

"U.S. Appl. No. 14/325,997, Examiner Interview Summary dated May 1, 2018", 3 pgs.

"U.S. Appl. No. 14/325,997, Examiner Interview Summary dated Dec. 7, 2018", 4 pgs.

"U.S. Appl. No. 14/325,997, Final Office Action dated Dec. 15, 2017", 10 pgs.

"U.S. Appl. No. 14/325,997, Non Final Office Action dated Aug. 2, 2017", 9 pgs.

"U.S. Appl. No. 14/325,997, Non Final Office Action dated Aug. 29, 2018", 12 pgs.

"U.S. Appl. No. 14/325,997, Notice of Allowance dated Jan. 25, 2019", 6 pgs.

"U.S. Appl. No. 14/325,997, Preliminary Amendment filed Jan. 9, 2015", 6 pgs.

"U.S. Appl. No. 14/325,997, Preliminary Amendment filed Apr. 7, 2017", 6 pgs.

"U.S. Appl. No. 14/325,997, Response filed Apr. 6, 2018 to Final Office Action dated Dec. 15, 2017", 10 pgs.

"U.S. Appl. No. 14/325,997, Response filed May 8, 2018 to Advisory Action dated Apr. 17, 2018", 14 pgs.

"U.S. Appl. No. 14/325,997, Response filed Jul. 5, 2017 to Restriction Requirement dated May 5, 2017", 5 pgs.

"U.S. Appl. No. 14/325,997, Response filed Dec. 1, 2017 to Non Final Office Action dated Aug. 2, 2017", 7 pgs.

"U.S. Appl. No. 14/325,997, Response filed Dec. 12, 2018 to Non Final Office Action dated Aug. 29, 2018", 11 pgs.

"U.S. Appl. No. 14/325,997, Restriction Requirement dated Mar. 5, 2017", 7 pgs.

"Ascii", [Online] Retrieved from the internet: <http:/lascii.ip/elem/000/000/330/330024/> accessed Nov. 1, 2011, (Mar. 25, 2002).

"Automatic Rechargeable Vacuum Cleaner", Matsutek Enterprises Co. Ltd, [Online] Retrieved from the internet <http://matsutek.manufacturer.globalsources.com/si/6008801427181/dti/Home-vacuum/10 . . . >, (Apr. 23, 2007).

"Chinese Application Serial No. 201510350985.5, Office Action dated Mar. 28, 2017".

"Cleaning Robot Capable of Wiping with a Wet Duster", UBOT, <http://us.aving.net/news/view.php?articleId=23031>, accessed Nov. 1, 2011, 4 pgs.

(56) References Cited

OTHER PUBLICATIONS

"Dyson's Robot Vacuum Cleaner—the DC06", [Online] Retrieved from the internet: <http://www.gizmag.com/go/1282/> accessed Nov. 11, 2011, (May 2, 2004).
"E Vac Robotic Vacuum", The Sharper Image, [Online] Retrieved from the internet: <www.shargerimage.com/us/en/temglates/products/pipmorework1printable.jhtml>, accessed Mar. 18, 2005, 2 pgs.
"e-Vac Robotic Vacuum S1727 Instruction", The Sharper Image, Copyright 2004, [Online] Retrieved from the internet: <www.sharperimage.com>, (2004), 18 pgs.
"Electrolux designed for the well-lived home website:", <http://www.electroluxusa.com/node57.as[?currentURL=node142.asp%3f>accessed Mar. 18, 2005.
"Electrolux Trilobite", Time to enjoy life, [Online] Retrieved from the internet: <http://www.robocon.cakr/trilobite/Presentation Trilobite Kor 030104.ppt> accessed Dec. 22, 2011, 10 pgs.
"Electrolux Trilobite", [Online]. Retrieved from the Internet: <http://www .eiectroluxm.com:8080/2002%5C822%5C833102EN>, accessed Jul. 2, 2012, (Jan. 12, 2001), 10 pgs.
"Electrolux Trilobite Robotic Vacuum", Hammacher Schlemmer, [Online] Retrieved from the internet: <www.hammacher.com/publish/71579.asp?promo=xsells>, accessed Mar. 18, 2005, 1 pg.
"Euroflex", <http://www.euroflex.tv/novita dett.php?id=15>, accessed Nov. 1, 2011, (Jan. 1, 2006), 1 pg.
"Euroflex Intellegente Monstre Mauele", (English only except).
"European Application Serial No. 07783998.3, Communication Pursuant to Article 94(3) EPC dated Aug. 17, 2010", 6 pgs.
"European Application Serial No. 17157969.1, Partial European Search Report dated Jun. 14, 2017", 11 pgs.
"Everyday Robots website:", [Online] Retrieved from the internet: <http://www.everydayrobots.com/index.ghp?option=content&task=view&id=9>accessed Apr. 20, 2005.
"Facts on the Trilobite", 2 pgs.
"Facts on the Trilobite Webpage", Electrolux, Accessed online <http://trilobite.electrolux.se/presskit_en/node1335.asp?print=yes&pressiD=>, (Dec. 12, 2003), 2 pgs.
"Florbot GE Plastics Image", accessed 2012, (1989-1990), 2 pgs.
"Friendly Robotics", [Online] Retrieved from tthe internet: <http://www.robotsandrelax.com/PDFs/RV400Manual.gdf>, accessed Dec. 22, 2011, 18 pgs.
"Friendly Robotics—Friendly Vac, Robotic Vacuum Cleaner", Friendly Robotics, [Online] Retrieved from the Internet: <www.friendlvrobotics.com/vac.htm>, (Apr. 20, 2005), 5 pgs.
"Friendly Robotics Robotic Vacuum RV400—The Robot Store", [Online]. Retrieved from the Internet: <http://www.therobotstore.com/s.nl/sc.9/category,-109/it.A/id.43/.1>, (Apr. 20, 2005), 1 pg.
"Home Robot—UBOT", [Online]. Retrieved from the Internet: <www.micmrobotusa.com>, (Dec. 2, 2008).
"Intelligent Automatic Vacuum Cleaner", Clean Mate 365, Model No. QQ-1, User Manual, [Online] Retrieved from the internet: <www.metaoo.com/suooort/user_manual.pdf>, 11 pgs.
"Intelligent Machines", InMach, [Online] Retrieved from the Internet: <www.inmach.de/inside.html>, (Nov. 19, 2008), 1 pg.
"International Application Serial No. PCT/US2004/001504, Written Opinion dated Aug. 20, 2012", 9 pgs.
"International Application Serial No. PCT/US2007/069389, International Preliminary Report on Patentability dated Nov. 4, 2008", 8 pgs.
"International Application Serial No. PCT/US2007/069389, International Search Report dated Feb. 14, 2008", 3 pgs.
"International Application Serial No. PCT/US2011/025095, International Search Report dated May 30, 2011", 3 pgs.
"International Application Serial No. PCT/US2011/025095, Written Opinion dated May 30, 2011", 7 pgs.
"It's eye", [Online] Retrieved from the internet: <www.hitachi.co.jp/rd/pdf/topics/hitac2003_10.pdf>, (2003), 2 pgs.
"Karcher", [Online] Retrieved from the internet:<http://www.karcherde/versions/intg/assets/video/2_4_robo en.swf> accessed Sep. 25, 2009.
"Karcher Product Manual Download webpage", [Online] Retrieved from the internet: <http://www.karcher.com/bta/downloadenshtml?ACTION=SELECTTEILEN R&ID=rc3000&-submitButtonName=Select+Product+Manual and associated pdf file "5959-915enpdf (47 MB) English/English">, accessed Jan. 21, 2004, 16 pgs.
"Karcher RoboCieaner RC 3000 Product Details webpages", [Online] Retrieved from the internet:<http://www.robocleaner.de/english/screen3.html" through" ... screen6.html>, accessed Dec. 12, 2003, 4 pgs.
"Koolvac Robotic Vacuum Cleaner Owner's Manual", Koolatron, Undated, 26 pgs.
"LG announces the first robotic vacuum cleaner of Korea", Robot Buying Guide, [Online] Retrieved from the internet <http://robotbg.com/news/2003/04/22/lg_announces_the_first_robotic_vacu>, (Apr. 21, 2003).
"Make your digital life", Popco.net, <http://www.popco.net/zboard/view.oho?id=trreview&no=40> accessed Nov. 1, 2011.
"Matsumura Camera Online Shop", [Online] Retrieved from the internet: <http://www.rakuten.co.jp/matsucame/587179/711512>, accessed Nov. 1, 2011.
"NorthStar Low-Cost, Indoor Localization", Evolution Robotics, Powering Intelligent Products, 2 pgs.
"Product Manual Download Karch", Karcher, [Online] Retrieved from the internet: <www.karcher.com>, (2004), 18 pgs.
"Put Your Roomba . . . On "Automatic" webpage", [Online] Retrieved from the internet: <http://www.acomputeredge.com/roomba>, accessed Apr. 20, 2005, 5 pgs.
"Radio Frequency Identification: Tracking ISS Consumables", NPL0127, 41 pgs.
"RC 3000 Robotics cleaner", Karcher USA, [Online] Retrieved from the internet: <www.karcher-usa.com>, accessed Mar. 18, 2005, 3 pgs.
"RC3000 RoboCleaner website", <TotalVac.com>, accessed Mar. 18, 2005.
"RC3000 Robotic Cleaner", Karcher USA, Website: <http://www.karcher-usa.com/showproducts.php?op=view.sub.--Prod¶m1 =143-¶m2=¶m3=>, accessed Mar. 18, 2005, 6 pgs.
"RoboKing—not just a vacuum cleaner, a robot!", [Online] Retrieved from the internet<http://www.infocom.uz/2004/01/21/robokingne-prosto-pyilesos-a-robot/> accessed Oct. 10, 2011, (Jan. 21, 2004), 7 pgs.
"RoboMaid Sweeps Your Floors So You Won't Have To", [Online]. Retrieved from the Internet: <http://www.therobomaid.com>, accessed Mar. 18, 2005, 2 pgs.
"Robot Family", UAMA (Asia) Industrial Co., Ltd., (2005).
"Robot Review Samsung Robot Vacuum (VC-RP30W)", [Online]. Retrieved from the Internet: <http://www.onrobo.com/reviews/At_Home/Vacuum_Cleaners/onOOvcrp30rosam/index.htm>, accessed Mar. 18, 2005, 11 pgs.
"Robot Reviews Samsung Robot Vacuum (VC-RP30W)", On Robo, [Online] Retrieved from the internet: <www.onrobo.com/reviews/ATHome/vacuum_cleanersion00vcrb30rosam/index.html>, (2005), 2 pgs.
"Robotic Vacuum by Matsushita About of Undergo Testing", Taipei Times, [Online] Retrieved from the internet:<http://www.taipeitimes.com/News/worldbiz/archives/2002/03/26/0000129338>, (Mar. 26, 2002), 2 pgs.
"Robotic Vacuum Cleaner—Blue", The Sharper Image, [Online]. Retrieved from the Internet: <http://www.sharperimage.com/us/en/catalog/productview.jhtml?sku=S1727BLU>, accessed Mar. 18, 2005, 3 pgs.
"Roomba Timer→ Timed Cleaning—Floorvac Robotic Vacuum", eBay, <Cgi.ebay.com/ws/eBayiSAPI.d11?viewitem&category=43526&item=4375198387&rd=1>, (Apr. 20, 2005), 5 pgs.
"Samsung Unveils High-tech Robot Vacuum Cleaner", MobileMag, [Online] Retrieved from the internet: <http://www.mobilemaq.com/content/100/102/C2261/>, (Mar. 18, 2005), 4 pgs.
"Samsung Unveils Its Multifunction Robot Vacuum", iirobotics.com, [Online] Retrieved from the internet: <www.iirobotics.com/weboaaes/hotstuff.oho?ubre=111>, accessed Mar. 18, 2005, 3 pgs.
"SVET Computers—New Technologies—Robot Vacuum Cleaner", [Online] Retrieved from the internet: <http://www.sk.rs/1999/10/sknt01.html>, accessed Nov. 1, 2011, (Oct. 1999).

(56) References Cited

OTHER PUBLICATIONS

"Tech-on!", [Online] Retrieved from the internet<http://techon.nikkeibg.co.jp/members/01db/200203/1006501/>, accessed Nov. 1, 2011, 4 pgs.
"Vacuum Cleaner Robot Operated in Conjunction with 3G Cellular Phone", Toshiba Special Reports, 59(9), http://www.toshiba.colo/tech/review/2004/09/59_0, (2004), 3 pgs.
"Welcome to the Electrolux trilobite", Electrolux, [Online] Retrieved from the internet: <www.electroluxusa.com/node57.asp?currentURL=node142.asp%03F>, accessed Mar. 18, 2005, 2 pgs.
"World's most powerful radio control robot? Sanyo also cleaning robot! RoboFesta Kanagawa 2001 (1)", IT media, [Online] Retrieved from the internet: <http://www.itmedia.co.jp/news/0111/16/robofesta_m.html> accessed Nov. 1, 2011, (Nov. 16, 2001), 4 pgs.
"Zoombot Remote Controlled Vacuum—RV-500 New Roomba 2", [Online]. Retrieved from the Internet: <http://cgi.ebay.com/ws/eBayISAPI.d11?ViewItem&category=43526&item+4373497618&rd=1>, accessed Apr. 20, 2005, 7 pgs.
Alfred-Karcher, "Karcher RC 3000 Cleaning Robot—user manual Manufacturer", GmbH & Co., Cleaning Systems D-71349 Winnenden, Germany, (Dec. 2002).
Andersen, et al., "Landmark based navigation strategies", SPIE Conference on Mobile Robots XIII, SPIE vol. 3525, (Jan. 8, 1999), 170-181.
Barker, "Navigation by the Stars—Ben Barker 4th Year Project", Power point, 1-20.
Becker, et al., "Reliable Navigation Using Landmarks", 1995 Proceedings of the 1995 IEEE International Conference on Robotics and Automation 1, (May 21-27, 1995), 401-46.
Benayad-Cherif, et al., "Mobile Robot Navigation Sensors", SPIE Mobile Robots VII vol. 1831, (1992), 378-387.
Betke, et al., "Mobile Robot localization using Landmarks", Proceedings of the IEEE/RSJ/GI International Conference on Intelligent Robots and Systems '94 "Advanced Robotic Systems and the Real World" (IROS '94), (Sep. 12-16, 1994).
Blaasvaer, et al., "AMOR—An Autonomous Mobile Robot Navigation System", Proceedings of the IEEE International Conference on Systems, Man, and Cybernetics, (1994), 2266-2271.
Borges, et al., "Optimal Mobile Robot Pose Estimation Using Geometrical Maps", IEEE Transactions on Robotics and Automation 18(1), (Feb. 2002), 87-94.
Braunstingl, et al., "Fuzzy Logic Wall Following of a Mobile Robot Based on the Concept of General Perception", ICAR '95, 7th International Conference on Advanced Robotics, Sant Feliu De Guixols, Spain, (Sep. 1995), 367-376.
Bulusu, et al., "Self Configuring Localization systems: Design and Experimental Evaluation", ACM Transactions on Embedded Computing Systems 3(1), (2003), 1-34.
Caccia, et al., "Bottom-Following for Remotely Operated Vehicles", 5th IFAC conference, (Aug. 1, 2000), 245-250.
Chae, et al., "StarLITE: A New Artificial Landmark for the Navigation of Mobile Robots", (2005), 4 pgs.
Chamberlin, et al., "Team 1: Robot Locator Beacon System", NASA Goddard SFC, Design Proposal, (Feb. 17, 2006), 15 pgs.
Champy, "Physical management of IT assets in Data Centers using RFID technologies", RFID 2005 University, (NPL0126), (Oct. 12-14, 2005).
Chiri, "Joystick Control for Tiny OS Robot", (Aug. 8, 2002), 12 pgs.
Christensen, "Theoretical Methods for Planning and Control in Mobile Robotics", 1997 First International Conference on Knowledge-Based Intelligent Electronic Systems, ((May 21-27, 1997), 81-86.
Clerentin, et al., "A Localization Method Based on Two Omnidirectional Perception Systems Cooperation", Proc of IEEE International Conference on Robotics & Automation vol. 2, (Apr. 2000), 1219-1224.
Corke, "High Performance Visual Serving for Robots End-Point Control", SPIE vol. 2056 Intelligent robots and computer vision, (1993).
Cozman, et al., "Robot Localization using a Computer Vision Sextant", IEEE International Midwest Conference on Robotics and Automation, (1995), 106-111.
De Bakker, "Smart PSD-Array for Sheet of Light Range Imaging", Proc. Of SPIE vol. 3965, (May 15, 2000), 1-12.
Desaulniers, et al., "An Efficient Algorithm to Find a Shortest Path for a Car-Like Robot", IEEE Transactions on robotics and Automation 11 (6), (Dec. 1995), 819-828.
D'Orazio, et al., "Model Based Vision System for Mobile Robot Position Estimation", Proc. of SPIE Mobile Robots VIII vol. 2058, (1992), 38-49.
Dorfmuller-Ulhaas, "Optical Tracking From User Motion to 3D Interaction", (2002), 182 pgs.
Dorsch, et al., "Laser Triangulation: Fundamental Uncertainty in Distance Measurement", Applied Optics 33(7), (Mar. 1, 1994), 1306-1314.
Doty, K. L, et al., "Sweep Strategies for a Sensory-Driven, Behavior-Based Vacuum Cleaning Agent", AAAI 1993 Fall Symposium Series, Instantiating Real-World Agents, Research Triangle Park, Raleigh, NC, (Oct. 22-24, 1993), 1-6.
Dudek, et al., "Localizing a Robot with Minimum Travel", Proceedings of the sixth annual ACM-SIAM symposium on Discrete algorithms 27(2), (Apr. 1998), 583-604.
Dulimarta, et al., "Mobile Robot Localization in Indoor Environment", Pattern Recognition 30(1), (1997), 99-111.
Eren, et al., "Accuracy in Position Estimation of Mobile Robots Based on Coded Infrared Signal Transmission", Proceedings: Integrating Intelligent Instrumentation and Control, Instrumentation and Measurement Technology Conference IMTC/95, (1995), 548-551.
Eren, et al., "Operation of Mobile Robots in a Structured Infrared Environment", Proceedings 'Sensing, Processing, Networking', IEEE Instrumentation and Measurement Technology Conference 1997 (IMTC/97) vol. 1, (May 19-21, 1997), 20-25.
Facchinetti, et al., "Using and Learning Vision-Based Self-Positioning for Autonomous Robot Navigation", ICARCV '94, vol. 3, (1694-1698), 1994.
Facchinetti, Claudio, et al., "Self-Positioning Robot Navigation Using Ceiling Images Sequences", ACCV '95, (Dec. 1995), 5 pgs.
Fairfield, et al., "Mobile Robot Localization with Sparse Landmarks", SPIE vol. 4573, (2002), 148-155.
Favre-Bulle, "Efficient tracking of 3D-Robot Position by Dynamic Triangulation", IEEE Instrumentation and Measurement Technology Conference IMTC 98 Session on Instrumentation and Measurement in Robotics vol. 1, (May 18-21, 1998), 446-449.
Fayman, "Exploiting Process Integration and Composition in the context of Active Vision", IEEE Transactions on Systems, Man, and Cybernetics—Part C: Application and reviews 29(1), (Feb. 1999), 73-86.
Floorbotics, "VR-8 Floor Cleaning Robot, Product Description for Manufacturers", [Onlin]Retrieved from the internet: <http://www.consensus.com.au/SoftwareAwards/CSAarchive/CSA2004/CSAart04/FioorBot/FX1%20Product%20Descrigtion%2020%20January%202004.pdf>, (Jan. 20, 2004), 11 pgs.
Franz, et al., "Biomimetric Robot Navigation", Robotics and Autonomous Systems vol. 30, (2000), 133-153.
Fuentes, et al., "Mobile Robotics 1994", University of Rochester Computer Science Department, TR 588, (Dec. 7, 1994), 44 pgs.
Fukuda, et al., "Navigation System based on Ceiling Landmark Recognition for Autonomous mobile robot", 1995 IEEE/ RSJ International Conference on Intelligent Robots and Systems 95 'Human Robot Interaction and Cooperative Robots', (Aug. 5-9, 1995), 1466-1471.
Gat, et al., "Robot Navigation by Conditional Sequencing", 1994 IEEE International Conference on Robotics and Automation vol. 2, (1994), 1293-1299.
Gionis, "A hand-held optical surface scanner for environmental Modeling and Virtual Reality", Virtual Reality World, 16 pgs.
Goncalves, Luis, et al., "A Visual Front-end for Simultaneous Localization and Mapping", Proceedings of the 2005 IEEE International Conference on Robotics and Automation, Barcelona, Spain, (Apr. 2005), 44-49.

(56) References Cited

OTHER PUBLICATIONS

Gregg, et al., "Autonomous Lawn Care Applications", 2006 Florida Conference on Recent Advances in Robotics, Miami, Florida International University, (May 25-26, 2006), 5 pgs.
Grumet, "Robots Clean House", Popular Mechanics, (Nov. 2003).
Hamamatsu, "SI PIN Diode S5980, S5981 S5870—Multi-element photodiodes for surface mounting", Hamatsu Photonics, (Apr. 2004), 2 pgs.
Haralick, et al., "Pose Estimation from Corresponding Point Data", IEEE Transactions on systems, Man, and Cybernetics 19(6), (Nov. 1989), 1426-1446.
Hausler, "About the Scaling Behaviour of Optical Range Sensors", Fringe '97, Proceedings of the 3rd International Workshop on Automatic Processing of Fringe Patterns, (Sep. 15-17, 1997), 147-155.
Hitachi, "", Hitachi, [Online]. Retrieved from the Internet: <http://www.hitachi.co.ip/New/cnews/h1_030529_h1_030529.pdf>, (May 29, 2003), 8 pgs.
Hitachi, "Feature", [Online]. Retrieved from the Internet: <http://kadenfan.hitachi.co.jp/robot/feature/feature.html>, (Nov. 19, 2008), 1 pg.
Hitachi, "News Release: The Home Cleaning Robot of the Autonomous Movement Type (experimental Machine)", Accessed online Mar. 18, 2005 <http://www.i4u.com/japanreleases/hitachirobot.htm>, (May 29, 2003), 5 pgs.
Hoag, et al., "Navigation and Guidance in Interstellar Space", ACTA Astronautica vol. 2, (Feb. 14, 1975), 513-533.
Huntsberger, et al., "CAMPOUT: A Control Architecture for Tightly Coupled Coordination of Multirobot Systems for Planetary Surface Exploration", IEEE Transactions on Systems, Man, and Cybernetics—Part A: Systems and Humans 33(5), (Sep. 2003), 550-559.
Jarosiewicz, et al., "Final Report—Lucid", University of Florida, Department of Electrical and Computer Engineering, EEL 5666—Intelligent Machine Design Laboratory, (Aug. 4, 1999), 50 pgs.
Jensfelt, et al., "Active Global Localization for a Mobile Robot Using Multiple Hypothesis Tracking", IEEE Transactions on Robots and Automation 17(5), (Oct. 2001), 748-760.
Jeong, et al., "An Intelligent Map-Building System for Indoor Mobile Robot Using Low Cost Photo Sensors", SPIE vol. 6042, (2005), 6 pgs.
Kahney, "Robot Vacs are in the House", [Online] Retrieved from the internet: <www.wired.com/news/technology/o,1282,59237,00.html>, (Jun. 16, 2003), 2 pgs.
Karlsson, et al., "Core Technologies for service Robotics", IEEE/RSJ International Conference on Intelligent Robots and Systems (IROS 2004), vol. 3, (Sep. 28-Oct. 2, 2004), 2979-2984.
Karlsson, et al., "The vSLAM Algorithm for Robust Localization and Mapping", Proceedings of the 2005 IEEE International Conference on Robotics and Automation, Barcelona, Spain, (Apr. 2005), 24-29.
King, et al., "Helpmate Autonomous Mobile Robots Navigation Systems", Proc. SPIE Mobile Robots vol. 1388, (Mar. 1, 1991), 190-198.
Kleinberg, "The Localization Problem for Mobile Robots", Laboratory for Computer Science, Massachusetts Institute of Technology, 1994 IEEE, (1994), 521-531.
Knights, et al., "Localization and Identification of Visual Landmarks", Journal of Computing Sciences in Colleges, 16(4), (May 2001), 312-313.
Kolodko, et al., "Experimental System for Real-Time Motion Estimation", Proceedings of the 2003 IEEEIASME International Conference on Advanced Intelligent Mechatronics (AIM 2003), (2003), 981-986.
Komoriya, et al., "Planning of Landmark Measurement for the Navigation of a Mobile Robot", Proceedings of the 19921EEE/RSJ International Conference on Intelligent Robots and Systems, (Jul. 7-10, 1992), 1476-1481.
Koolatron, "KOOLVAC—Owner's Manual", 13 pgs.
Krotov, et al., "Digital Sextant", Downloaded from the internet at: <htto://www.cs.cmu.edu/-epk/>, (1995), 1 pg.
Krupa, "Autonomous 3-D Positioning of Surgical Instruments in Robotized Laparoscopic Surgery Using Visual Servoing", IEEE Transactions on Robotics and Automation 19(5), (Oct. 5, 2003), 842-853.
Kuhl, et al., "Self Localization in Environments using Visual Angles", VRCAI '04 Proceedings of the 2004 ACM SIGGRAPH international conference on Virtual Reality continuum and its applications in industry, (2004), 472-475.
Kurs, "Wireless Power Transfer via Strongly Coupled Magnetic Resonances", In Proceedings Science of AAAS, vol. 317, (Jul. 6, 2007), 5 pgs.
Kurth, Derek, "Range-Only Robot Localization and SLAM with Radio", [Online] Retrieved from the internet: <http://www.ri.cmu.edu/pub_files/pub4/kurth_derek_2004_1/kurth_derek_2004_1.pdf>, (May 2004), 60 pgs.
Lambrinos, et al., "A Mobile Robot Employing Insect Strategies for Navigation", Robotics and Autonomous Systems 30(1-2), (2000), 39-64.
Lang, et al., "Visual Measurement of Orientation Using Ceiling Features", IMTC 1994 IEEE, (May 10-12, 1994), 552-555.
Lapin, "Adaptive Position Estimation for an Automated Guided Vehicle", SPIE Mobile Robots VII vol. 1831, (1992), 82-94.
Lavalle, et al., "Robot Motion Planning in a Changing, Partially Predictable Environment", 1994 IEEE International Symposium on Intelligent Control, (Aug. 16-18, 1994), 261-266.
Lee, et al., "Development of Indoor Navigation system for Humanoid Robot Using Multisensors Integration", ION NTM, (Jan 22-24, 2007), 798-805.
Lee, et al., "Localization of a Mobile Robot Using the Image of a Moving Object", IEEE Transaction on Industrial Electronics 50(3), (Jun. 2003), 612-619.
Leonard, "Mobile Robot Localization by tracking Geometric Beacons", IEEE Transaction on Robotics and Automation 7(3), (Jun. 1991), 376-382.
Li, et al., "Making a Local Map of Indoor Environments by Swiveling a Camera and a Sonar", Proceedings of the 1999 IEEE/RSJ International Conference on Intelligent Robots and Systems, (1999), 954-959.
Li, et al., "Robust Statistical Methods for Securing Wireless Localization in Sensor Networks", Information Procesing in Sensor Networks, 2005, Fourth International Symposium, (Apr. 2005), 91-98.
Lin, et al., "Mobile Robot Navigation Using Artificial Landmarks", Journal of robotics System 14(2), (1997), 93-106.
Linde, "Dissertation: On Aspects of Indoor Localization", University of Dortmund, [Online] Retrieved from the internet<https://eldorado.tu-dortmund.de/bitstream/2003/22854/1/dissertation_linde.pdf>, (Aug. 28, 2006), 138 pgs.
Lumelsky, et al., "An Algorithm for Maze Searching with Azimuth Input", 1994 IEEE International Conference on Robotics and Automation vol. 1, (1994), 111-116.
Luo, et al., "Real-time Area-Covering Operations with Obstacle Avoidance for Cleaning Robots", IEEE, (2002), 2359-2364.
Ma, "Thesis: Documentation on Northstar", California Institute of Technology, (May 17, 2006), 14 pgs.
Madsen, et al., "Optimal Landmark Selection for Triangulation of Robot Position", Journal of Robotics and Autonomous Systems vol. 13, (1998), 277-292.
Malik, et al., "Virtual Prototyping for Conceptual Design of a Tracked Mobile Robot", IEEE Canadian Conference on Electrical and Computer Engineering, (May 1, 2006), 2349-2352.
Martishevcky, "The Accuracy of point light target coordinate determination by dissectoral tracking system", Proc. SPIE Mobile Robots X vol. 2591, (Dec. 27, 1995), 25.
McGillem, et al., "A Beacon Navigation Method for Autonomous Vehicles", IEEE Transactions on Vehicular Technology 38(3), (Aug. 1989), 132-139.
McGillem, et al., "Infra-red Lacation System for Navigation and Autonomous Vehicles", 1988 IEEE International Conference on Robotics and Automation, (Apr. 24-29, 1988), 1236-1238.
McLurkin, "Stupid Robot Tricks: A Behavior-based Distributed Algorithm Library for Programming Swarms of Robots", Paper submitted for requirements of BSEE at MIT, (May 2004).

(56) References Cited

OTHER PUBLICATIONS

McLurkin, "The Ants: A community of Microrobots", Paper submitted for requirements of BSEE at MIT, (May 12, 1995).
Michelson, "Autonomous Navigation", 2000 Yearbook of Science & Technology McGraw-Hill ISBN 0-07-052771-7, (1999), 28-30.
Miro, et al., "Towards Vision Based Navigation in Large Indoor Environments", 2006 Proceedings of the IEEE/RSJ, International Conferences on Intelligent Robots and Systems, Beijing, China, (Oct. 9-15, 2006), 2096-2102.
Miwako, Doi, "Using the symbiosis of human and robots from approaching Research and Development Center", Toshiba Corporation, Available at<http://www.warp.ndl.go. jp/info: ndljp/pid/258151/www.soumu.go.jp/joho_tsusin/policyreports/chousa/netrobot/pdf/0302141_33_a_pdf>, (Feb. 26, 2003), 16 pgs.
Monteiro, et al., "Visual Servoing for Fast Mobile Robot: Adaptive Estimation of Kinematic Parameters", Proceedings of the IECON '93., International Conference on Industrial Electronics, (Nov. 15-19, 1993), 1588-1593.
Moore, et al., "A Simple Map-Based Localization Strategy Using Range Measurements", SPIE vol. 5804, (2005), 612-620.
Morland, Cameron, "Autonomous Lawnmower Control", (Jul. 24, 2002), 10 pgs.
Munich, et al., "ERSP: A Software Platform and Architecture for the Service Robotics Industry", Intelligent Robots and Systems 2005 (IROS 2005), (Aug. 2-6, 2005), 460-467.
Munich, M E, et al., "SIFT-ing Through Features with ViPR", IEEE Robotics & Automation Magazine, (Sep. 2006), 72-77.
Nam, et al., "Real-Time Dynamic Visual Tracking Using PSD Sensors and extended Trapezoidal Motion Planning", Applied Intelligence 10(1), (1999), 53-70.
Nitu, et al., "Optomechatronic System for Position Detection of a Mobile Mini-Robot", IEEE Transactions on Industrial Electronics 52(4), (Aug. 2005), 969-973.
Onrobo, "Samsung Unveils Its Multifunction Robot Vacuum", [Online] Retrieved form the internet<www.onrobo.com/enews/0210/samsuna vacuum.shtml>, accessed Mar. 18, 2005, 3 pgs.
Pages, et al., "A Camera-Projector System for Robot Positioning by Visual Servoing", Proceedings of the 2006 Conference on Computer Vision and Pattern Recognition Workshop (CVPRW06), (Jun. 17-22, 2006), 8 pgs.
Pages, et al., "Optimizing Plane-to-Plane Positioning Tasks by Image-Based Visual Servoing and Structured Light", IEEE Transactions on Robotics 22(5), (Oct. 2006), 1000-1010.
Pages, et al., "Robust Decoupled Visual Servoing Based on Structured Light", 2005 IEEE/RSJ Int. Cont. on Intelligent Robots and Systems, (2005), 2676-2681.
Park, et al., "A Neural Network Based Real-Time Robot Tracking Controller Using Position Sensitive Detectors", IEEE World Congress on Computational Intelligence, 1994 IEEE International Conference on Neutral Networks, (Jun. 27-Jul. 2, 1994), 2754-2758.
Park, et al., "Dynamic Visual Servo Control of Robot Manipulators using Neutral Networks", The Korean Institute Telematics and Electronics 29-B (10), (Oct. 1992), 771-779.
Paromtchik, et al., "Optical Guidance System for Multiple mobile Robots", Proceedings 2001 ICRA. IEEE International Conference on Robotics and Automation vol. 3, (May 21-26, 2001), 2935-2940.
Paromtchik, "Toward Optical Guidance of Mobile Robots", Proceedings of the Fourth World Multiconference on Systemics, Cybermetics and Informatics, Orlando, FL, USA, (Jul. 23, 2000), 44-49.
Penna, et al., "Models for Map Building and Navigation", IEEE Transactions on Systems, Man, and Cybernetics 23(5), (Sep./Oct. 1993), 1276-1301.
Pirjanian, et al., "A Decision-Theoretic Approach to Fuzzy Behavior Coordination", 1999 IEEE International Symposium on Computational Intelligence in Robotics and Automation, CIRA '99, (Nov. 8-9, 1999), 101-106.
Pirjanian, "Challenges for Standards for Consumer Robotics", IEEE Workshop on Advanced Robotics and its Social impacts, (Jun. 12-15, 2005), 260-264.
Pirjanian, et al., "Distributed Control for a Modular, Reconfigurable Cliff Robot", Proceedings of the 2002 IEEE International Conference on Robotics & Automation, (May 2002), 4083-4088.
Pirjanian, et al., "Improving Task Reliability by Fusion of Redundant Homogeneous Modules Using Voting Schemes", Proceedings of the 1997 IEEE International Conference on Robotics and Automation, (Apr. 1997), 425-430.
Pirjanian, et al., "Multi-Robot Target Acquisition using Multiple Objective Behavior Coordination", Proceedings of the 2000 IEEE International Conference on Robotics & Automation, (Apr. 2000), 2696-2702.
Pirjanian, "Reliable Reaction", Proceedings of the 1996 IEEE/SICE/RSJ International Conference on Multisensor Fusion and Integration for Intelligent Systems, (1996), 158-165.
Pirjanian, et al., "Representation and Execution of Plan Sequences for Multi-Agent Systems", Proceedings of the 2001 IEEE/RSJ International Conference on Intelligent Robots and Systems, (Oct. 29-Nov. 3, 2001), 2117-2123.
Prassler, et al., "A Short History of Cleaning Robots", Autonomous Robots, vol. 9, (2000), 211-226.
Remazeilles, et al., "Image Based Robot Navigation in 3D Environments", Proc. of SPIE vol. 6052, (Dec. 6, 2005), 1-14.
Rives, et al., "Visual Servoing Based on Ellipse Features", SPIE Intelligent Robots and Computer Vision vol. 2056, (1993), 356-367.
Ronnback, "On Methods for Assistive Mobile Robots", Doctoral Thesis, [Online] Retrieved from the internet<http://www.openthesis.org/documents/methods-assistive-mobile-robots-595019.html>, (Jan. 1, 2006), 218 pgs.
Roth-Tabak, et al., "Environment Model for mobile Robots Indoor Navigation", SPIE vol. 1388 Mobile Robots, (1990), 453-463.
Sahin, et al., "Development of a Visual Object Localization Module for Mobile Robots", 1999 Third European Workshop on Advanced Mobile Robots (Eurobot '99), (1999), 65-72.
Salomon, et al., "Low-Cost Optical Indoor Localization system for Mobile Objects without Image Processing", IEEE Conference on Emerging Technologies and Factory Automation, 2006 (ETFA '06), (Sep. 20- 22, 2006), 629-632.
Sato, "Range Imaging Based on Moving Pattern Light and Spatio-Temporal Matched Filter", Proceedings International Conference on Image Processing vol. 1, (Sep. 16-19, 1996), 33-36.
Schenker, et al., "Lightweight Rovers for Mars Science Exploration and Sample Return", Intelligent Robots and Vision X I SPIE Proc. vol. 3208, (1997), 24-36.
Schofield, Monica, "Neither Master nor Slave—A Practical Study in the Development and Employment of Cleaning Robots, Emerging Technologies and Factory Automation", Proceedings EFA '99, 1999 7th IEEE International Conference in Barcelona, Spain, (Oct. 18-21, 1999), 1427-1434.
Shimoga, "Touch and Force Reflection for Telepresence Surgery", Engineering in Medicine and Biology Society, 1994. Engineering Advances: New Opportunities for Biomedical Engineers. Proceedings of the 16th Annual International Conference of the IEEE, (1994), 1049-1050.
Sim, et al., "Learning Visual Landmarks for Pose Estimation", IEEE International Conference on Robotics and Automation, vol. 3, Detroit, MI, (May 1999), 1972-1978.
Sobh, et al., "Case Studies in Web-Controlled Devices and Remote Manipulation", Automation Congress, 2002 Proceedings of the 5th Biannual World, (Dec. 10, 2002), 435-440.
Stella, et al., "Self-Location for Indoor Navigation of Autonomous Vehicles", Part of the SPIE conference on Enhanced and Synthetic Vision SPIE vol. 3364, (1998), 298-302.
Summet, "Tracking Locations of Moving Hand-held Displays Using Projected Light", Pervasive 2005, LNCS 3468, (2005), 37-46.
Svedman, et al., "Structure from Stereo Vision using Unsynchronized Cameras for Simultaneous Localization and Mapping", 2005 IEEE/RSJ International Conference on Intelligent Robots and Systems, (2005), 2993-2998.
Takio, et al., "Real-Time Position and Pose Tracking Method of Moving Object Using Visual Servo System", 47th IEEE International Symposium on Circuits and Systems, (2004), 167-170.

(56) References Cited

OTHER PUBLICATIONS

Teller, "Pervasive Pose Awareness for People, Objects and Robots", [Online] Retrieved from the internet:<http://www.ai.mitedu/lab/dangerous-ideas/Spring2003/teller-pose.pdf>, (Apr. 30, 2003), 22 pgs.
Terada, et al., "An Acquisition of the Relation between Vision and Action using Self-Organizing Map and Reinforcement Learning", 1998 Second International Conference on Knowledge-Based Intelligent Electronic Systems, (Apr. 21-23, 1998), 429-434.
Thrun, Sebastian, et al., "Learning Occupancy Grid Maps With Forward Sensor Models", Autonomous Robots 15, (Sep. 1, 2003), 111-127.
Trebi-Ollennu, et al., "Mars Rover Pair Cooperatively Transporting a Long Payload", Proceedings of the 2002 IEEE International Conference on Robotics & Automation, (May 2002), 3136-3141.
Tribelhorn, et al., "Evaluating the Roomba: A low-cost, ubiquitous platform for robotics research and education", IEEE, (2007), 1393-1399.
Tse, et al., "Design of a Navigation System for a Household Mobile Robot Using Neural Networks", Department of Manufacturing Engg. & Engg. Management, City University of Hong Kong, (1998), 2151-2156.
Watanabe, et al., "Position Estimation of Mobile Robots With Internal and External Sensors Using Uncertainty Evolution Technique", 1990 IEEE International Conference on Robotics and Automation, (May 13-18, 1990), 2011-2016.
Watts, "Robot, Boldly Goes where No Man Can", The Times, (Jan. 1985), 20 pgs.
Wijk, et al., "Triangulation-Based Fusion of Sonar Data with Application in Robot Pose Tracking", IEEE Transactions on Robotics and Automation 16(6), (2000), 740-752.
Wolf, et al., "Robust Vision-Based Localization by Combining an Image-Retrieval System with Monte Carol Localization", IEEE Transactions on Robotics 21(2), (2005), 208-216.
Wolf, et al., "Robust Vision-based Localization for Mobile Robots Using an Image Retrieval System Based on Invariant Features", Proceedings of the 2002 IEEE International Conference on Robotics and Automation, Washington, DC, (May 2002), 359-363.
Wong, "EiED Online» Robot Business", ED Online ID# 13114, [Online] Retrieved from the internet: <http://electronicdesign.com/boards/eied-online-robot-business>, (Jul. 26, 2006), 7 pgs.
Yamamoto, Yutaka, et al., "Optical Sensing for Robot Perception and Localization", IEEE Workshop on Advanced Robotics and its Social Impacts, 2005, (Jun. 12-15, 2005), 14-17.
Yata, et al., "Wall Following Using Angle Information Measured by a Single Ultrasonic Transducer", Proceedings of the 1998 IEEE, International Conference on Robotics & Automation, (May 1998), 1590-1596.
Yun, et al., "Image-Based Absolute Positioning System for Mobile Robot Navigation", IAPR International Workshops SSPR, (Aug. 17-19, 2006), 261-269.
Yun, et al., "Robust Positioning a Mobile Robot with Active Beacon Sensors", Lecture Notes in Computer Science vol. 4251, (2006), 890-897.
Yuta, et al., "Implementation of an Active Optical Range sensor Using Laser Slit for In-Door Intelligent Mobile Robot", IEE/RSJ International workshop on Intelligent Robots and systems (IROS 91) vol. 1, (Nov. 3-5, 1991), 415-420.
Zha, et al., "Mobile Robot Localization Using Incomplete Maps for Change Detection in a Dynamic Environment", IEEE/ASME International Conference on Advanced Intelligent Mechatronics '97 Final Program and Abstracts, (Jun. 16-20, 1997), 110 pgs.
Zhang, et al., "A Novel Mobile Robot Localization Based on Vision", SPIE vol. 6279, (Jan. 29, 2007), 6 pgs.
U.S. Appl. No. 13/028,996/U.S. Pat. No. 8,800,107, filed Feb. 16, 2011, Vacuum Brush.
U.S. Appl. No. 14/215,997/U.S. Pat. No. 10,314,449, filed Jul. 8, 2014, Vacuum Brush.
"Maschinemarkt Wurzburg 105, No. 27", Robovac 1999, (Jul. 5, 1999), 4 pgs.
"U.S. Appl. No. 13/028,996, Non Final Office Action dated Jan. 4, 2013", 8 pgs.
"U.S. Appl. No. 13/028,996, Response filed Apr. 15, 2013 to Non Final Office Action dated Jan. 4, 2013", 12 pgs.
"U.S. Appl. No. 13/028,996, Final Office Action dated May 8, 2013", 8 pgs.
"U.S. Appl. No. 13/028,996, Response filed Jun. 19, 2013 to Final Office Action dated May 8, 2013", 8 pgs.
"U.S. Appl. No. 13/028,996, Examiner Interview Summary dated Jun. 19, 2013", 3 pgs.
"U.S. Appl. No. 13/028,996, Notice of Allowance dated Jul. 17, 2013", 8 pgs.
"U.S. Appl. No. 13/028,996, Notice of Allowance dated Dec. 27, 2013", 8 pgs.
"U.S. Appl. No. 13/028,996, Notice of Allowance dated Jul. 2, 2014", 6 pgs.
"U.S. Appl. No. 12/687,464, Non Final Office Action dated Jul. 15, 2011", 13 pgs.
"International Application Serial No. PCT US2007 069389, Written Opinion dated Feb. 14, 2008", 6 pgs.
"U.S. Appl. No. 11/751,470, Non Final Office Action dated May 27, 2010", 13 pgs.
"U.S. Appl. No. 11/751,470, Final Office Action dated Feb. 18, 2011", 17 pgs.
"U.S. Appl. No. 11/751,267, Non Final Office Action dated Apr. 13, 2010", 7 pgs.
"U.S. Appl. No. 11/751,267, Final Office Action dated Dec. 2, 2010", 6 pgs.
"U.S. Appl. No. 11/834,656, Non Final Office Action dated Jul. 28, 2008", 7 pgs.
"U.S. Appl. No. 11/834,656, Final Office Action dated Jan. 26, 2009", 6 pgs.
"U.S. Appl. No. 11/834,606, Non Final Office Action dated Feb. 28, 2008", 5 pgs.
"U.S. Appl. No. 11/834,647, Non Final Office Action dated May 16, 2008", 6 pgs.
"U.S. Appl. No. 11/834,647, Final Office Action dated Oct. 31, 2008", 8 pgs.
"U.S. Appl. No. 11/834,647, Non Final Office Action dated Mar. 6, 2009", 6 pgs.
"U.S. Appl. No. 11/834,647, Non Final Office Action dated Sep. 9, 2009", 8 pgs.
"U.S. Appl. No. 10/818,073, Non Final Office Action dated May 7, 2008", 8 pgs.
"U.S. Appl. No. 10/818,073, Final Office Action dated Jan. 7, 2009", 5 pgs.
"U.S. Appl. No. 11/751,413, Non Final Office Action dated Aug. 2, 2010", 8 pgs.
"International Application Serial No. PCT US2011 025095, International Preliminary Report on Patentability dated Aug. 30, 2012", 9 pgs.
"European Application Serial No. 11713539.2, Response filed Mar. 25, 2013 to Communication pursuant to Rules 161(1) and 162 EPC dated Sep. 25, 2012", 10 pgs.
"European Application Serial No. 11713539.2, Communication Pursuant to Article 94(3) EPC dated Feb. 3, 2014", 4 pgs.
"European Application Serial No. 11713539.2, Response filed May 29, 2014 to Communication Pursuant to Article 94(3) EPC dated Feb. 3, 2014", 17 pgs.
"European Application Serial No. 11713539.2, Communication Pursuant to Article 94(3) EPC dated Nov. 4, 2014", 4 pgs.
"European Application Serial No. 11713539.2, Response filed Mar. 16, 2015 to Communication Pursuant to Article 94(3) EPC dated Nov. 4, 2014", 10 pgs.
"European Application Serial No. 11713539.2, Communication Pursuant to Article 94(3) EPC dated Dec. 3, 2015", 4 pgs.
"European Application Serial No. 11713539.2, Response filed May 17, 2016 to Communication Pursuant to Article 94(3) EPC dated Dec. 3, 2015", 10 pgs.
"European Application Serial No. 17157969.1, Extended European Search Report dated Sep. 19, 2017", 10 pgs.

(56) References Cited

OTHER PUBLICATIONS

"European Application Serial No. 17157969.1, Response filed Mar. 7, 2018 to Extended European Search Report dated Sep. 19, 2017", 11 pgs.
"Matsushita develops "cleaning robot autonomous control system"—conducts a demonstration experiment of a cleaning robot at home", Ascii.jp, [Online] Retrieved from the Internet :http: ascii.jp elem 000 000 330 330024 , (Mar. 25, 2002), 8 pgs.
"U.S. Appl. No. 13/307,893, Non Final Office Action dated Jul. 20, 2012", 13 pgs.
"Chinese Application Serial No. 201810153702.1, Office Action dated Mar. 2, 2020", W O English Translation, 9 pgs.
"Chinese Application Serial No. 201810153702.1, Response filed Jul. 17, 2020 to Office Action dated Mar. 2, 2020", w English claims, 16 pgs.
"Chinese Application Serial No. 201810153702.1, Office Action dated Nov. 13, 2020", w English Translation, 7 pgs.
"Chinese Application Serial No. 201810153702.1, Response filed Jan. 25, 2021 to Office Action dated Nov. 13, 2020", w English Claims, 15 pgs.
Bison, P, "Using a structured beacon for cooperative position estimation", Robotics and Autonomous Systems vol. 29, No. 1, (Oct. 1999), 03-40.
Cameron, Morland, "Autonomous Lawn Mower Control", (Jul. 24, 2002), 10 pgs.
Derek, Kurth, "Range-Only Robot Localization and SLAM with Radio", (Jul. 27, 2012).
Gat, Erann, "Robust Low-Computation Sensor-Driven Control for Task-Directed Navigation", Proceedings of the 1991 IEEE, International Conference on Robotics and Automation, Sacramento, California, (Apr. 1991), 2484-2489.
Karcher, "Karcher RoboCleaner RC 3000", Retrieved from the Internet: URL: www.robocleaner.de english screen3.html, (accessed Dec. 2003), 4 pgs.
King, "Helpmate Autonomous Mobile Robots Navigation Systems", SPIE vol. 1388 Mobile Robots, (1990), 190-198.
Li, "Robust Statistical Methods for Securing Wireless Localization in Sensor Networks", Wireless Information Network Laboratory, Rutgers University, (2005), 8 pgs.
Martishevsky, "The Accuracy or point light target coordinate determination by dissectoral tracking system", SPIE vol. 2591, (Oct. 23, 2005), 25-30.
Thrun, Sebastian, "Learning Occupancy Grid Maps With Forward Sensor Models", School of Computer Science, Carnegie Mellon University, 1-28.

* cited by examiner

VACUUM BRUSH

CROSS REFERENCE TO RELATED APPLICATIONS

This U.S. patent application is a continuation of and claims priority under 35 U.S.C. § 120 from U.S. patent application Ser. No. 14/325,997, now U.S. Pat. No. 10,314, 449, filed on Jul. 8, 2014, which is a continuation of and claims priority under 35 U.S.C. § 120 from U.S. patent application Ser. No. 13/028,996, now U.S. Pat. No. 8,800, 107, filed on Feb. 16, 2011, which claims priority under 35 U.S.C. § 119(e) to U.S. Provisional Application No. 61/304, 886, filed Feb. 16, 2010. The disclosures of these prior applications are considered part of the disclosure of this application and are hereby incorporated by reference in their entireties.

TECHNICAL FIELD

This disclosure relates to a vacuum brush for a robotic vacuum. The present teachings relate more particularly to a vacuum brush for a robotic vacuum including portions that lessen the amount of hair and similar matter that reach the bearing and drive areas of the robotic vacuum cleaning head.

BACKGROUND

Hair and other similar matter can become wrapped around the ends of robotic vacuum brushes, becoming entangled in the ends of the brushes (e.g., around bearings and drive protrusions) and/or in gearboxes that drive the brushes to rotate relative to the cleanings head compartment. Such entanglement can stall the robotic vacuum, make cleaning less effective, or cause other undesirable events.

Axle guards or end caps can be provided adjacent one or more ends of each brush to keep hair and other similar matter from reaching the brush ends to prevent such matter from becoming entangled in the ends of the brushes and/or in the gearbox. However, the axle guards and end caps currently employed in robotic vacuums may not sufficiently prevent hair and similar matter from becoming entangled in the ends of the brushes and/or in the gearbox. Thus, robotic vacuums employing known axle guards and end caps may still stall due to entangled matter.

SUMMARY

The present teachings provide a rotating cleaning element configured to be inserted in a cleaning head compartment of a robotic vacuum. The rotating cleaning element includes a drive end including a drive protrusion configured to engage a drive mechanism of the cleaning head compartment, a bearing end and a shroud configured to surround at least a portion of the bearing end to lessen an amount of hair and similar matter that reaches the bearing, and a central member extending between the bearing end and the drive end.

The bearing end of the rotating cleaning element may further include a cylindrical sleeve surrounding a shaft of the rotating cleaning element, a circular flange adjacent the central member of the rotating cleaning element and extending radially outwardly from the sleeve of the central member, and a recess between a portion of the central member and the circular flange.

The shroud may include a first wall generally parallel to a central axis of the central member, a second wall extending generally perpendicular to the first wall, a third wall extending generally perpendicular to the second wall, and a fourth wall extending generally perpendicular to the third wall to define the interior of the shroud, and wherein a reservoir into which the hair and similar matter is collected is defined between the circular flange, the first wall of the shroud, the second wall of the shroud, and the sleeve.

The rotating cleaning element further includes a labyrinth passage between the recess and the reservoir, the labyrinth passage being a path between the recess and the reservoir at an outer diameter of the circular flange. The rotating cleaning element may further include a guard extending outwardly from the sleeve to an interior wall of the shroud. The circular flange, the guard and the shroud may define a first reservoir into which the hair and similar matter is collected.

The shroud may include a first wall generally parallel to a central axis of the central member, a second wall extending generally perpendicular to the first wall, a third wall extending generally perpendicular to the second wall, and a fourth wall extending generally perpendicular to the third wall to define the interior of the shroud.

The at least one guard may extend from the sleeve radially outwardly to the third wall of the shroud, the first reservoir being defined between the circular flange, the first wall of the shroud, the second wall of the shroud, a portion of the third wall of the shroud, the guard, and the sleeve.

The guard may extend from the sleeve radially outwardly toward the third wall of the shroud, the first reservoir being defined between the circular flange, the first wall of the shroud, the second wall of the shroud, the guard, and the sleeve. The rotating cleaning element may further include a first labyrinth passage between the recess and the first reservoir, the first labyrinth passage being a path between the recess and the first reservoir at an outer diameter of the circular flange. The guard, the sleeve and the shroud may define a second reservoir into which the hair and similar matter is collected.

The rotating cleaning element may further include a second labyrinth passage between the first reservoir and the second reservoir, the second labyrinth passage being a path between the first reservoir and the second reservoir at an outer diameter of the guard. The rotating cleaning element may be one of a main brush and a flapper brush.

The present teachings provide a cleaning head subsystem for a robotic vacuum, the cleaning head subsystem including a cleaning head compartment and at least one cleaning element. The cleaning element includes a bearing end and a first shroud configured to surround at least a portion of the bearing end and a sleeve thereof, a first reservoir being defined at least between a portion of the first shroud and the sleeve, a drive end comprising a drive protrusion configured to engage a drive mechanism of the cleaning head compartment, and a central member extending between the bearing end and the drive end. The drive end includes a second shroud configured to surround at least a portion of the drive end of the brush assembly and at least one guard extending radially outwardly from a central axis of the central member toward an interior of the second shroud, a second reservoir being defined at least between a portion of the second shroud and the guard.

The drive end may further include a retention device and a drive protrusion, the retention device being configured to limit axial motion of the cleaning element.

The retention device may include a plurality of interlocking members configured to engage one or more recesses in a drive gear that engages the drive protrusion.

The present teachings provide a cleaning head subsystem for a robotic vacuum, the cleaning head subsystem including a cleaning head compartment, a cleaning element assembly disposed within the cleaning head compartment, the cleaning element assembly including a main brush and a flapper brush, and a gearbox comprising a main brush drive gear to drive the main brush, a flapper brush drive gear to drive the flapper brush, and a first shroud configured to surround at least one of the main brush drive gear and the flapper brush drive gear.

The cleaning head subsystem may further include a second shroud configured to surround the other of the main brush drive gear and the flapper brush drive gear. The first shroud may be disposed over a drive end of the main brush in an installed position of the main brush, and the second shroud may be disposed over a drive end of the flapper brush in an installed position of the flapper brush. The cleaning head subsystem may further include a motor to drive the gearbox, and a third shroud extending between the motor and the gearbox. The third shroud may cooperate with the gearbox housing to create a recessed collection area for hair and similar matter.

Additional objects and advantages of the present teachings will be set forth in part in the description which follows, and in part will be obvious from the description, or may be learned by practice of the present teachings. The objects and advantages of the teachings will be realized and attained by means of the elements and combinations particularly pointed out in the appended claims.

It is to be understood that both the foregoing general description and the following detailed description are exemplary and explanatory only and are not restrictive of the present teachings, as claimed.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Some robotic vacuums include a cleaning head subsystem providing cleaning mechanisms for the robotic vacuum and comprising a brush assembly including a main brush and a flapper brush as illustrated in U.S. Pat. No. 7,636,982, the disclosure of which is incorporated by reference herein in its entirety. The main brush and the flapper brush can be mounted in recesses in the cleaning head compartment. Each main brush and flapper brush can comprise a central member (e.g., a cage) with first and second ends configured to mount the brush in the cleaning head compartment. One end of the brush/flapper is mounted to a gearbox or drive side of the cleaning head compartment, and the other end of the brush/flapper can comprise a bearing allowing the brush to rotate substantially freely when mounted to an opposite end of the cleaning head.

Axle guards or end caps can be provided adjacent one or more ends of each brush to lessen the amount of hair and similar matter that reaches and becomes entangled in the ends of the brushes and/or in the gearbox. Entanglement can stall the robotic vacuum, make cleaning less effective, or cause other undesirable events.

The present teachings therefore include a number of improvements for the ends of the main brush and/or the flapper brush that lessen the amount of hair and similar matter that reach and become entangled in the ends of the brushes and/or in the gearbox.

Figure 1:
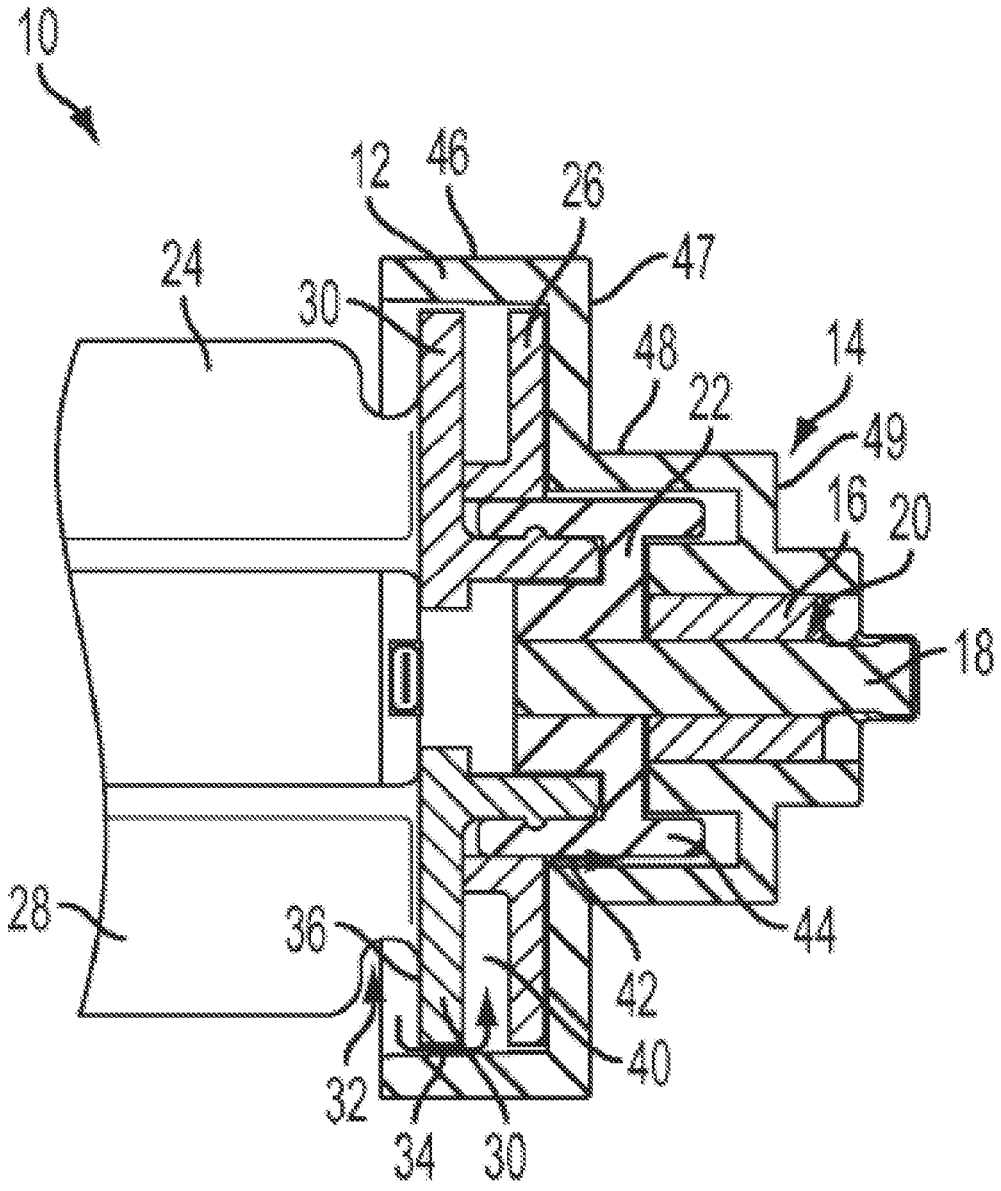
FIGS. 1-4 are cross-sectional views of various embodiments of a bearing end portion of a main brush for a robotic vacuum.

FIG. 1 illustrates a brush that may be a main brush or a flapper brush of a cleaning head subsystem, for example, that includes an embodiment of a shroud that can be employed in accordance with the present teachings to cover at least the bearing end of one or more of the main brush and the flapper brush of the cleaning head subsystem. In FIG. 1, the shroud 12 is shown covering a bearing end 14 of a brush 10, which is shown in FIG. 1 as a main brush. The shroud 12 is preferably not attached to the brush 10 and thus can remain stationary while the brush 10 rotates. The illustrated shroud 12 covers the bearing end 14 of the illustrated brush 10, and can optionally include an integrally molded or formed bearing 16 to reduce the total number of parts in the cleaning head subsystem. The bearing 16 need not, however, be integrally molded or formed in the shroud 12 and may be provided as a separate piece that, for example, fits within the shroud 12. The bearing 16 allows a shaft 18 of the brush 10 to rotate substantially freely when mounted in the cleaning head (shown more clearly in FIG. 15A, for example). If an integrally molded or formed bearing 16 is used with the shroud 12, an axle (or shaft 18) of the brush 10 is inserted into an aperture 20 in the shroud/bearing. When the bearing 16 is provided separate from the shroud 12, the brush shaft 18 can be inserted in the bearing 16 and then the bearing 16 can be inserted in the shroud 12, or the bearing 16 can be inserted in the shroud 12 before the shaft 18 is inserted into the bearing 16.

A shaft housing/cage cap 22 can be used to attach the shaft 18 to a cage 24 of the brush 10. The shaft housing/cage cap 22 provides protection for the bearing 16 from hair and other matter migrating into bearing 16. The shroud 12 includes a first wall 46 parallel to the cage 24 of the brush 10, a second wall 47 extending relatively perpendicularly from the first wall 46 toward the shaft 18, a third wall 48 extending relatively perpendicularly from the second wall 47 toward the bearing end 14, and a fourth wall 49 extending relatively perpendicularly from the third wall 48. A guard (e.g., an axle guard) 26 can surround the shaft housing/cage cap 22 to prevent hair and similar matter that has entered an interior of the shroud 12 from migrating outwardly toward the shaft housing/cage cap 22, the bearing 16, and the shaft 18. The guard 26 can extend perpendicularly with respect to the shaft 18 toward the first wall 46 of the shroud 12 and an outer face of the guard 26 can be maintained in close proximity to the second wall 47 to prevent hair and other matter from approaching the bearing 16.

FIG. 1 includes a circular flange 30, which may be similar to the guard 26 but spaced therefrom, a recess 32 lying between ribs 28 of the cage 24 and the circular flange 30, and a first labyrinth passage 34 from the recess 32, through a space between the outer diameter of the circular flange 30 and the shroud 12 to an internal reservoir 40 formed between the circular flange 30, the guard 26, and the first wall 46 of the shroud 12. The circular flange 30 is substantially parallel to the guard 26 and also extends perpendicularly with respect to the shaft 18 toward the first wall 46 of the shroud 12. Hair may collect around the cage ribs 28 and gather in the recess 32. Build-up of hair in the recess 32 and against a facing wall 36 of the circular flange 30 can provide a dam that prevents entry of hair and similar matter into the shroud interior once initial buildup has occurred, providing a location for hair and similar matter to collect where the hair and similar matter will not stall the robotic vacuum. The first labyrinth passage 34 provides a short passage from the recess 32 at a large outer diameter of the circular flange 30 to the reservoir 40. The short length of the first labyrinth passage 34 ensures that minimal torque is required if any hair or similar matter enters the shroud 12. In particular, if the labyrinth passage 34 was long, hair and other matter would be more likely to get stuck, causing a rise in torque and resulting in stalling the cleaning head. The internal reservoir 40 formed between the circular flange 30, the guard 26 and the first wall 46 of the shroud 12 provides a location for hair and similar matter that has entered the shroud 12 to collect where the hair and similar matter will not stall the robotic vacuum, i.e., the hair and other matter does not interfere with the bearing 16 when the hair, etc. is retained within the internal reservoir 40.

A second labyrinth passage 42 is formed between an exterior surface of the shaft housing/cage cap 22 and a complementary interior surface of the shroud 22 between the shaft housing/cage cap 22 and the second wall 47, the third wall 48 and the fourth wall 49 of the shroud, particularly around protrusions 44 of the shaft housing/cage cap 22 that extend into recesses in the shroud 12 interior. The path through the second labyrinth passage 42 is long and offers additional protection for the bearing 16 because the first labyrinth passage 34 has drastically reduced the amount of hair reaching the second labyrinth passage 42.

Figure 2:
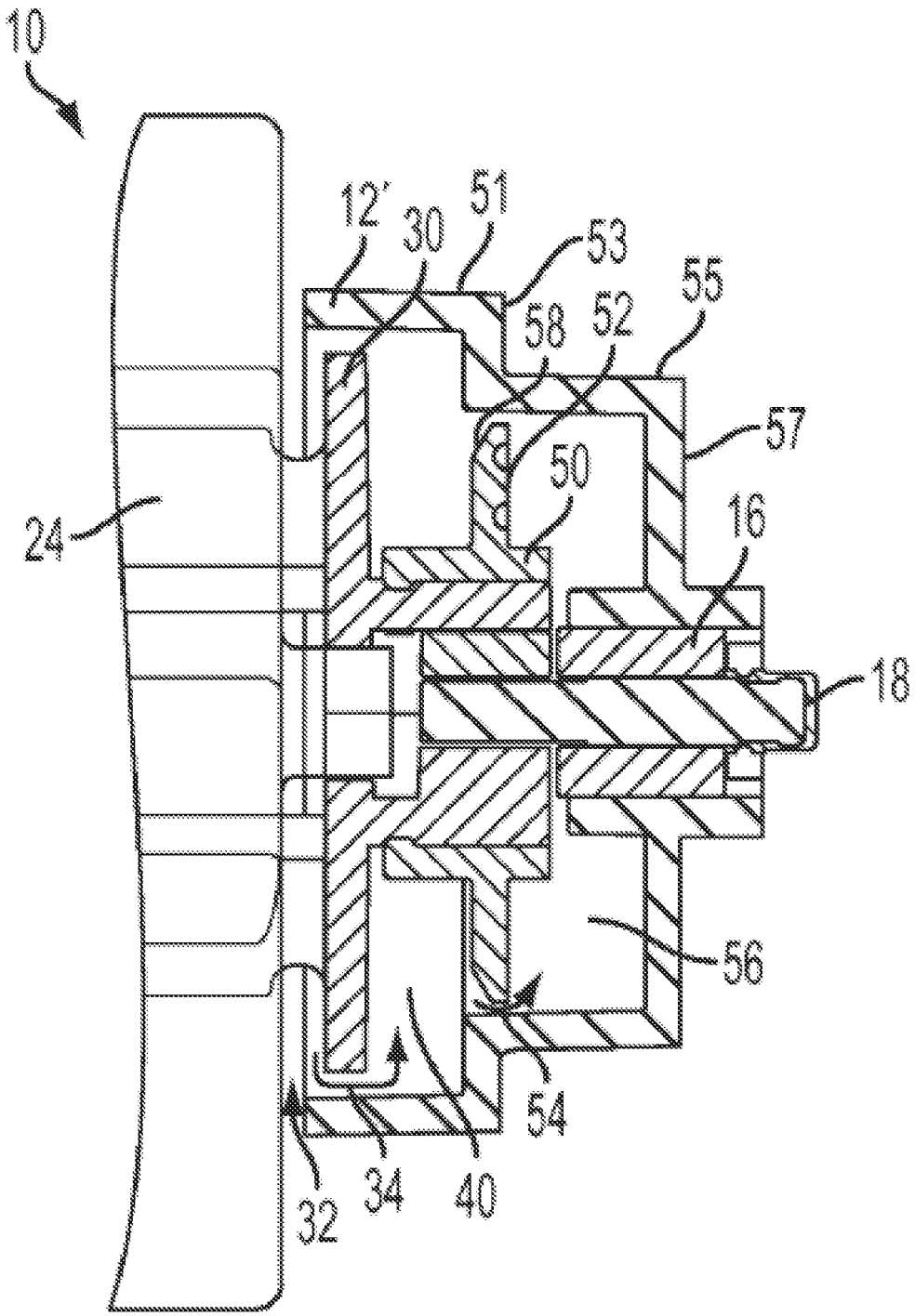

FIG. 2 illustrates another embodiment of a bearing end portion of a main brush for a robotic vacuum, wherein like reference numbers indicate like features. The brush 10 includes a shroud 12' and a circular flange 30 that is integrally formed with the brush cage 24. A recess 32 is provided between ribs of the brush cage 24 and the circular flange 30 in order to collect hair and other matter and provides a dam that prevents entry of the hair and other matter into the interior of the shroud 12'. The brush 10 also includes a sleeve 50 generally surrounding a shaft 18 of the brush 10 with a guard 52 extending perpendicularly from the sleeve 50 toward a wall of the shroud 12'. An end 58 of the guard 52 may be slightly tapered toward its distal end on the side opposite the bearing end 14 of the brush 10. Such tapering can be used to accommodate manufacturing tolerances.

The shroud 12' includes a first wall 51 extending generally parallel with a shaft 18 that holds a bearing 16, a second wall 53 that extends generally perpendicular to the first wall 51, a third wall 55 extending from the second wall 53 toward the bearing end 14 and a fourth wall 57 extending generally perpendicular to the third wall 55 toward the bearing 16. The guard 52 extends perpendicularly away from the shaft 18 and can be roughly aligned with the second wall 53, and can divide the interior space of the shroud 12' into a first reservoir 40 and a second reservoir 56. Similar to FIG. 1, a first labyrinth passage 34 is provided from the recess 32 to the first reservoir 40 at the outer diameter of the circular flange 30. The short length of the first labyrinth 34 ensures that minimal torque is required by minimizing the likelihood of hair and other matter getting stuck, as discussed above, should hair or other matter migrate into the gaps.

The second reservoir 56 is defined between the guard 52, the third wall 55 of the shroud 12', the first wall 57 of the shroud 12' and the bearing 16. The second reservoir provides an additional location to collect hair and other matter. The space of the reservoirs 40 and 56 allows hair to be kept loosely, which provides a web to tangle additional hair as the hair enters the reservoirs 40 and 56. A second labyrinth passage 54 is provided from the first reservoir 40 to the second reservoir 56 in a space between the end 58 of the guard 52 and wall 55. The second labyrinth passage 54 provides a short passage at a larger outer diameter to minimize the amount of hair and other matter that is able to enter further into the shroud 12' toward the bearing 16.

Figure 3:
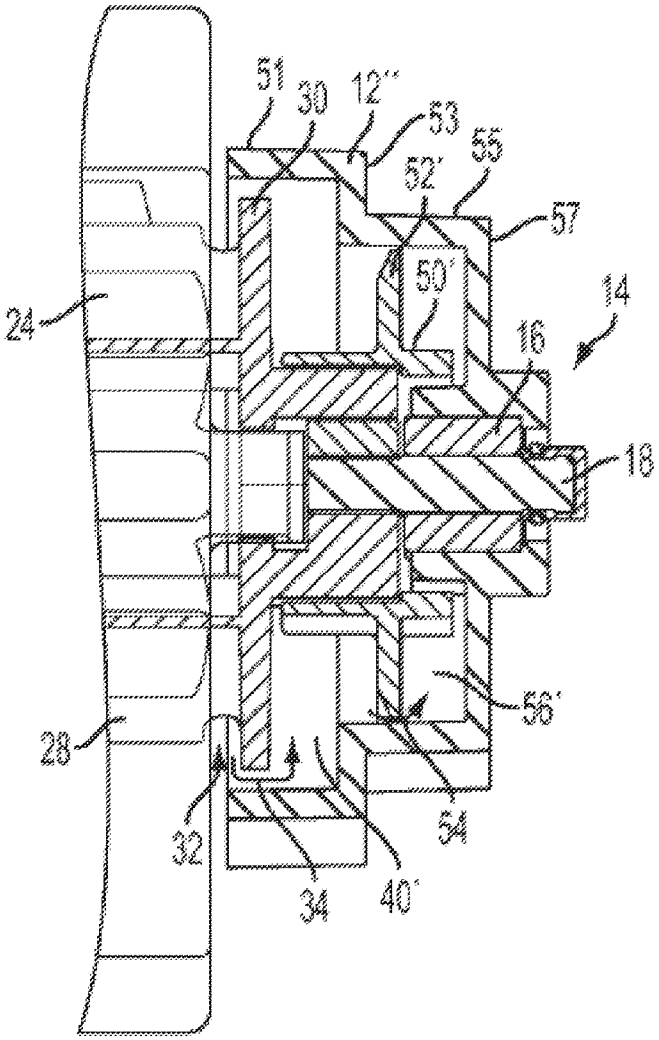

FIG. 3 illustrates another embodiment of a bearing end portion of a main brush for a robotic vacuum, wherein like reference numbers indicate like features. In FIG. 3, a circular flange 30 is provided and a recess 32 is defined between the circular flange 30 and the ribs 28 of the cage 24. The shroud 12" is similar to the shroud 12' illustrated in FIG. 2, with the first 51 and third 53 walls being relatively shorter. Thus, the shroud 12" of FIG. 3 is smaller than the shroud 12' of FIG. 2.

In the embodiment of FIG. 3, the sleeve 50' extends further toward the bearing end 14 than the sleeve 50 in FIG. 2. The guard 52', which extends perpendicularly from the sleeve 50', is provided and extends to the third wall 55, thus providing a larger first reservoir 40' and a smaller second reservoir 56', allowing more hair and other matter to collect in the first reservoir 40' after passing from the recess 32 through the first labyrinth passage 34. The first reservoir 40' is defined between the circular flange 30, the first wall 51, the second wall 53, a portion of the third wall 55, the guard 52' and the sleeve 50'. The second reservoir 56' is defined between the third wall 55 and the fourth wall 57 of the shroud 12" and is smaller than the first reservoir 40'. The embodiment of FIG. 3 may provide better performance than the embodiment of FIG. 2 in preventing hair from reaching the bearing 16.

Figure 4:
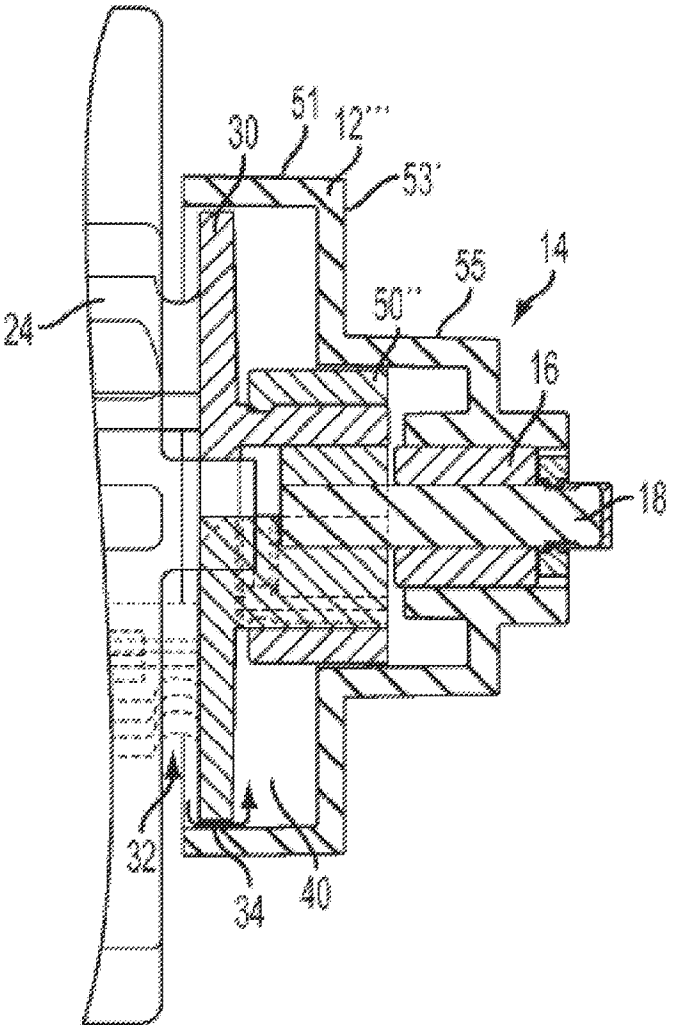

FIG. 4 illustrates another embodiment of a bearing end portion of a main brush for a robotic vacuum, wherein like reference numbers indicate like features. In FIG. 4, a circular flange 30 is provided and a recess 32 is defined between the circular flange 30 and the ribs 28 of the cage 24. The shroud 12' is similar to the shroud 12' illustrated in FIG. 2 and the shroud 12" illustrated in FIG. 3, with the second wall 53 being relatively longer than the second walls of the shroud 12' and the shroud 12".

In the embodiment of FIG. 4, a sleeve 50" extends toward the bearing end 14. The sleeve 50" does not include a guard. The second wall 53' extends from the first wall 51 to the sleeve 50". A first reservoir 40 is defined between the circular flange 30, the first wall 51, the second wall 53' that extends to the sleeve 50" and the sleeve 50". The first reservoir 40 is similarly sized to that of the first reservoir 40 shown in FIG. 2. A first labyrinth passage 34 provides a path for the hair and other matter that is received in the recess 32 to travel to the first reservoir 40. Due to the configuration of the sleeve 50" without a guard and the configuration of the shroud 12'", only one main reservoir is provided to accumulate hair and other matter and prevent the hair and other matter from being received into the bearing 16. Thus, the embodiment of FIG. 4 may provide worse performance than the embodiments of FIGS. 2 and 3 of preventing hair from reaching the bearing 16. The benefits of using the embodiment of FIG. 4 will be discussed below in reference to FIG. 7.

Figure 5:
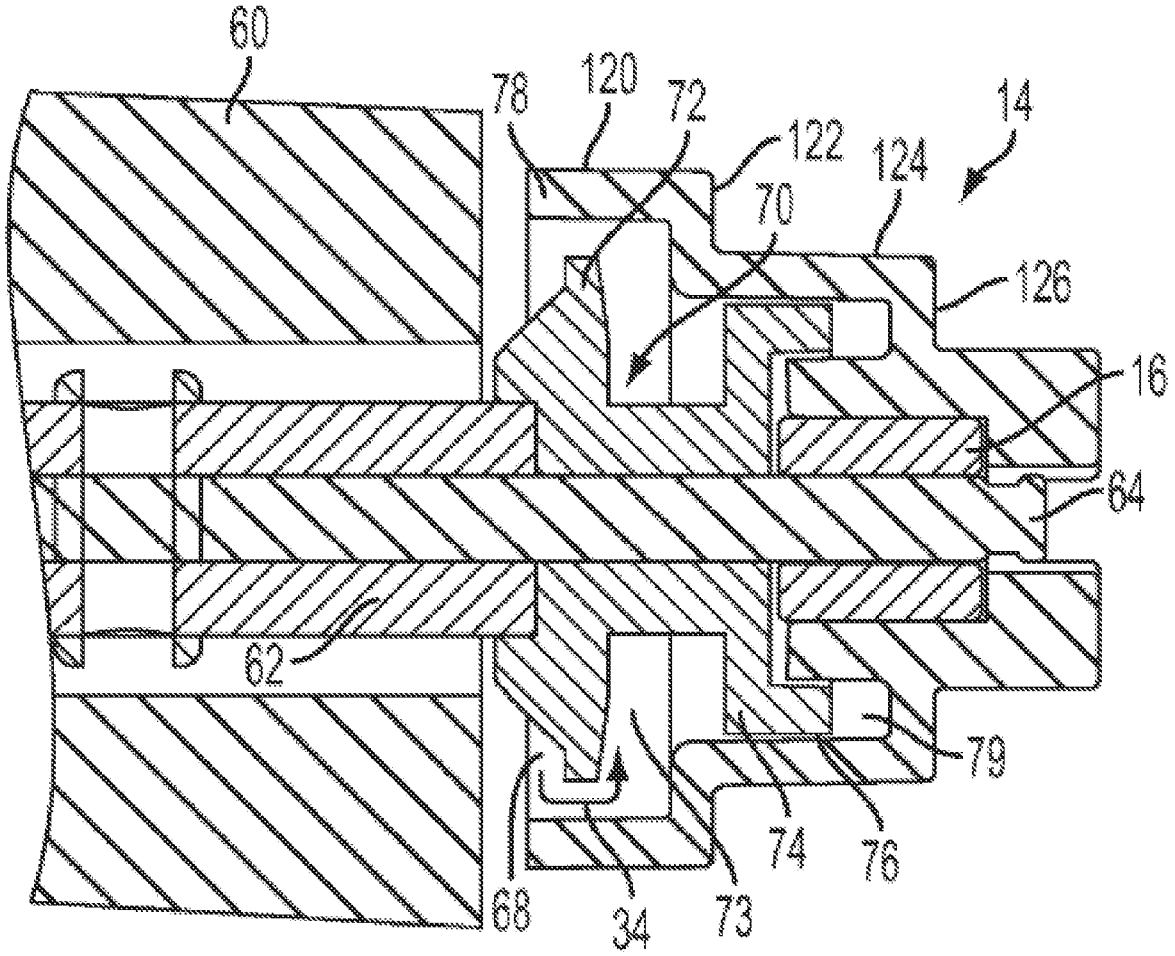
FIGS. 5 and 6 are cross-sectional views of various embodiments of a bearing end portion of a flapper brush for a robotic vacuum.

FIG. 5 illustrates another embodiment of a shroud that can be employed in accordance with the present teachings to cover at least the bearing end of one or more of the main brush and the flapper brush of a cleaning head subsystem. In FIG. 5 a shroud 78 is shown covering a bearing end 14 of a flapper brush 60. The flapper brush 60 includes a flapper shaft 62, for example with an overmold. The shroud 78 is preferably not attached to the brush 60 and thus can remain stationary while the brush 60 rotates. The illustrated shroud 78 can optionally include an integrally molded or formed bearing 16 to reduce the total number of parts in the cleaning head subsystem. The bearing 16 need not, however, be integrally molded or formed in the shroud 78 and may be provided as a separate piece. The bearing 16 allows the brush shaft 64 to rotate substantially freely when mounted in the cleaning head compartment. If an integrally molded or formed bearing 16 is used with the shroud 78, an axle (or shaft) 64 of the brush 60 is inserted into an aperture in the shroud/bearing. When the bearing 60 is provided separate from the shroud 78, the brush shaft 64 can be inserted in the bearing 60 and then the bearing 60 can be inserted in the shroud 78, or the bearing 60 can be inserted in the shroud 78 before the shaft 64 is inserted into the bearing 60.

A shaft housing 70 can surround the axle (or shaft) 64 adjacent at least the bearing end 14 of the brush 60 and include a first flange 72 and a second flange 74 with a recessed area 73 therebetween. A relatively large gap 68 is formed between the first flange 72 of the shaft housing 70 and an adjacent interior surface of the shroud 78. This gap 68 can allow hair and similar matter to enter the recessed area 73 of the shaft housing 70 that is located between the first flange 72 and the second flange 74, providing a location at the recessed area 73 for hair and similar matter to collect where the hair and similar matter will not stall the robotic vacuum. A short labyrinth passage 34 between an exterior surface of the shaft housing 72 and a complementary interior surface of the shroud 78 from the large gap 68 to the recessed area 73 provides a short passage at a large outer diameter of the shaft housing 72. The short length of the passage 34 ensures that minimal torque is required by minimizing the likelihood of hair and other matter getting stuck, as discussed above, if any hair or similar matter enters the shroud. The shaft housing cap 70 includes protrusions 76 extending from the second flange 74 into recesses 79 in the shroud 78 interior. As passage from the gap 68 into the recessed area 73 and around the protrusions 79 into the recesses 79 is long and difficult, additional protection is provided for the bearing 16.

Figure 6:
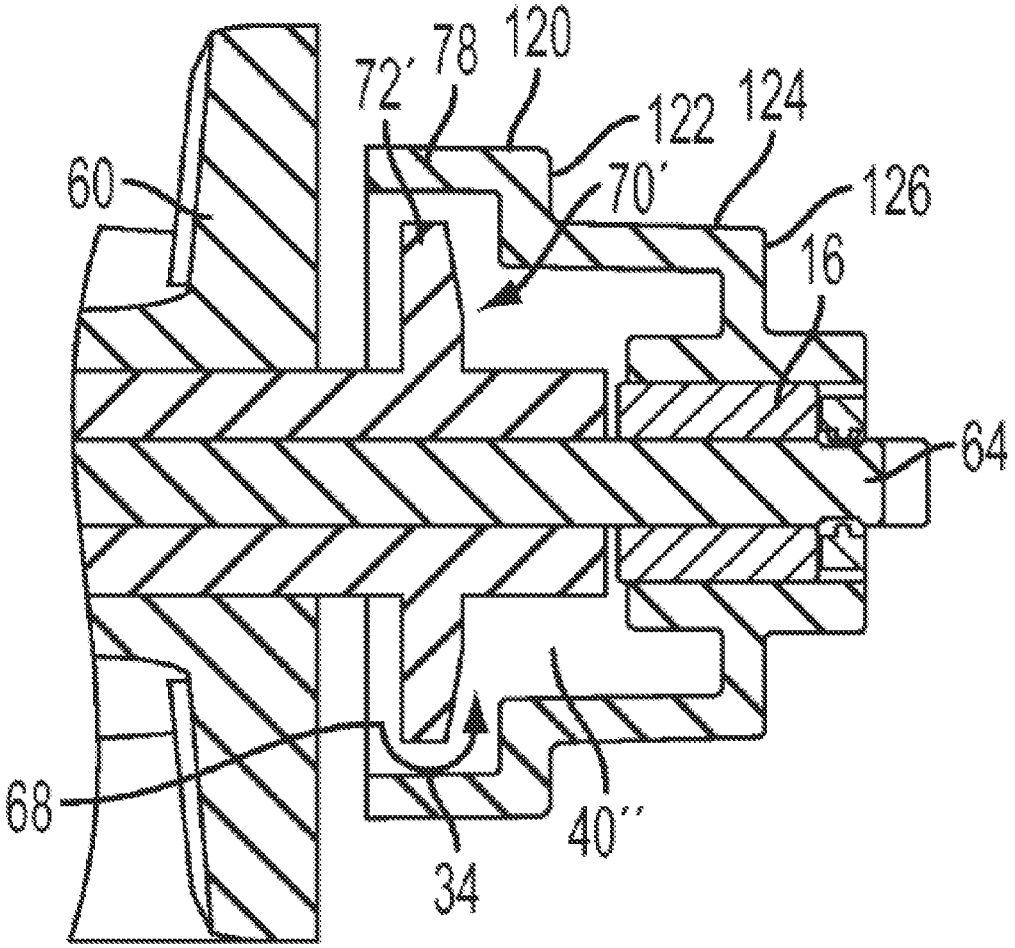

FIG. 6 illustrates an alternative embodiment of the shroud employed to cover at least the bearing end of one or more of the main brush and the flapper brush of a cleaning head subsystem. The structure of the bearing 16, shroud 78 and axle or shaft 64 is similar to that disclosed in FIG. 5. In FIG. 6, a shaft housing 70' that includes a sleeve and a guard 72' is provided. The guard 72' extends from the sleeve portion of the shaft housing 70' toward the shroud 78. The shroud 78 includes a first wall 120 extending parallel to the shaft 64, a second wall 122 extending generally perpendicular to the first wall 120, a third wall 124 extending generally perpendicular to the second wall 122, and a fourth wall 126 extending generally perpendicular to the third wall 124. A recess 68 is formed between the guard 72' and the brush 60. Hair collects between the flapper brush 60 and the guard 72' and provides a dam which prevents hair entry into the shroud 78 once initial buildup has occurred. A labyrinth passage 34 is formed from the recess 68 between the guard 72' and the shroud 78 interior at first wall 120 and to a reservoir 40". The reservoir 40" receives hair through the labyrinth passage 34 and is relatively large, being defined between a portion of the first wall 120 of the shroud 78, the second wall 122, the third wall 124 and the fourth wall 126. The reservoir 40" provides a location for hair and other matter to collect.

One skilled in the art will appreciate that a shroud as illustrated in FIGS. 1-4 or FIGS. 5 and 6 can be employed in a similar manner on the drive end of one or more of the main brush or the flapper brush in accordance with the present teachings.

Figure 7B:
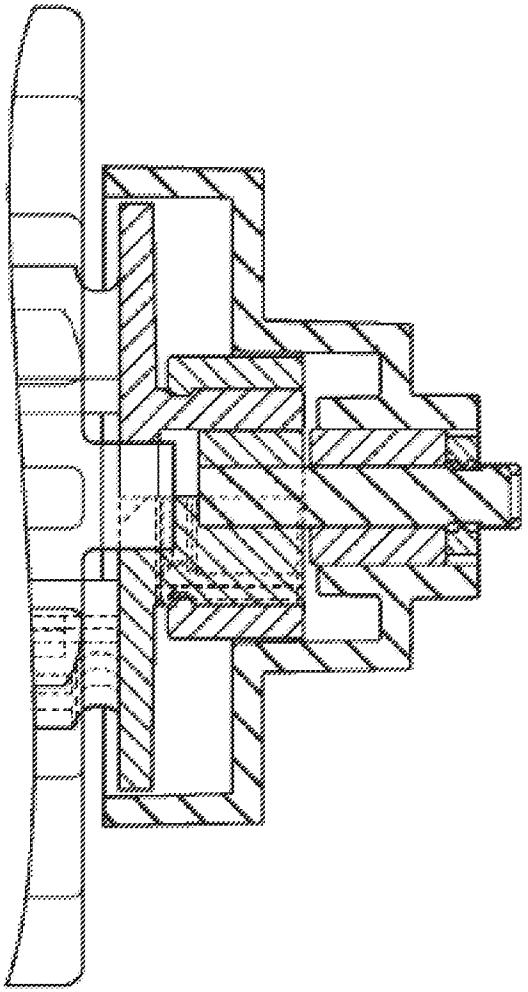
FIGS. 7A and 7B are cross-sectional views of exemplary embodiments of a drive end portion and a bearing end portion, respectively, of a brush for a robotic vacuum.
Figure 7A:
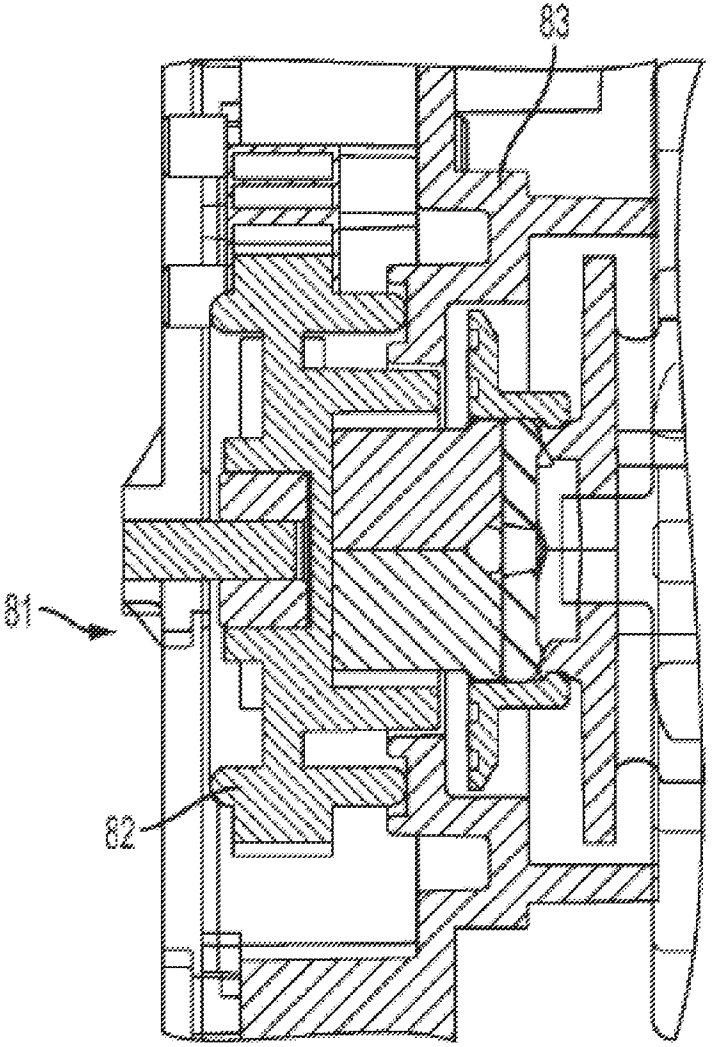

FIGS. 7A and 7B are cross-sectional views of at least one embodiment of a drive end portion and a bearing end portion, respectively, of a brush for a robotic vacuum in accordance with the present teachings. In general, it is preferable for hair and other matter to collect in the bearing end (see FIG. 7B) of the brush instead of being fed into the gearbox of the brush's drive end (see FIG. 7A). Therefore, in a preferred embodiment, the drive end portion shown in FIG. 7A includes an embodiment of the shroud shown with a guard, for example, guard 52 or 52' in FIGS. 2 and 3, while the bearing end portion shown in FIG. 7B includes an embodiment with only the sleeve, for example, sleeve 50" in FIG. 4. As the addition of the guard provides additional protection for the gearbox and as the bearing end does not include a guard, in this embodiment, the hair and other matter tend to migrate away from the drive end (FIG. 7A) and toward the bearing end (FIG. 7B), which is preferable to avoid gearbox failures and to direct the hair and other matter to the end at which a user is able to clean the brushes. As the bearing end preferably does not include the guard, more hair and other matter tend to migrate into the bearing end and be collected in reservoir(s) in the bearing end.

The drive end of the brush includes a gearbox 81 having a gear 82. A shroud 83 surrounds the drive end of the brush and is incorporated into the gearbox 81 at the drive end (see FIG. 16, for example). A continuous stationary shroud housing allows for full 360 degree rotation of the brushes within the stationary shroud. However, it is noted that a shroud need not provide a full 360 degree rotation and may provide less than 360 degrees of rotation for received brushes. Because breaks in the shroud surface promote catching of hair, it is preferable for the gearbox housing to have a single continuous shroud within breaks in the shroud surface.

Figure 8A:
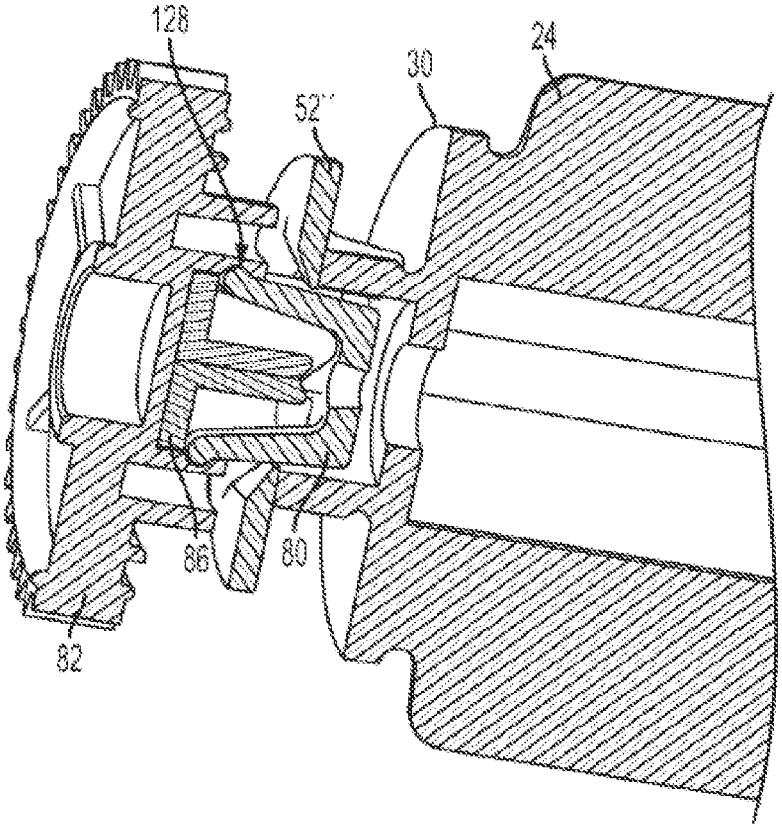
FIG. 8A is a perspective cross-sectional view of an exemplary embodiment of a drive end portion of a brush, including a retention device.
Figure 8B:
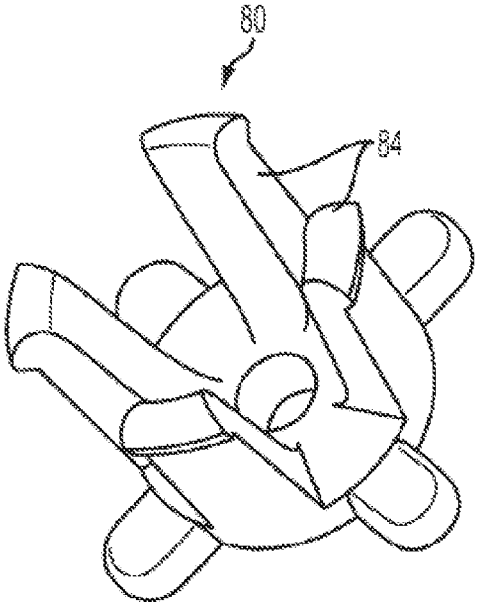
FIG. 8B is a perspective view of the retention device of FIG. 8A.

FIG. 8A is a perspective cross-sectional view of a drive end portion of a brush connected with a drive gear of the cleaning head, including a retention device in accordance with the present teachings, and FIG. 8B is a perspective view of the retention device of FIG. 8A in accordance with the present teachings. In FIG. 8A, a retention device 80 is shown housed internal to the cage 24 of the brush 10. While the retention device 80 is shown attached to the main brush 10, it will be understood by one of ordinary skill in the art that the retention device may also be utilized with a flapper brush. The retention device 80 is positioned between a circular flange 30 and a gear 82 to lock the brush to the gear 82. A sleeve 50''' having a guard 52" extending from the sleeve 50''' may be provided between the circular flange 30 and the gear 82.

The retention device 80 may be, for example, an internal snapping device that is able to be retained to the gear 82. The retention device 80 may include a plurality of interlocking members 84 extending away from the cage 24 when the retention device 80 is in an engaged position. The retention device 80 is internally disposed between the sleeve 50''' and the guard 52" and is received within a drive protrusion 86. When the drive protrusion 86 is inserted into a main recess of the gear 82 (see also gear 120 in FIG. 17), the interlocking members 84 are each received into a reception recess 128 within the interior of the gear 82. The retention device 80 limits the axial motion of the brush 10 toward its bearing end, which reduces the ability of hair and debris to enter the drive end of the brush by reducing gaps at the drive end.

Figure 16:
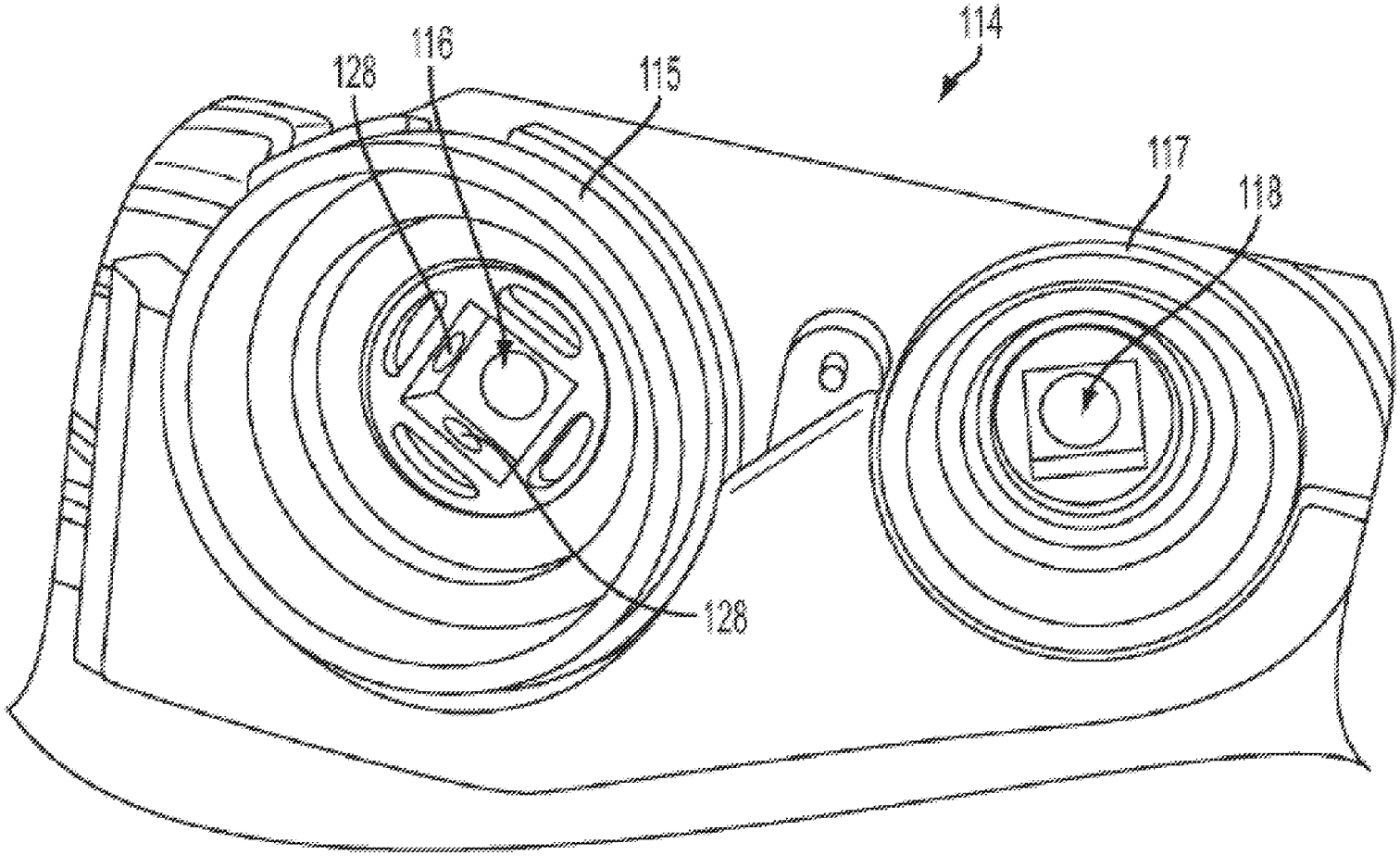
FIG. 16 is a front view of the drive end of the cleaning head compartment.
Figure 17:
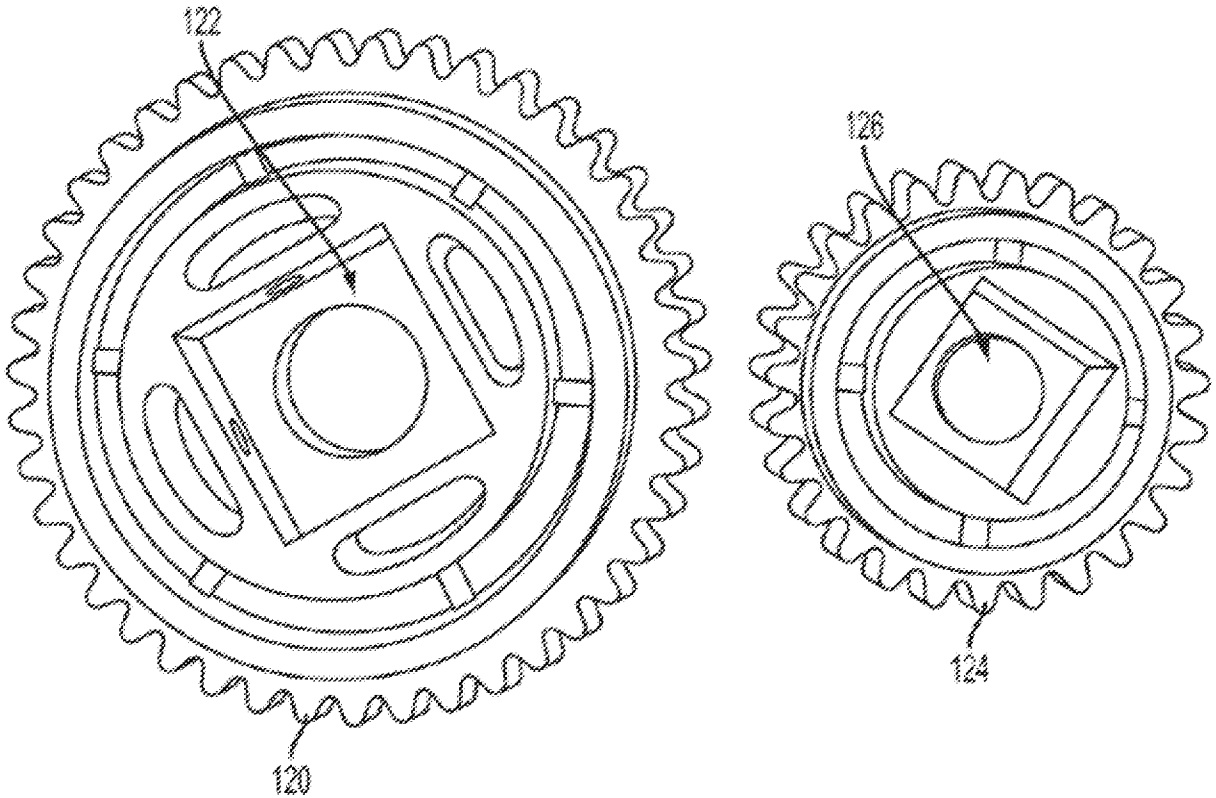
FIG. 17 is a top view of gears for the main brush and the flapper brush.

The drive protrusion 86 can engage a gear recess, such as, e.g., gear recess 122 for gear 120 shown in FIGS. 16 and 17, which is disposed within a shroud head 114 including a shroud portion, such as shroud 115 for the main brush 10 and a shroud portion, such as shroud 117 for the flapper brush 60, as shown in FIG. 16, for example. While the gear 120 shown in FIG. 17 and similarly shown as gear 82 in FIG. 8A, which are used with the main brush 10, is illustrated in connection with the retention device 80, it may be understood by those of ordinary skill that the retention device 80 may also or alternatively be used with the flapper brush 60 and thus may be used with the gear 124 engaged with the shroud 117 and having a gear recess 126.

In addition, although the retention device 80 is shown being housed internal to the brush cage 24 with the interlocking members 84 being retained by reception recesses 128 within the gear 82, one of ordinary skill would recognize that the retention device could alternatively be provided at the gear 82, with corresponding reception recesses located at the brush cage 24 to be retained at the brush end.

Figure 9:
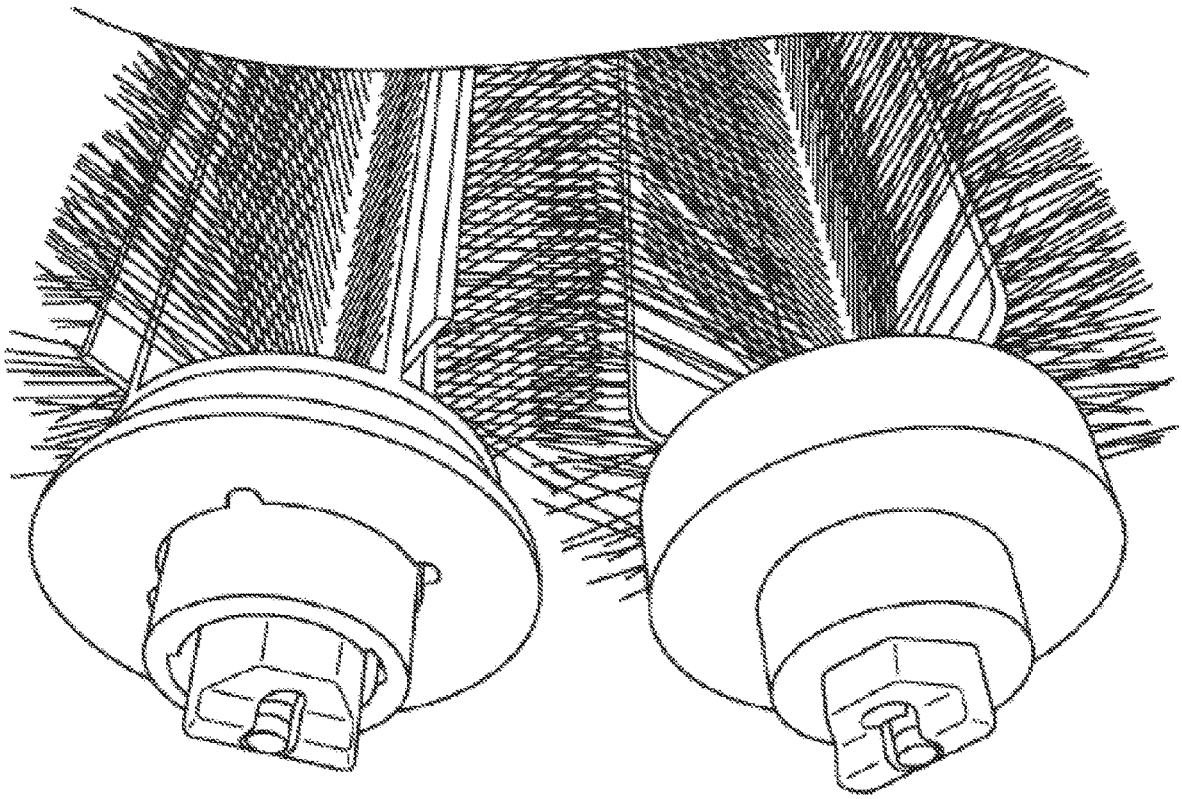
FIG. 9 is a perspective view of an exemplary bearing end portion of an existing robotic vacuum brush (left) and an exemplary bearing end portion of a robotic vacuum brush (right).

Certain embodiments of the present teachings contemplate providing a shrouded end for a brush as set forth in the above exemplary embodiments, which has a size and shape allowing it to be backward compatible with existing cleaning heads. FIG. 9 shows how a bearing end of a shrouded main brush (right) can be sized and shaped like a bearing end of an existing non-shrouded main brush (left) for backward compatibility with existing cleaning heads into which the bearing end of the main brush is mounted, noting that a third wall and a fourth wall (such as walls 48 and 49 shown in FIG. 1, for example).

Figure 10A:
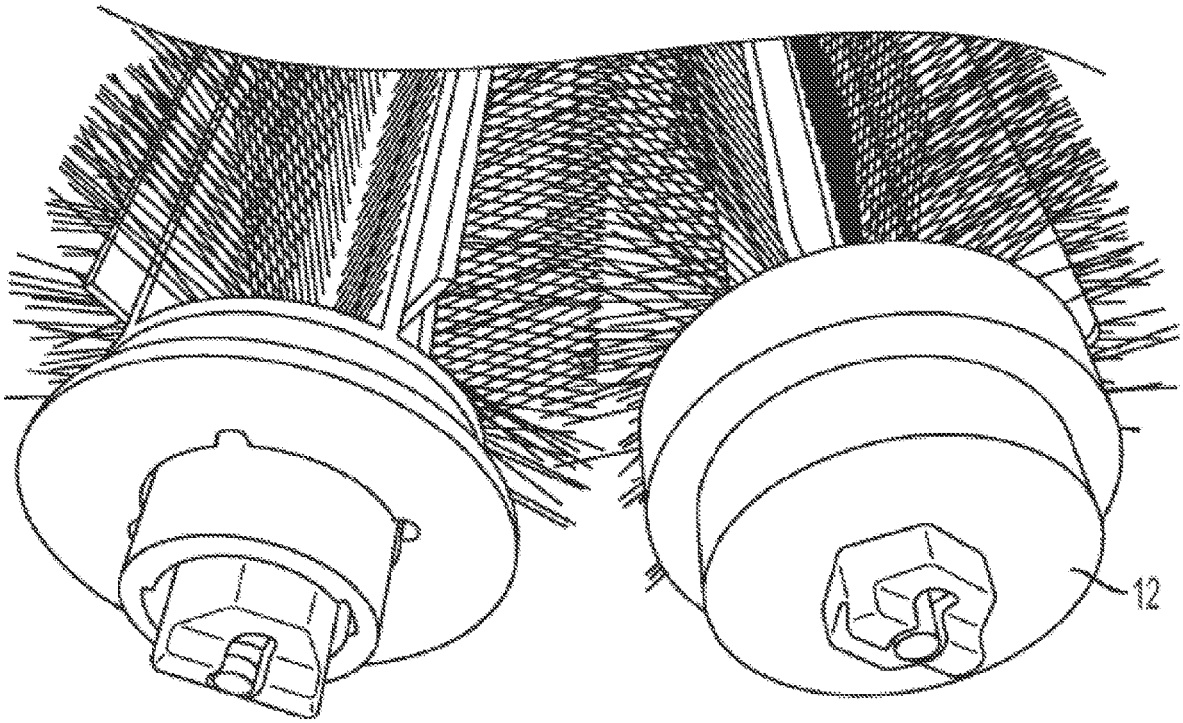
FIG. 10A is a perspective view of a bearing end portion of an existing robotic vacuum brush (left) and an embodiment of a bearing end portion of a robotic vacuum brush in accordance with an exemplary embodiment of the present teachings (right).
Figure 10B:
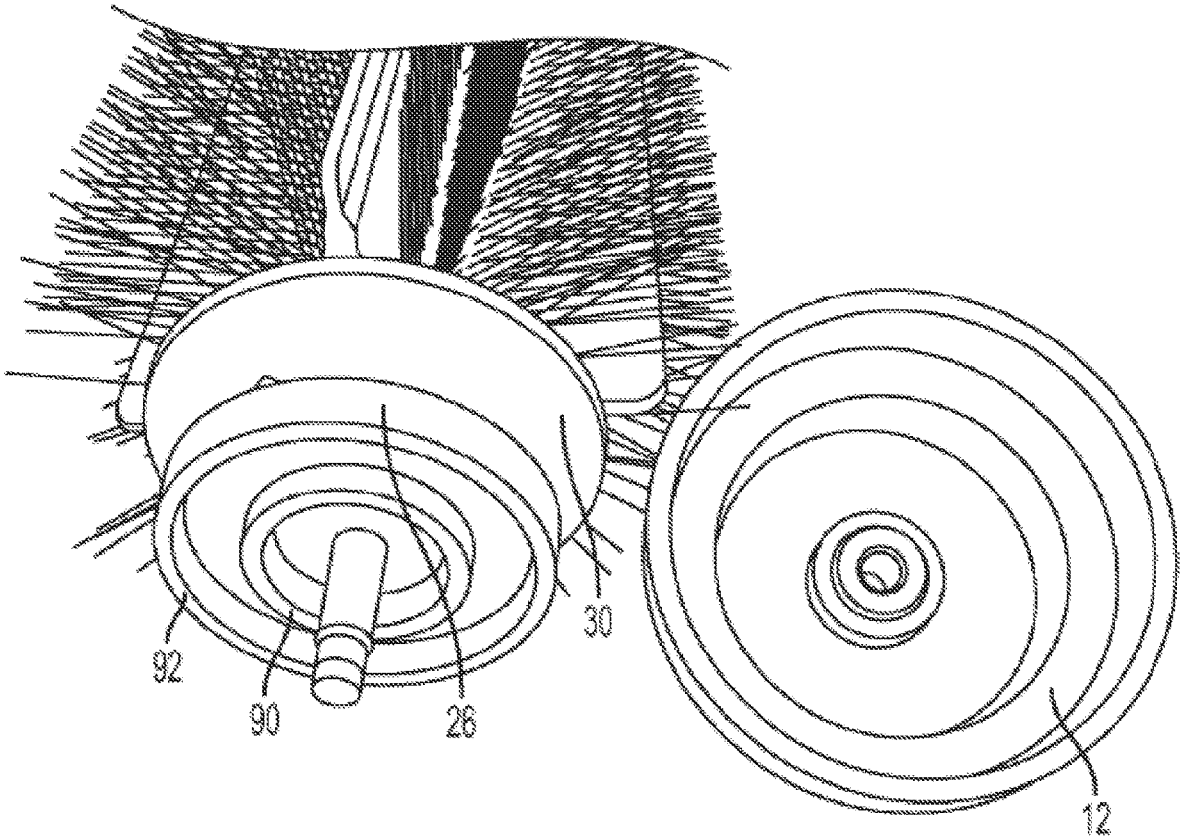
FIG. 10B is a perspective view of the brush bearing end portion embodiment shown on the right side of FIG. 10A, with the shroud removed.

FIG. 10A shows an embodiment of a bearing end of a shrouded main brush (right) with improved hair-resistance properties but which is not backward compatible with existing cleaning heads because it does not have the same size and shape as existing main brush bearing ends (left). The shroud, which may be similar to shroud 12 in FIG. 1, for example, is larger because the brush guard includes a non-removable guard 26 with a large diameter (and optionally with both a first protrusion 90 and a second protrusion 92 for engagement with a second recess of the shroud to form an additional labyrinth) as illustrated in FIG. 10B. An alternative embodiment can include, for example, a shroud that has a third wall and a fourth wall (such as walls 55 and 57 in FIG. 2, for example) that are sized to define a relatively larger diameter than the diameter of the third and fourth walls shown in FIG. 9.

Figure 11A:
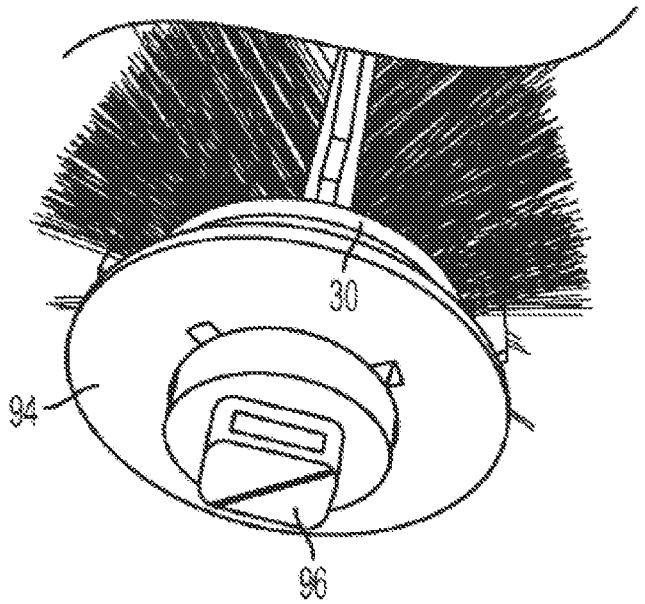
FIG. 11A is a perspective view of a drive end portion of an existing robotic vacuum brush.
Figure 11B:
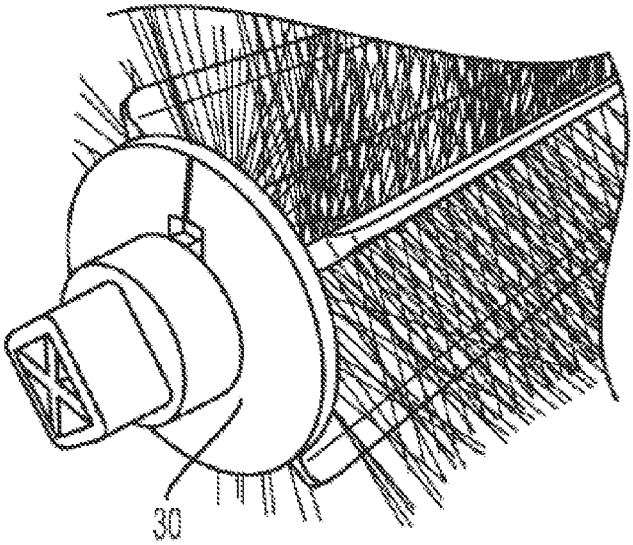
FIG. 11B is a perspective view of an embodiment of a drive end portion of a robotic vacuum brush.
Figure 11C:
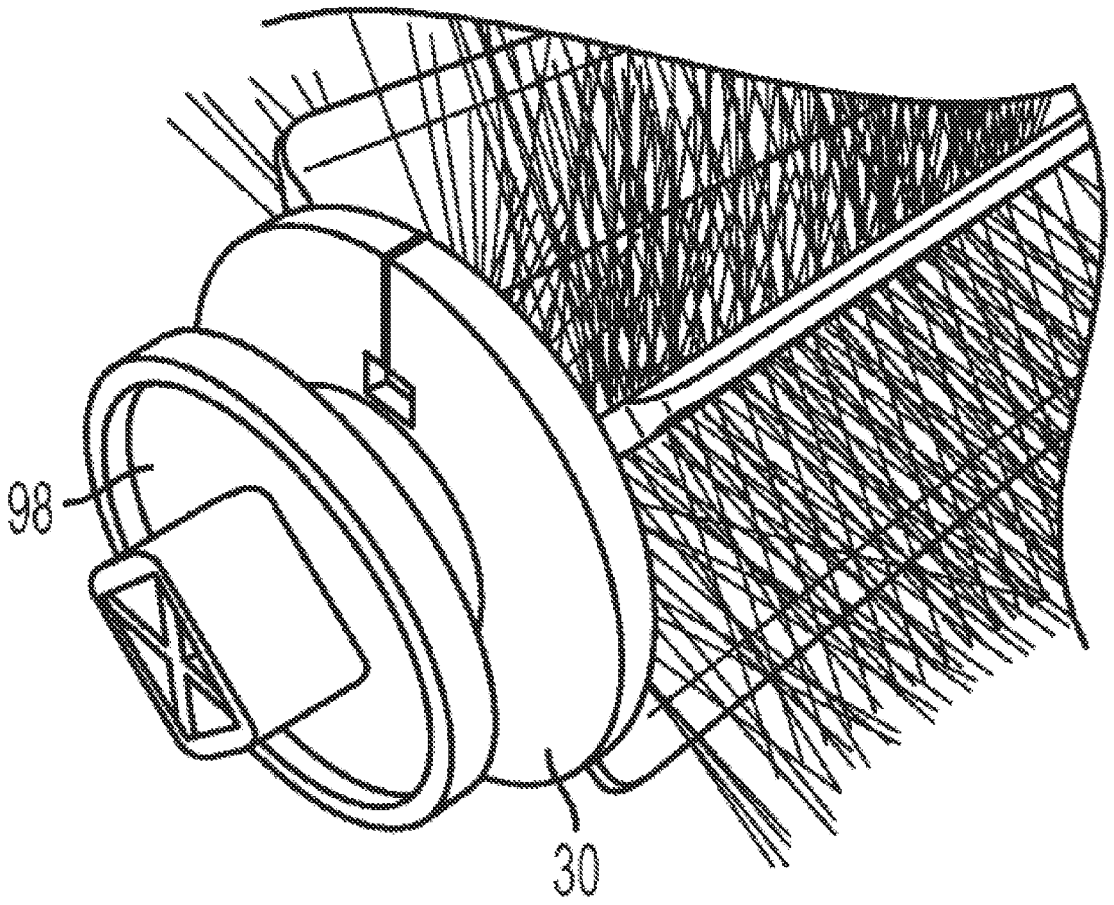
FIG. 11C is a perspective view of an embodiment of a drive end portion of a robotic vacuum brush.

FIG. 11A shows a drive end of an existing main brush, FIG. 11B shows an embodiment of a drive end of a main brush in accordance with the present teachings, and FIG. 11C shows another embodiment of a drive end of a main brush in accordance with the present teachings. As shown, the drive end of the brush can include a drive protrusion 96, e.g., a square-shaped drive protrusion, for engagement with a complementary recess 122 (shown in FIG. 17) of the cleaning head compartment's brush drive mechanism. A removable guard 94 or end cap as illustrated in FIG. 11A can be provided between the square-shaped drive protrusion 96 and a brush cage 24 in the existing brush drive end illustrated in FIG. 11A or in the embodiment of FIG. 11B. The embodiment of FIG. 11B can allow a wider recessed area between a removable end cap and the circular flange 30 of the cage 24, providing a larger area for hair and similar matter to collect where it will not stall the robotic vacuum.

FIG. 11C shows an embodiment of a vacuum brush in accordance with the present teachings that includes a non-removable guard 98 having a protruding lip at its outer perimeter and creating a wide recessed area between the non-removable guard 98 and the circular flange 30 of the cage 24, providing a larger area for hair and similar matter to collect where it will not stall the robotic vacuum. Due to the diameter of the illustrated non-removable guard, this brush embodiment may not be backward compatible with existing cleaning heads.

Figure 12B:
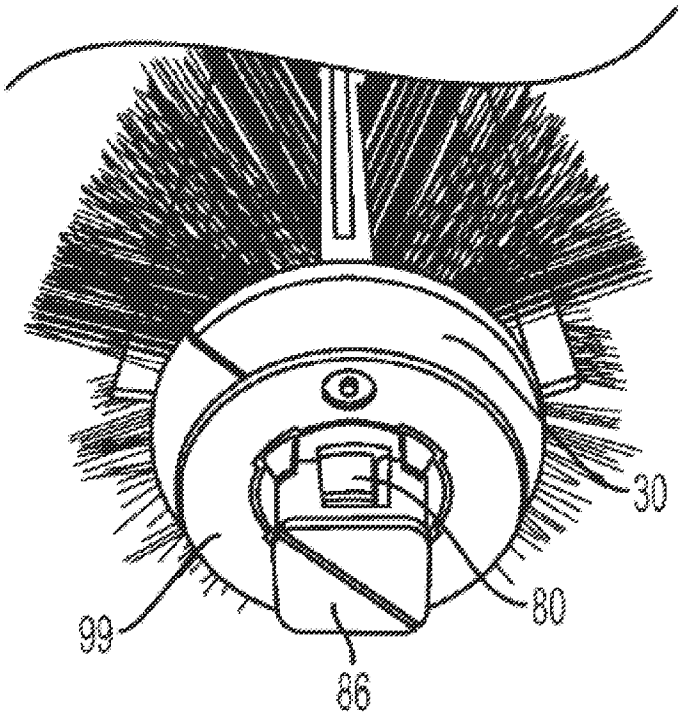
FIG. 12B is a front perspective view of an embodiment of a drive end portion of a robotic vacuum brush.
Figure 12A:
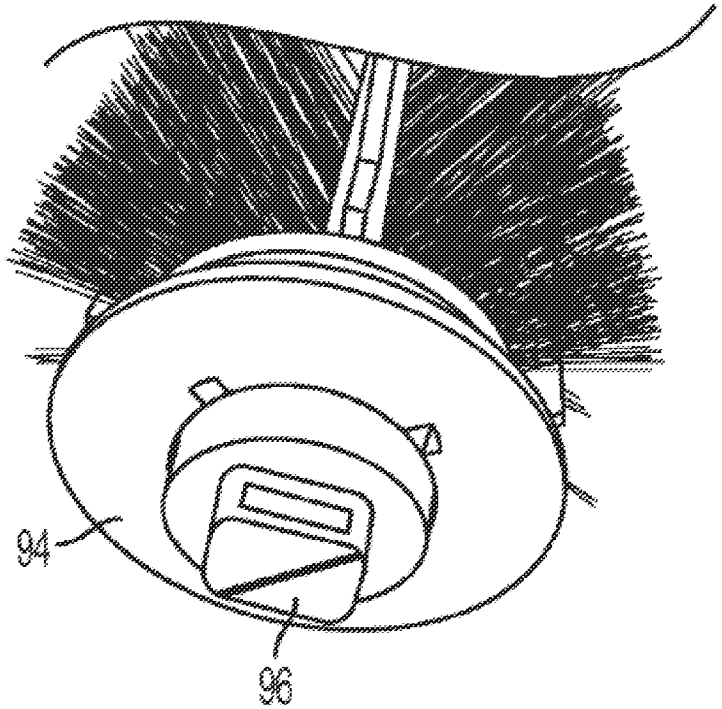
FIG. 12A is a front perspective view of a drive end portion of an existing robotic vacuum brush.

FIG. 12A is a front perspective view of a drive end portion of an existing robotic vacuum brush corresponding to FIG. 8A discussed above, and FIG. 12B is a front perspective view of an embodiment of a drive end portion of a robotic vacuum brush in accordance with the present teachings. The existing brush shown in FIG. 12A includes a removable guard 94 and a square drive protrusion 96. In contrast, the brush according to the present teachings shown in FIG. 12B includes a non-removable sleeve (not visible in FIG. 12A) with a guard 99 extending therefrom. The retention device 80 can be seen through an aperture in the illustrated drive end protrusion 86.

Figure 13:
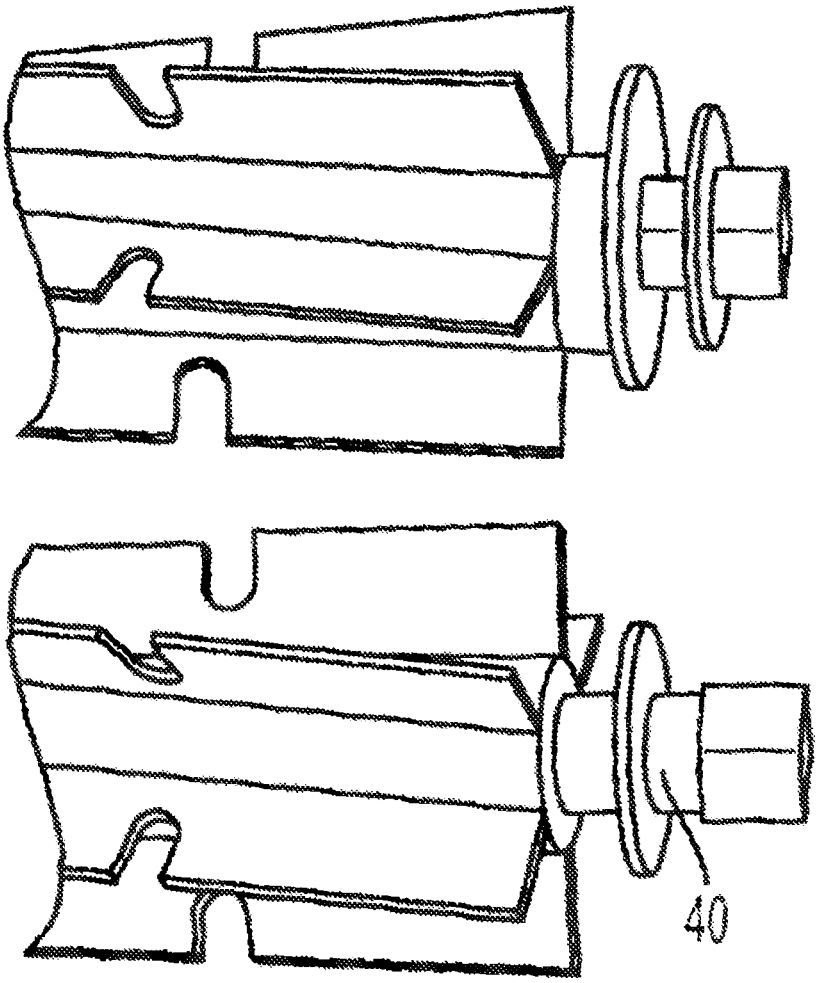
FIG. 13 is a side perspective view of an exemplary embodiment of an end portion of a robotic vacuum flapper brush (top) and a side perspective view of another exemplary embodiment of an end portion of a robotic vacuum brush (bottom).

FIG. 13 is a side perspective view of an exemplary embodiment of an end portion of a robotic vacuum flapper (top) and a side perspective view of another exemplary embodiment of an end portion of a robotic vacuum flapper (bottom). The drive end of the flapper brush is shown. The top flapper brush may include two flange or guard portions, while the bottom flapper brush may include a single flange or guard portion between the central member of the brush and the drive protrusion, with a reservoir 40 being defined between the single flange or guard portion and the shroud when the shroud is installed over the drive end of the flapper brush. It may be preferable to include a single flange or guard because the accumulation of the hair and other matter between the guards may cause melting of parts due to the increased humidity due to hair buildup.

Figure 14A:
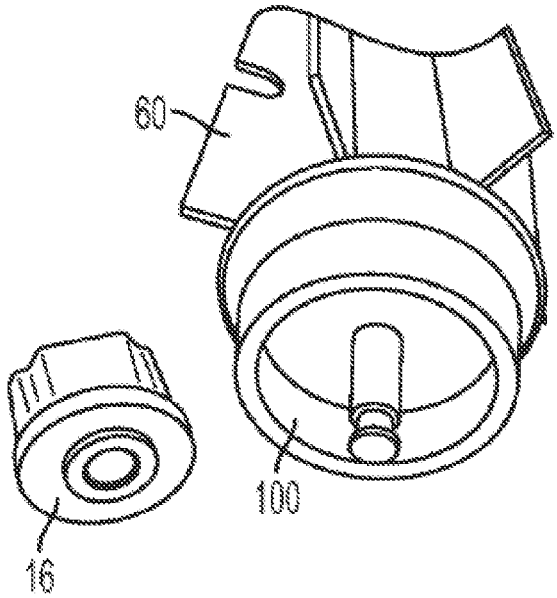
FIG. 14A is a perspective view of a bearing end portion of an existing flapper brush, with the bearing removed from the brush axle.
Figure 14B:
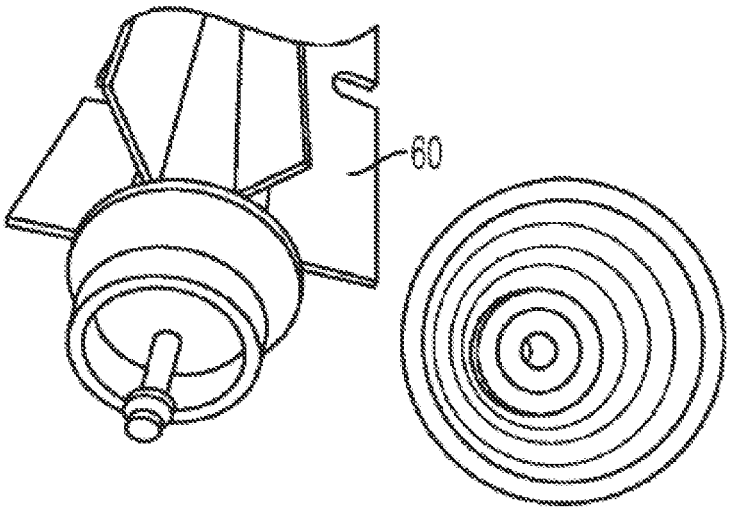
FIG. 14B is a perspective view of an embodiment of a bearing end portion of a brush with the shroud removed from the brush axle.
Figure 14C:
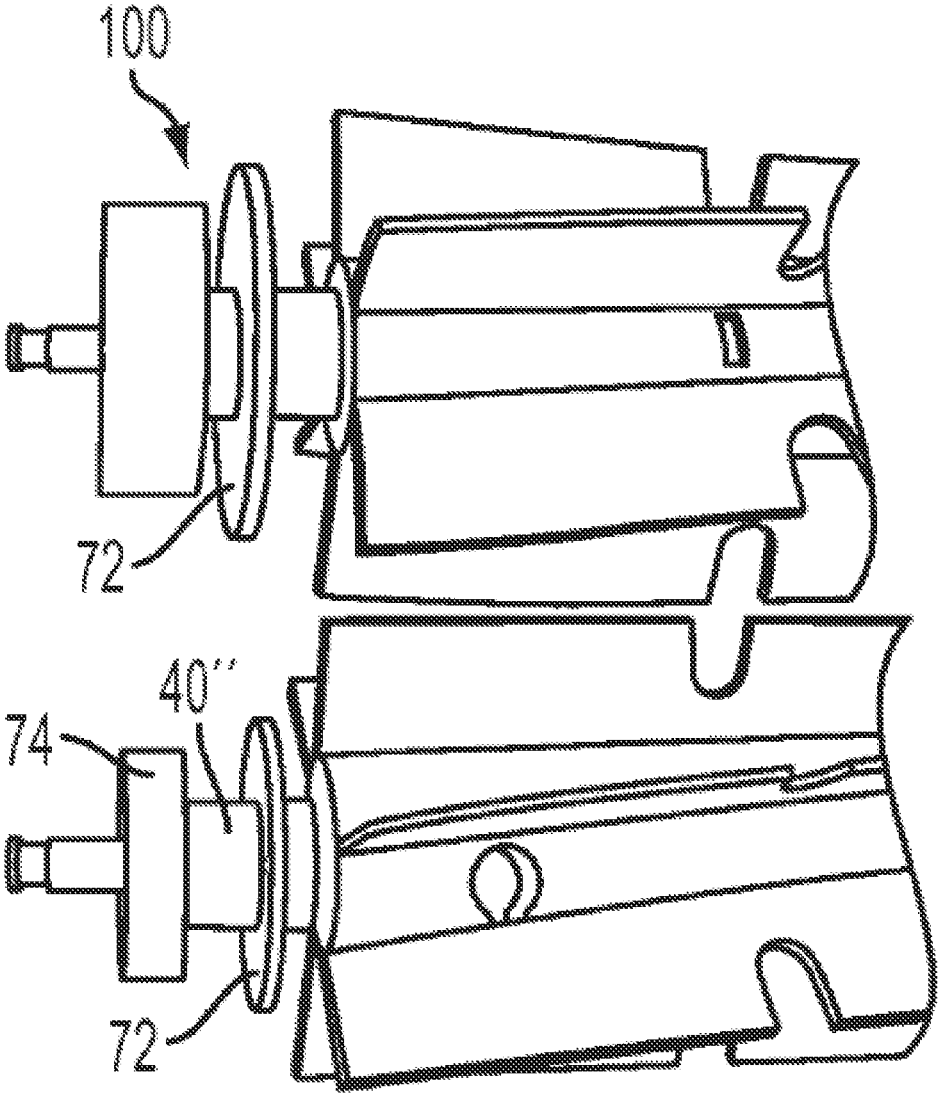
FIG. 14C is a top view providing a comparison of an existing robotic vacuum brush bearing end portion (top) and an embodiment of a robotic vacuum brush bearing end portion (bottom).

FIG. 14A illustrates an existing bearing end of a flapper brush. The bearing 16 is shown detached, but can be inserted on the axle or shaft and seated within a recess of an end piece 100 of the flapper brush 60. FIG. 14B illustrates an embodiment of a flapper end piece, which may be similar to the shaft housing 70 or 70' shown in FIGS. 5 and 6 in accordance with the present teachings, similar to or the same as the embodiment shown in cross section and discussed with respect to FIGS. 5 and 6, including a bearing 16 that is integrally molded or formed with a shroud, such as shroud 78 or 78' in FIGS. 5 and 6, for example. FIG. 14C provides a comparison between an existing bearing end (top) of a flapper brush and the embodiment of FIG. 11B (bottom), which shows a smaller size of a secondary guard (such as secondary guard 74, shown in FIG. 5, for example), but a larger reservoir (for example, recessed area 73 shown in FIG. 5 or reservoir 40" shown in FIG. 6) between the main guard 72 and the secondary guard 74 to hold hair and similar matter that has entered an interior of the shroud.

As stated above, certain embodiments of the present teachings contemplate a shroud provided for a drive end of the flapper brush, or an increased reservoir size for the flapper brush drive end.

Figure 15:
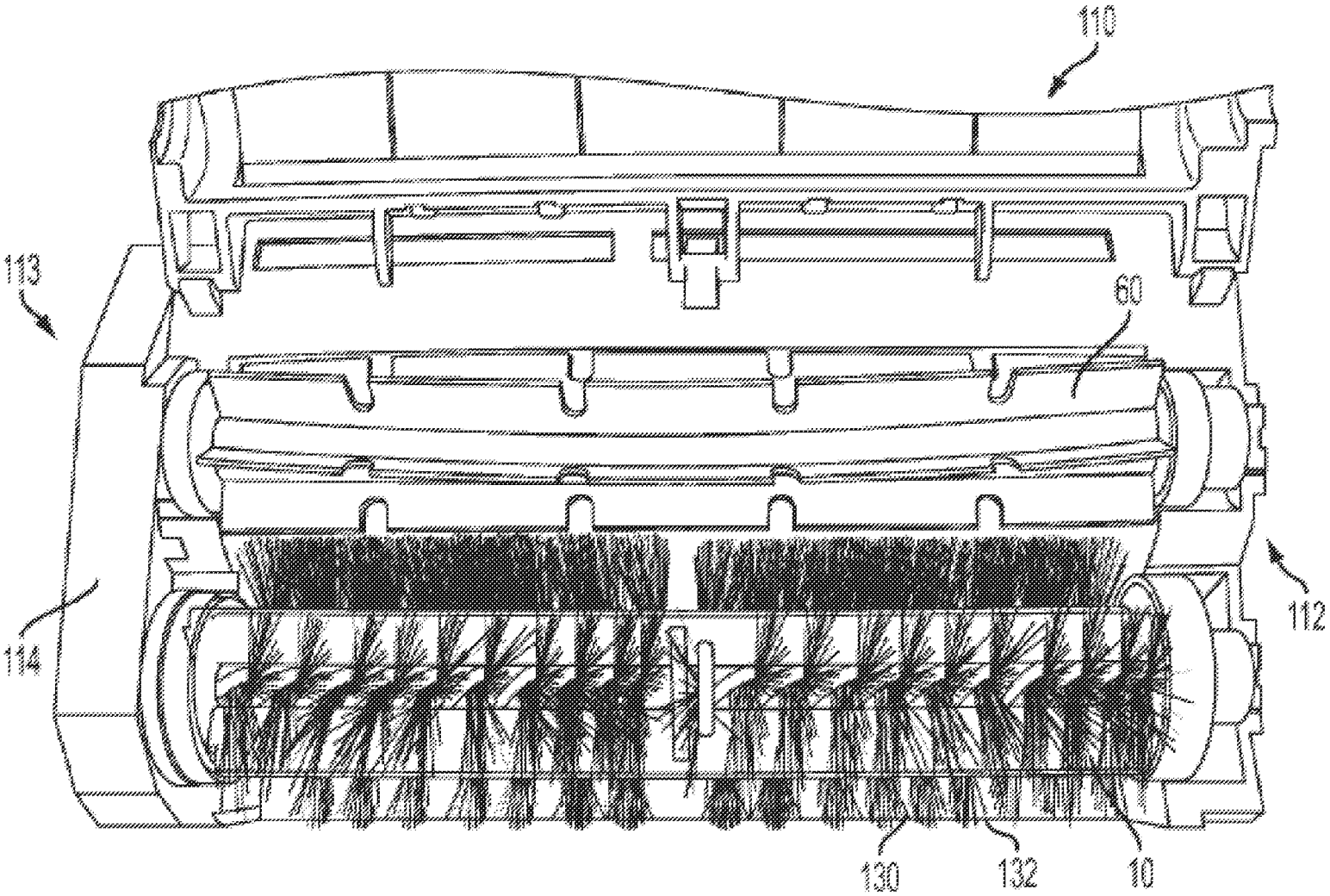
FIG. 15 is a front view of a cleaning head compartment.

FIG. 15 illustrates a cleaning head subsystem for a robotic vacuum with brushes having ends configured in accordance with various embodiments of the present teachings. FIG. 15 illustrates the cleaning head compartment 110 having a bearing end 112 and a drive end 113, with main 10 and flapper 60 brushes mounted therein, the bearing end 112 of the main 10 and flapper 60 brushes being shrouded in accordance with the present teachings and the drive end 113 of the brushes being provided with a shrouded gearbox housing 114 at the gearbox 81. It will be understood by one of ordinary skill in the art that any of the embodiments described above may be installed within the cleaning head compartment 110. The shrouded gearbox housing 114 including the gearbox 81 may be divorced from the cleaning head compartment 110 so that, for example, the shrouded gearbox may be able to be manufactured separately from the cleaning head compartment 110.

In addition, as shown in FIG. 15, the main brush 10 may include two sets of bristles 130, 132. A first set of bristles 130 may have a relatively larger diameter than a second set of bristles 132. More of the second set of bristles 132 may be provided, which provides more floor contact due to the increased number of bristles. Two bristle diameter types are provided to be able to pick up different types of materials. In an embodiment, approximately 70% of the second set of bristles may be provided, while approximately 30% of the first set of bristles may be provided. It will be understood to one of ordinary skill, however, that the percentages may be variable. In addition, the first set of bristles 130 may have a diameter of 0.2 mm, while the second set of bristles may have a diameter of 0.1 mm.

FIG. 16 is a front perspective view of an exemplary embodiment of a shrouded gearbox housing 114 for use on a drive end of a robotic vacuum cleaning head compartment in accordance with certain embodiments of the present teachings. Using the illustrated embodiment, the shrouding can be located on the gearbox rather than on the drive end of the flapper and brush engaged therewith to be driven. A partial cross section of the shrouded gearbox housing 114 can be seen in FIG. 7A and include a shroud 115 located around the main brush drive recess 116 and a shroud 117 located around the flapper brush drive recess 118. As seen in FIG. 16, for example, a plurality of reception recesses 128 may be disposed within the gear so that the gear is able to retain the retention device 80.

FIG. 17 is a top view of gears for the main brush and the flapper brush in accordance with the present teachings. FIG. 17 shows an exemplary embodiment of a gear 120 for the main brush, which may be similar to gear 82 of FIG. 8A, and an exemplary embodiment of a gear 124 for the flapper brush. The main brush gear 120 includes a gear recess 122, and the flapper brush gear 124 includes a gear recess 126. The main brush gear recess 122 is relatively larger than the flapper brush gear recess 126 as the drive protrusion for the main brush includes the retention device, which increases the size of the drive protrusion to be received into the gear recess 122. While it is shown and described to include the retention device 80 as part of the main brush 10 and received in the main brush gear 122, it will be understood by those of ordinary skill in the art that the flapper brush may additionally or alternatively include the retention device 80 and the recess 126 of the flapper brush gear 124 may have an increased size in this case due to the increased size of the drive protrusion including the retention device 80. As discussed above, a plurality of reception recesses 128 may be provided within the gear recess 122 in order to be able to retain the interlocking members 84 of the retention device 80.

Figure 18:
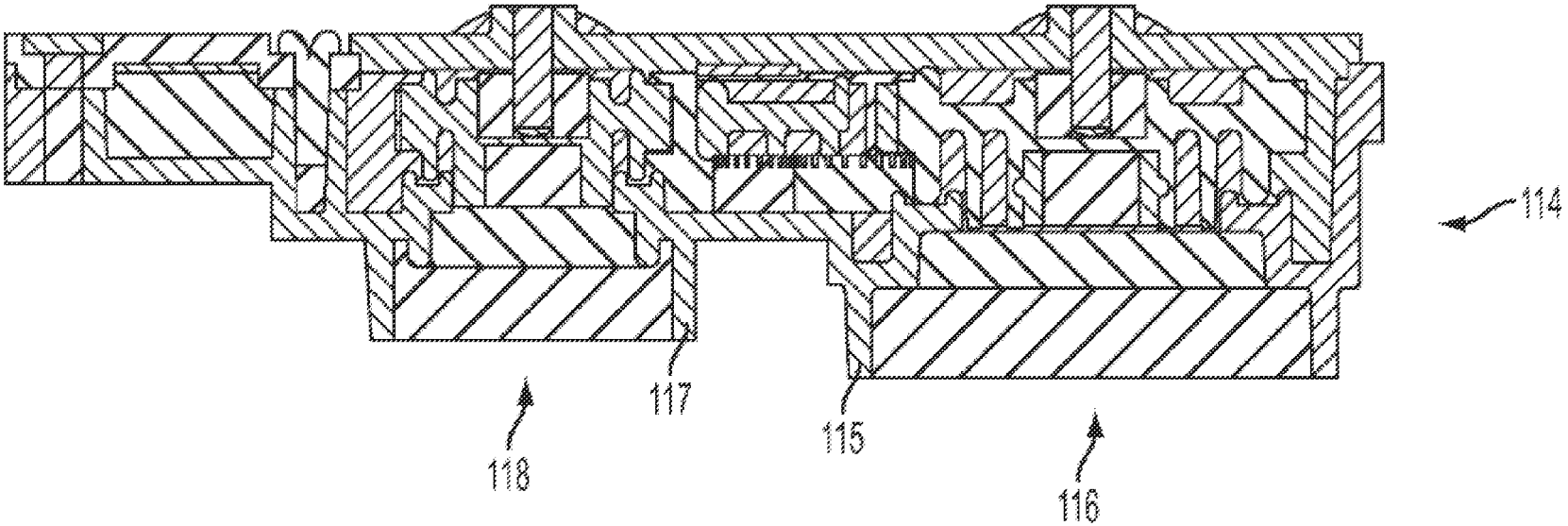
FIG. 18 is a cross-sectional view of the shrouded drive end of the cleaning head compartment.

FIG. 18 is a cross-sectional view of the divorced shrouded gearbox shown in FIG. 7A, for example. The shrouded gearbox 114 includes the shroud 115 located around the main brush drive recess 116 and the shroud 117 located around the flapper brush drive recess 118.

Figure 19A:
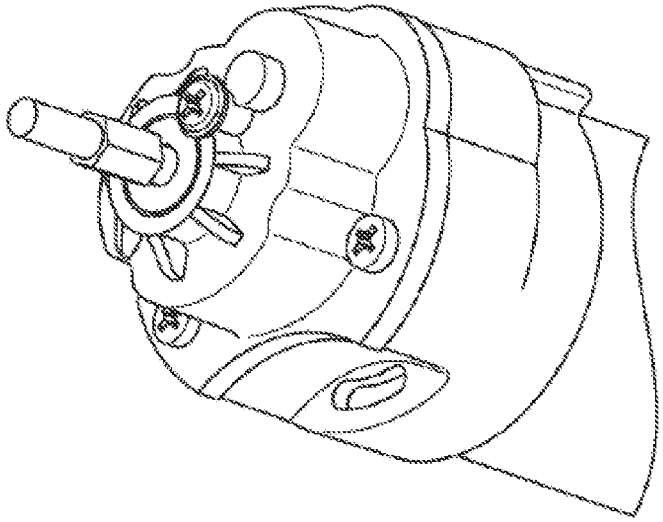
FIG. 19A is a perspective view of an existing motor.
Figure 19B:
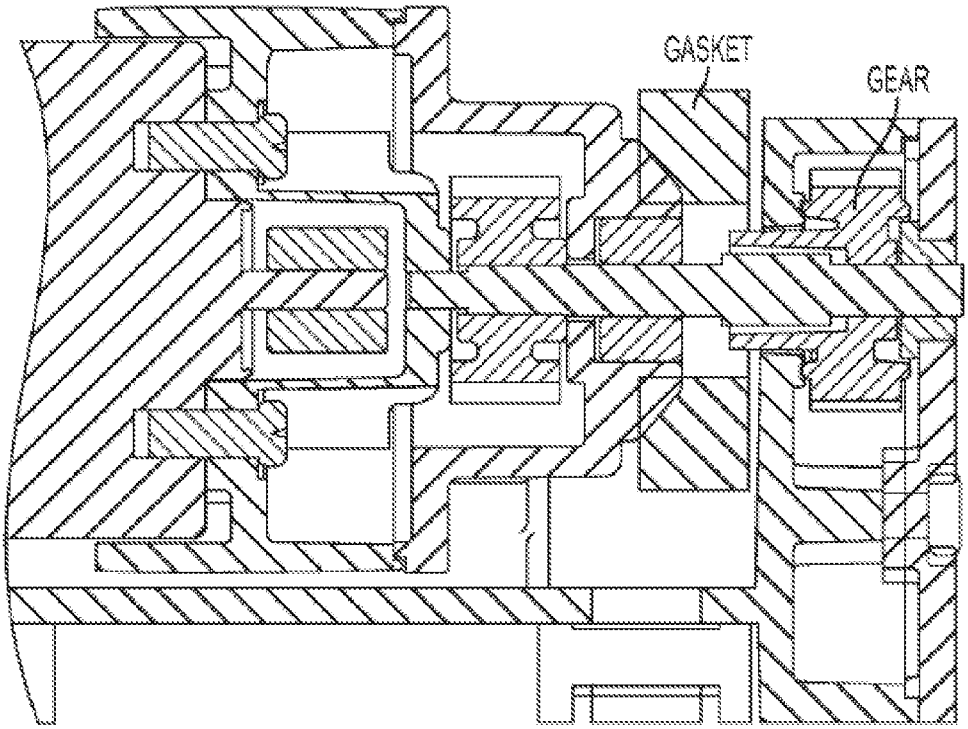
FIG. 19B is a cross-sectional view of the existing motor.
Figure 20A:
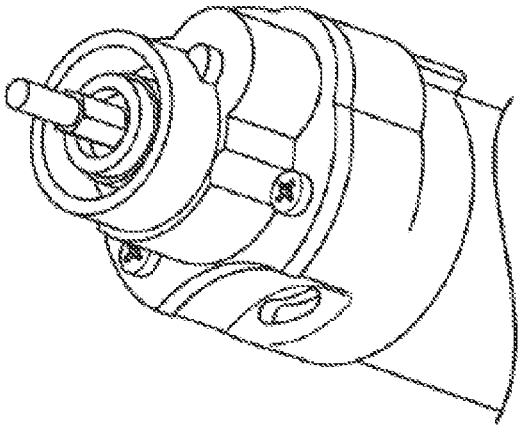
FIG. 20A is a perspective view of a shrouded motor in accordance with the present teachings.
Figure 20B:
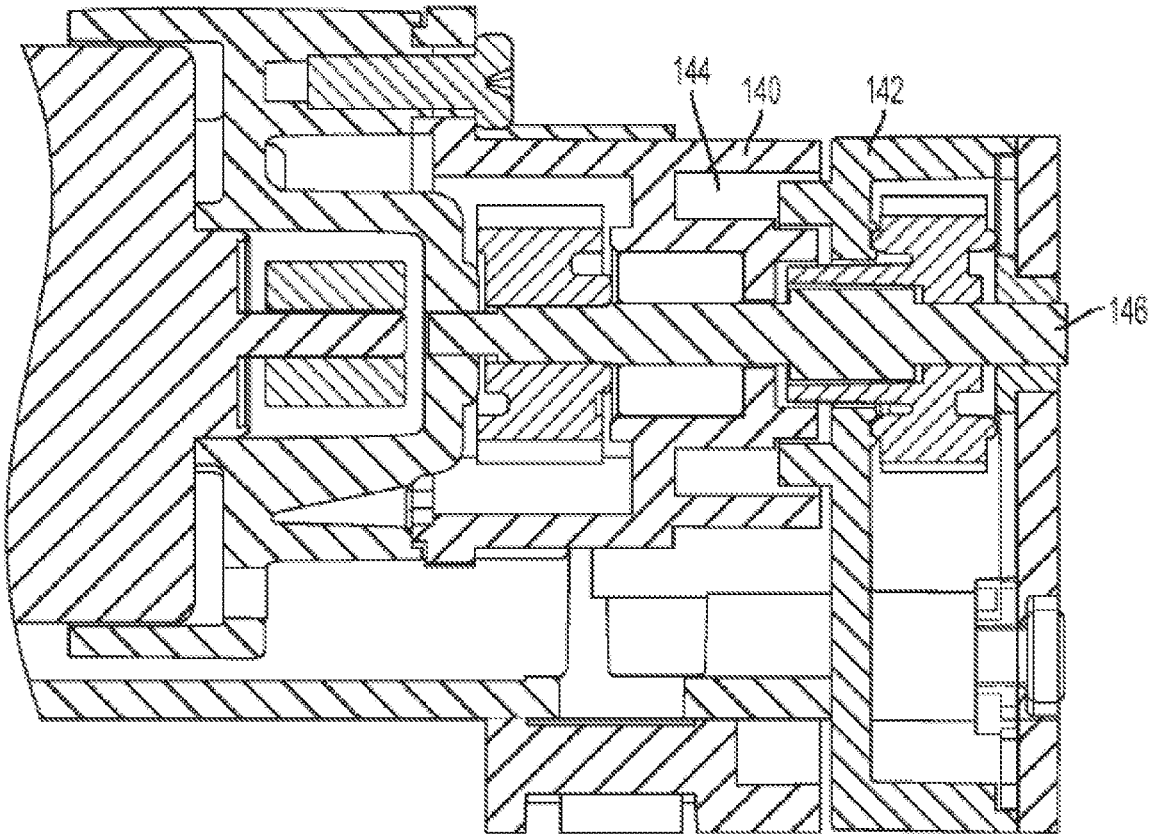
FIG. 20B is a cross-sectional view of the shrouded motor of FIG. 20A.
Figure 21:
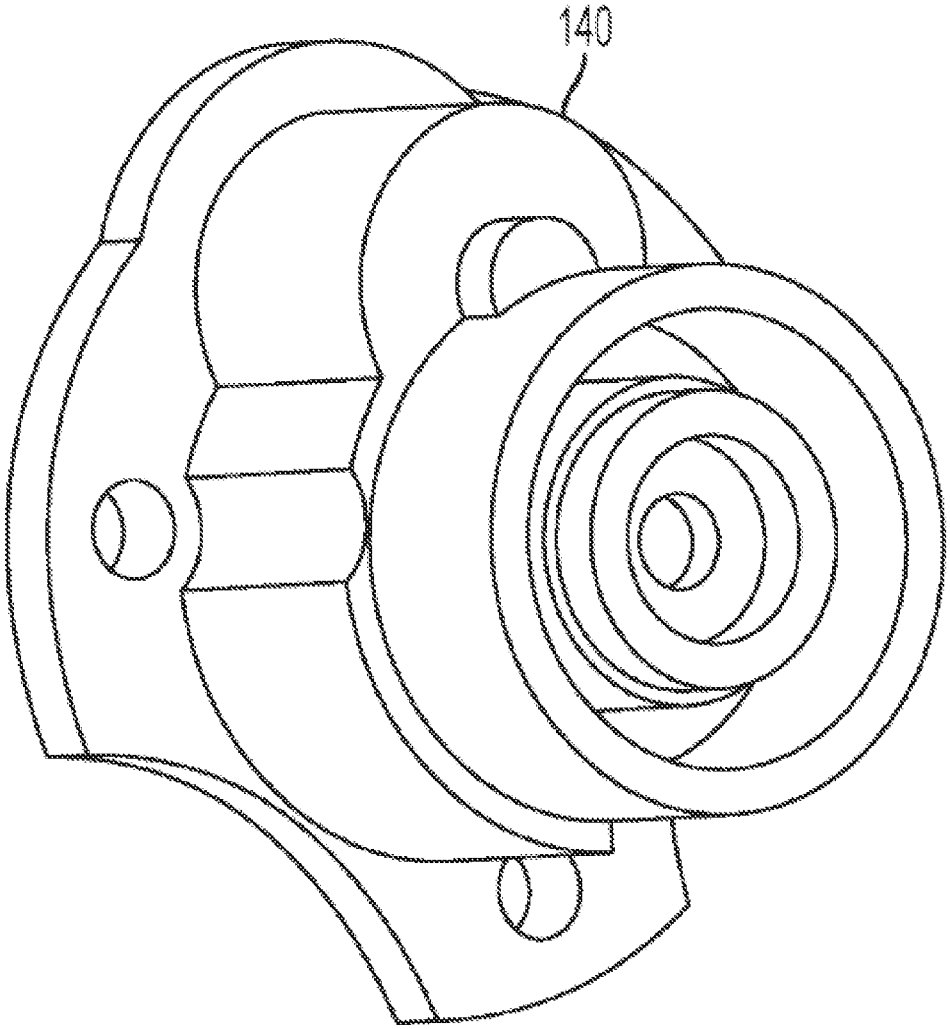
FIG. 21 is an exterior perspective view of the shroud for the motor shown in FIGS. 20A and 20B.

FIG. 19A is a perspective view of an existing motor, and FIG. 19B is a cross-sectional view of the existing motor. FIG. 20A is a perspective view of a shrouded motor in accordance with the present teachings, and FIG. 20B is a cross-sectional view of the shrouded motor of FIG. 20A in accordance with the present teachings. The motor shown in FIG. 20B includes a shroud 140 that engages with a gearbox housing 142, with a shaft 146 extending therethrough. A recessed collection area 144 is provided within interior of the shroud 140 and is able to additionally collect hair and other matter before the hair and other matter are able to migrate to the motor. FIG. 21 is an exterior perspective view of the shroud 140 for the motor shown in FIGS. 20A and 20B.

Other embodiments of the present teachings will be apparent to those skilled in the art from consideration of the specification and practice of the teachings disclosed herein. For example, the present teachings apply to a robotic vacuum having a single brush or a single brush having a structure in accordance with the present teachings, and to robotic vacuums having more than two brushes. In addition, the present teachings apply generally to rotating cleaning elements for a robotic vacuum that are configured to lift debris from the floor. The rotating cleaning elements can include a brush, a flapper, or a similar device. It is intended that the specification and examples be considered as exemplary only, with a true scope and spirit of the present teachings being indicated by the following claims.

What is claimed is:

1. A cleaning element insertable into a vacuuming compartment, the cleaning element comprising:

a brush defining a longitudinal axis and comprising:

a drive end portion configured to be driven to rotate the brush; and a bearing end portion including:

a shaft driven to rotate by the drive end portion;

a circular flange extending radially outward, the shaft extending axially beyond the circular flange; and a guard extending radially outward from the shaft;

a bearing configured to receive a portion of the shaft to allow the shaft to rotate when the shaft and the bearing are mounted in the vacuuming compartment; and a bearing shroud configured to support the bearing and to receive at least a portion of the guard therein, the circular flange located with respect to the bearing shroud to form a labyrinth passage between the circular flange and the bearing shroud when the cleaning element is located in the vacuuming compartment, and the guard is between the circular flange and the bearing shroud.

2. The cleaning element of claim 1, wherein the brush includes a brush cage, the shaft secured to the brush cage.

3. The cleaning element of claim 2, wherein the circular flange is integrally formed with or mounted to the brush cage.

4. The cleaning element of claim 1, wherein the labyrinth passage is formed between an outer diameter of the circular flange and a first wall of the bearing shroud.

5. The cleaning element of claim 4, further comprising:

a second wall that extends perpendicular to the first wall; and a third wall that extends from the second wall.

6. The cleaning element of claim 5, wherein the brush comprises a sleeve extending about at least a portion of the shall.

7. The cleaning element of claim 6, wherein the sleeve and a third wall of the bearing shroud form a second labyrinth passage therebetween.

8. The cleaning element of claim 6, wherein the bearing is provided separate from the bearing shroud.

9. A cleaning element releasably securable in a vacuuming compartment, the cleaning element comprising:

a brush defining a longitudinal axis, the brush comprising:

a drive end portion configured to be driven to rotate the brush; and a bearing end portion including:

a shaft configured to be driven to rotate by the drive end portion;

a flange extending radially outward, the shaft extending axially beyond the flange;

a guard extending radially outward from the shall and offset from the flange;

a bearing configured to receive at least a portion of the shaft to allow the shaft to rotate when the shall and the bearing are mounted in the vacuuming compartment; and a shroud configured to support the bearing and receive at least a portion of the guard therein, the shroud configured to at least partially surround the bearing end portion when the cleaning element is located in the vacuuming compartment, and the guard is between the circular flange and the bearing shroud.

10. The cleaning element of claim 9, wherein the shroud and the flange together form a labyrinth passage therebetween.

11. The cleaning element of claim 10, wherein the labyrinth passage is formed between an outer portion of the flange and a first wall of the shroud.

12. The cleaning element of claim 11, further comprising:

a second wall that extends perpendicular to the first wall; and a third wall that extends perpendicular from the second wall and parallel to the first wall.

13. The cleaning element of claim 12, wherein the brush comprises a sleeve extending around at least a portion of the shaft.

14. The cleaning element of claim 13, wherein the sleeve and a third wall of the shroud form a second labyrinth passage therebetween.

15. The cleaning element of claim 9, wherein the brush includes a brush cage, the shaft secured to the brush cage and the flange integrally formed with the brush cage.

16. The cleaning element of claim 9, wherein the drive end portion is connected to a drive gear configured to drive the brush to rotate.

17. A cleaning element insertable into a vacuuming compartment, the cleaning element comprising:

a brush defining a central axis and comprising a bearing end portion including:

a shaft rotatable about the central axis;

a flange extending radially outward, the shaft extending axially beyond the flange; and a guard extending radially outward from the shaft;

a bearing configured to receive at least a portion of the shaft to allow the shaft to rotate when the shaft and the bearing are located in the vacuuming compartment; and a shroud configured to support the bearing and located with respect to the flange to form a first labyrinth passage between the flange and the shroud and a second labyrinth passage between the guard and the shroud when the cleaning element is located in the vacuuming compartment, and the guard is between the circular flange and the bearing shroud.

18. The cleaning element of claim 17, wherein the first labyrinth passage is formed between an outer portion of the flange and a first wall of the shroud.

19. The cleaning element of claim 18, wherein the brush includes a brush cage, the shaft secured to the brush cage and the flange integrally formed with or mounted to the brush cage.

20. The cleaning element of claim 17, wherein the flange extends radially beyond the cage and the brush extends radially beyond the flange.

* * * * *